US010634085B2

(12) United States Patent
Okamura

(10) Patent No.: US 10,634,085 B2
(45) Date of Patent: Apr. 28, 2020

(54) CONTROL DEVICE FOR FUEL PUMP AND CONTROL METHOD THEREOF

(71) Applicant: TOYOTA JIDOSHA KABUSHIKI KAISHA, Toyota-shi, Aichi-ken (JP)

(72) Inventor: Seiji Okamura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/207,672

(22) Filed: Dec. 3, 2018

(65) Prior Publication Data

US 2019/0178198 A1 Jun. 13, 2019

(30) Foreign Application Priority Data

Dec. 13, 2017 (JP) ..... 2017-238769

(51) Int. Cl.

| | |
|---|---|
| ***F02D 41/38*** | (2006.01) |
| ***F02D 41/40*** | (2006.01) |
| ***F02M 59/20*** | (2006.01) |
| ***F02M 59/10*** | (2006.01) |

(52) U.S. Cl.

CPC ..... *F02D 41/3845* (2013.01); *F02D 41/401* (2013.01); *F02M 59/10* (2013.01); *F02M 59/20* (2013.01); *F02D 2200/101* (2013.01)

(58) Field of Classification Search

CPC ..... F02D 41/3845; F02D 41/401; F02D 2200/101; F02M 59/10; F02M 59/20

USPC ..... 123/445, 497

See application file for complete search history.

(56) References Cited

U.S. PATENT DOCUMENTS

| | | | | |
|---|---|---|---|---|
| 2004/0011335 | A1 | 1/2004 | Namari et al. | |
| 2004/0154594 | A1* | 8/2004 | Miyashita | F02D 33/003 123/458 |
| 2007/0125343 | A1 | 6/2007 | Hayakawa | |
| 2007/0251500 | A1 | 11/2007 | Kikutani et al. | |
| 2009/0217910 | A1 | 9/2009 | Alessandri et al. | |
| 2012/0156057 | A1* | 6/2012 | Akita | F02D 41/3082 417/44.2 |

FOREIGN PATENT DOCUMENTS

| | | | |
|---|---|---|---|
| DE | 102012112626 | A1 | 6/2013 |
| EP | 0802322 | A1 | 10/1997 |
| EP | 0962650 | A2 | 12/1999 |
| EP | 1369573 | A2 | 12/2003 |
| JP | 2000-008926 | A | 1/2000 |

(Continued)

*Primary Examiner* — Mahmoud Gimie
(74) *Attorney, Agent, or Firm* — Oliff PLC

(57) ABSTRACT

A control device for an fuel pump includes an electronic control unit. The fuel pump is an electric fuel pump configured to supply fuel to a fuel pipe to which a fuel injection valve disposed within a cylinder of an engine is coupled. The electronic control unit executes an inter-injection discharge control of executing fuel discharge from the fuel pump at a predetermined timing between an Nth fuel injection and an (N+1)th fuel injection from the fuel injection valve. The electronic control unit changes a discharge ratio in accordance with an operational state of the internal combustion engine during the execution of the inter-injection discharge control. The discharge ratio is a ratio of the number of times of fuel discharge from the high-pressure fuel pump to the number of times of fuel injection from the fuel injection valve.

15 Claims, 12 Drawing Sheets

(56) References Cited

FOREIGN PATENT DOCUMENTS

| | | | |
|---|---|---|---|
| JP | 2001-221137 | A | 8/2001 |
| JP | 2002-242786 | A | 8/2002 |
| JP | 2004-052596 | A | 2/2004 |
| JP | 2013-130106 | A | 7/2013 |
| KR | 10-2007-0105892 | A | 10/2007 |

* cited by examiner

CONTROL DEVICE FOR FUEL PUMP AND CONTROL METHOD THEREOF

INCORPORATION BY REFERENCE

The disclosure of Japanese Patent Application No. 2017-238769 filed on Dec. 13, 2017 including the specification, drawings and abstract is incorporated herein by reference in its entirety.

BACKGROUND

1. Technical Field

The present disclosure relates to a control device and a control method for a fuel pump.

2. Description of Related Art

An internal combustion engine disclosed in Japanese Unexamined Patent Application Publication No. 2004-052596 (JP 2004-052596 A) has a fuel injection valve that injects fuel into a cylinder of the internal combustion engine, a fuel pipe to which the fuel injection valve is coupled, and a fuel pump that supplies fuel to the fuel pipe. The fuel pump has a rod-shaped plunger and a cylinder. The rod-shaped plunger is disposed in a cylinder of the fuel pump. The plunger is made of a magnetic material. The plunger is always biased to a first side of the cylinder of the fuel pump by a biasing spring provided in the fuel pump. The fuel pump has a coil for exciting the plunger. When the coil is energized in the fuel pump, the plunger is excited by a magnetic field generated around the coil. When the plunger is excited, the plunger moves to a second side opposite to the first side against a biasing force of the biasing spring. When the energization of the coil is stopped, the excitation of the plunger ends and the plunger moves to the first side in accordance with the biasing force of the biasing spring. As described above, in the fuel pump, the plunger reciprocates between the first side and the second side inside the cylinder of the fuel pump. Each time the plunger reciprocates once, the fuel pump performs a suction function of suctioning fuel and a discharge function of pressurizing and discharging the suctioned fuel.

With a control device for the fuel pump disclosed in JP 2004-052596 A, when the rotation speed of the internal combustion engine is within a predetermined range, the driving start timing of the fuel pump is set to be slightly earlier than the start timing of fuel injection from the fuel injection valve, and an fuel injection period by the fuel injection valve and a discharge period of fuel from the fuel pump overlap each other. Accordingly, fluctuations of the fuel pressure in the fuel pipe while fuel is injected from the fuel injection valve are reduced.

With a control device for a fuel pump disclosed in US 2009-0217910 A, when a fuel injection amount from a fuel injection valve is within a predetermined range, a driving cycle of the fuel injection valve and a driving cycle of the fuel pump are set to be the same.

With the control device for the fuel pump disclosed in JP 2004-052596 A, when the rotation speed of the internal combustion engine is within a predetermined range, fuel is supplied to the fuel pipe by performing one fuel discharge from the fuel pump per one fuel injection from the fuel injection valve. With the control device for a fuel pump disclosed in US 2009-0217910 A, when the fuel injection amount from the fuel injection valve is within a predetermined range, fuel is supplied to the fuel pipe by performing one fuel discharge from the fuel pump per one fuel injection from the fuel injection valve. In the configurations of JP 2004-052596 A and US 2009-0217910 A, in order to allow a sufficient amount of fuel to be supplied to the fuel pipe with respect to the fuel injection amount from the fuel injection valve, it is necessary that the maximum amount of fuel that can be discharged from the fuel pump at one time be designed to be large. On the other hand, along with demands for reduction of the size of internal combustion engines, reduction of the size of fuel pumps is also desired.

SUMMARY

In small-sized fuel pumps, the maximum amount of fuel that can be discharged from the fuel pump at one time is small. For that reason, in a case where the control devices of the fuel pumps disclosed in JP 2004-052596 A and US 2009-0217910 A are applied to the small-sized fuel pumps, there is a possibility that a fuel amount discharged from the fuel pump at one time will be insufficient for a fuel injection amount from the fuel injection valve at one time and a sufficient amount of fuel cannot be supplied to the fuel pipe.

When the rotation speed of the internal combustion engine is out of the predetermined range in the control device for the fuel pump disclosed in JP 2004-052596 A or when the fuel injection amount from the fuel injection valve is out of the predetermined range in the control device for the fuel pump disclosed in US 2009-0217910 A, discharge from the fuel pump is performed in a predetermined cycle set in advance, without consideration of the timing of fuel injection from the fuel injection valve. In such a case, the timing of the fuel discharge with respect to the timing of the fuel injection is likely to fluctuate. The degree of change in the fuel pressure in the fuel pipe in the fuel injection period varies depending on whether or not the fuel injection period and the fuel discharge period overlap each other. In fuel injection control, it is desirable to set the fuel injection period or the like in consideration of the degree of change in the fuel pressure in the fuel injection period. However, in some cases, fluctuations in the timing of fuel discharge with respect to the timing of fuel injection make it difficult to estimate the fuel pressure in the injection period. In a direct-injection engine including a fuel injection valve disposed in a cylinder of the internal combustion engine, a fuel pipe for accumulating high-pressure fuel injected from the fuel injection valve, and a fuel pump that discharges fuel to the fuel pipe, because the high-pressure fuel is injected, there is a possibility that variations in an air-fuel ratio may exceed an allowable range due to fluctuations of the fuel pressure in the fuel injection period. For this reason, in the direct-injection engine that injects the high-pressure fuel into the cylinder, it is desirable to further improve the controllability of the fuel pressure in the fuel injection period while suppressing the variations in the air-fuel ratio within the allowable range. Regarding the above-described points, there is not any disclosure in JP 2004-052596 A or US 2009-0217910 A, and there is room for improvement in providing greater control over the fuel pressure in the fuel pipe.

A first aspect of the disclosure relates to a control device for a fuel pump including a cylinder, a plunger provided to be slidable inside the cylinder of the fuel pump, and an electric actuator configured to move the plunger. The fuel pump is an electric fuel pump configured to supply fuel to a fuel pipe to which a fuel injection valve is coupled. The fuel injection valve is disposed so as to inject fuel into a cylinder of an internal combustion engine is coupled. The fuel pump is configured to perform suction of fuel and discharge of fuel as the plunger reciprocates by an energization control to the electric actuator. The control device includes an electronic control unit. The electronic control unit is configured to execute an inter-injection discharge control of executing fuel discharge from the fuel pump at a predetermined timing between an Nth fuel injection and an (N+1)th fuel injection from the fuel injection valve. The electronic control unit is configured to change a discharge ratio in accordance with an operational state of the internal combustion engine during the execution of the inter-injection discharge control. The discharge ratio is a ratio of the number of times of fuel discharge from the fuel pump to the fuel pipe to the number of times of fuel injection from the fuel injection valve.

With the above-mentioned configuration, the inter-injection discharge control of executing fuel discharge from the fuel pump at the predetermined timing between the Nth fuel injection and the (N+1)th fuel injection from the fuel injection valve is executed. Accordingly, fuel discharge from the fuel pump can be performed so as to follow the fuel injection from the fuel injection valve. When the inter-injection discharge control is being executed, the ratio of the number of times of fuel discharge from the fuel pump to the fuel pipe to the number of times of fuel injection from the fuel injection valve is changed in accordance with the operational state of the internal combustion engine. That is, in a case where the discharge ratio is smaller than one, a case where the fuel discharge from the fuel pump is not performed one time until the next fuel injection is performed after fuel injection from the fuel injection valve is performed is included. In a case where the discharge ratio is 1 or more, a case where the fuel discharge from the fuel pump is performed two or more times until the next fuel injection is performed after fuel injection from the fuel injection valve is performed is included. Since the operational state of the internal combustion engine is correlated with the fuel injection amount, it is possible to change the discharge ratio in accordance with the operational state of the internal combustion engine. Thereby, it is possible to supply fuel with an amount matched with the fuel injection amount to the fuel pipe. By the inter-injection discharge control, fuel discharge is executed at the predetermined timing between the Nth fuel injection and the (N+1)th fuel injection from the fuel injection valve. For this reason, the fluctuation of the timing of the fuel discharge with respect to the timing of the fuel injection can be suppressed, and variations in the degree of change in the fuel pressure in an fuel injection period resulting from the above-described fluctuation can be suppressed. Hence, with the control device of the first aspect of the disclosure, an effect of improving the controllability of the fuel pressure in the fuel pipe is obtained.

In the control device, the electronic control unit may be configured to execute one of the following control i) and ii): i) control of making the discharge ratio smaller when a rotation speed of the internal combustion engine is high than when the rotation speed is low, and ii) control of making the discharge ratio smaller when an injection interval of fuel in the fuel injection valve is short than when the injection interval is long.

When fuel is discharged one time from the fuel pump, a corresponding time is required. With the above mentioned configuration, the discharge ratio when the rotation speed of the internal combustion engine is relatively high is smaller than the discharge ratio when the rotation speed is relatively low. When the rotation speed of the internal combustion engine is relatively low, the injection interval of fuel from the fuel injection valve tends to be relatively long. The discharge ratio when the fuel injection interval between execution of the present fuel injection and the execution of next fuel injection is relatively short is smaller than the discharge ratio when the injection interval is relatively long. The number of times of fuel discharge within the fuel injection interval can be reduced by making the discharge ratio small. For this reason, with the control device, while the number of times of fuel discharge within the fuel injection interval that is the limited period to a value capable of being realized, it is also possible to perform fuel discharge a plurality of times from the fuel pump with respect to a one-time fuel injection from the fuel injection valve when the injection interval is relatively long. Accordingly, the driving of the fuel pump can be appropriately controlled when the fuel pressure in the fuel pipe is controlled.

In the control device, the electronic control unit may be configured to set the discharge ratio to a higher value when a target discharge amount is large than when the target discharge amount is relatively small. The target discharge amount may be a target value of a fuel discharge amount from the fuel pump.

With the above-mentioned configuration, the discharge ratio when the target discharge amount that is the target value of a fuel discharge amount is relatively large is higher than the discharge ratio when the target discharge amount is relatively small. For example, in a case where the target discharge amount is larger than the maximum discharge amount of the fuel capable of being discharged one time from the fuel pump, it is possible to perform fuel discharge a plurality of times from the fuel pump with respect to a one-time fuel injection from the fuel injection valve by making the discharge ratio higher than that in a case where the target discharge amount is smaller than the maximum amount. Since the target discharge amount is correlated with the fuel injection amount, when the target discharge amount is relatively large, it is possible to supply the fuel with an amount matched with the fuel injection amount to the fuel pipe by making the discharge ratio higher than that when the target discharge amount is relatively small.

In the control device, the electronic control unit may be configured to set the discharge ratio to a value higher than one during the execution of the inter-injection discharge control. With the above-mentioned configuration, fuel discharge can be performed a plurality of times from the fuel pump within a period between the execution of the present fuel injection and the execution of next fuel injection. For this reason, it is possible to set the maximum discharge amount of the fuel pump to be smaller, and a smaller-sized fuel pump can also be selected so as to match the maximum discharge amount of the fuel pump.

In the control device, the electronic control unit may be configured to set the discharge ratio to a value lower than one during the execution of the inter-injection discharge control. With the above-mentioned configuration, the number of times of the fuel discharge within a period between the execution of the present fuel injection and the execution of next fuel injection can be made smaller than one time. That is, the fuel discharge from the fuel pump within the period between the execution of the present fuel injection and the execution of next fuel injection can be made not to be performed even one time. For this reason, it is also possible to stop driving the fuel pump, and the driving frequency of the fuel pump can be lowered as compared to a case where the fuel pump is continuously driven. Hence, an effect of suppressing electrical power consumption can also be obtained.

In the control device, the electronic control unit may be configured to set an upper limit of the discharge ratio, based on a fuel injection interval between execution of the present fuel injection and execution of next fuel injection.

The time required to discharge fuel from the fuel pump may be longer than the fuel injection interval from the fuel injection valve. In the control device, the upper limit of the discharge ratio, which is the ratio of the number of times of discharge of the fuel from the fuel pump to the fuel pipe to the number of times of injection of the fuel from the fuel injection valve, is set based on the injection interval between execution of the present fuel injection and execution of next fuel injection. For that reason, it is possible to suppress a situation in which the time required to discharge fuel from the fuel pump becomes longer than the fuel injection interval from the fuel injection valve. Hence, it is possible to suppress a situation in which the number of times of discharge of fuel within the fuel injection interval that is a limited period is set to a value incapable of being realized and the driving of the fuel pump can be appropriately controlled.

In the control device, the electronic control unit may be configured to change the discharge ratio, based on a target discharge amount that is a target value of a fuel discharge amount from the fuel pump to the fuel pipe. According to this configuration, the discharge ratio is changed based on the target discharge amount. For this reason, in a case where the target discharge amount is larger than the maximum amount of the fuel capable of being discharged one time from the fuel pump, it is possible to supply fuel equivalent to the target discharge amount to the fuel pipe by setting the discharge ratio to a high value and performing fuel discharge a plurality of times from the fuel pump with respect to a one-time fuel injection from the fuel injection valve. Hence, with the above-mentioned configuration, the control of setting the discharge ratio corresponding to the target discharge amount can be realized.

In the control device, the electronic control unit may be configured to perform calculation so as to make the target discharge amount larger when a load of the internal combustion engine is high than when the load of the internal combustion engine is low. The electronic control unit may be configured to perform calculation so as to make the target discharge amount larger when a rotation speed of the internal combustion engine is high than when the rotation speed of the internal combustion engine is low.

A one-time fuel injection amount from the fuel injection valve when the load of the internal combustion engine is high is larger than the one-time fuel injection amount when the load of the internal combustion engine is low. Since the fuel injection interval is short when the rotation speed of the internal combustion engine is relatively high, there is a need for setting the fuel pressure in the fuel pipe to be relatively high compared to that when the rotation speed is relatively low. Hence, as in the configuration mentioned above, the pressure of the fuel in the fuel pipe can be appropriately controlled by calculating the target discharge amount of the fuel pump so as to be larger in a case where the load of the internal combustion engine is high compared to that in a case where the load is low, and calculating the target discharge amount so as to be larger when the rotation speed of the internal combustion engine is relatively high compared to that when the rotation speed is relatively low.

In the control device, the electronic control unit may be configured to set the discharge ratio to a higher value when a load of the internal combustion engine is high than when the load of the internal combustion engine is low. A one-time fuel injection amount from the fuel injection valve when the load of the internal combustion engine is high is larger than the one-time fuel injection amount when the load of the internal combustion engine is low. Since the maximum amount of the fuel discharged one time from the fuel pump can be obtained in advance, the discharge ratio when the load of the internal combustion engine is high is set to a higher value than the discharge ratio when the load is relatively low. That is, the discharge ratio is set to a higher value when the amount of the fuel injected from the fuel valve is large than when the amount of the fuel is relatively small. Accordingly, the pressure of the fuel in the fuel pipe can be appropriately controlled.

In the control device, the electronic control unit may be configured to execute the inter-injection discharge control when a fuel injection interval between the execution of the present fuel injection and the execution of next fuel injection is equal to or more than a required time. The electronic control unit may be configured to execute an individual control of repeatedly performing discharge of fuel in a fixed cycle in a case where the injection interval is shorter than the required time. The required time may be a time required to discharge fuel one time from the fuel pump.

With the above-mentioned configuration, in a case where the fuel injection interval is equal to or more than the required time that is the time required for the fuel pump to discharge fuel one time, the inter-injection discharge control is executed. Accordingly, when the fuel discharge from the fuel pump can be completed within the fuel injection interval, fuel discharge is executed at the predetermined timing between the Nth fuel injection and the (N+1)th fuel injection. For that reason, the controllability of the fuel pressure in the fuel pipe can be maintained.

In a case where the injection interval is shorter than the required time, the fuel discharge from the fuel pump cannot be completed within the fuel injection interval in the fuel injection valve. In this case, the individual control of repeatedly executing discharge of fuel in the fixed cycle regardless of the timing of fuel injection is executed. In the individual control, fuel is repeatedly discharged from the fuel pump without taking into consideration the timing of the fuel injection from the fuel injection valve.

With the above-mentioned configuration, in a case where the fuel injection interval is shorter than the required time, switching is made from the inter-injection discharge control to the individual control. Accordingly, it is also possible to give priority to securing the fuel discharge amount with respect to the fuel injection amount.

In the control device, the electronic control unit may be configured to set a timing at which fuel discharge is executed so as not to overlap a fuel injection period that is a period in which fuel injected from the fuel injection valve, in the inter-injection discharge control.

With the above-mentioned configuration, when the fuel injection from the fuel injection valve is performed, discharge of fuel is not performed from the fuel pump. For this reason, fluctuation of the fuel pressure within the fuel pipe resulting from the fuel discharge being performed from the fuel pump does not easily influence the fuel injection. Hence, the timing of fuel supply to the fuel pipe can be appropriately controlled.

In the control device, the electronic control unit may be configured to execute fuel discharge from the fuel pump after an end of the Nth fuel injection and before a start of the (N+1)th fuel injection, in the inter-injection discharge control.

With the above-mentioned configuration, the fuel discharge is executed so as not to overlap the fuel injection period. For this reason, it is possible to restrain fuel from being discharged from the fuel pump when the fuel injection from the fuel injection valve is performed. Hence, with the above-mentioned configuration, compared to a case where fuel discharge is executed so as to overlap at least one of the Nth fuel injection period and the (N+1)th fuel injection period, the influence of fluctuation of the fuel pressure within the fuel pipe resulting from the fuel discharge from the fuel pump can be made difficult to occur in the fuel injection.

In the control device, the electronic control unit may be configured to execute fuel discharge from the fuel pump so as to overlap a fuel injection period of any of the Nth fuel injection and the (N+1)th fuel injection within a period from a start of the Nth fuel injection to an end of the (N+1)th fuel injection, in the inter-injection discharge control.

With the above-mentioned configuration, the fuel discharge is executed so as not to overlap one of the Nth fuel injection period from the fuel injection valve and the (N+1) th fuel injection period from the fuel injection valve. For this reason, compared to a case where fuel discharge is executed so as to overlap both of the Nth fuel injection period and the (N+1)th fuel injection period in the fuel injection valve, the influence of fluctuation of the fuel pressure within the fuel pipe resulting from the fuel discharge from the fuel pump can be made difficult to occur in the fuel injection.

In the control device, the electronic control unit may be configured not to perform a discharge of fuel from the fuel pump to the fuel pipe when a difference between a target fuel pressure and an actual fuel pressure of the fuel pipe is less than a predetermined value during the execution of the inter-injection discharge control. The electronic control unit may be configured to perform a discharge of fuel from the fuel pump to the fuel pipe until next fuel injection is started when the difference between the target fuel pressure and the actual fuel pressure is more than the predetermined value.

With the above-mentioned configuration, when the inter-injection discharge control is being executed and the difference between the target fuel pressure and the actual fuel pressure of the fuel pipe is less than the predetermined value, discharge of the fuel from the fuel pump to the fuel pipe is not performed. For this reason, a discharge mode including a case where the fuel discharge from the fuel pump is not performed even one time until the next fuel injection is performed after fuel injection is performed from the fuel injection valve can be realized, and the ratio of the number of times of discharge of the fuel from the fuel pump to the fuel pipe to the number of times of injection of the fuel from the fuel injection valve can be made smaller than one. When the difference between the target fuel pressure and the actual fuel pressure of the fuel pipe is equal to or more than the predetermined value, discharge of the fuel from the fuel pump to the fuel pipe is performed until the next fuel injection is started. As described above it is possible to execute fuel discharge matched with the fuel injection amount by determining execution need of the discharge of fuel in accordance with the fuel injection amount.

A second aspect of the disclosure relates to a control method of a fuel pump. The fuel pump includes a cylinder, a plunger provided to be slidable inside the cylinder of the fuel pump, and an electric actuator configured to move the plunger. The fuel pump is an electric fuel pump configured to supply fuel to a fuel pipe to which a fuel injection valve is coupled. The fuel injection valve is disposed so as to inject fuel into a cylinder of an internal combustion engine. The fuel pump is configured to perform suction of fuel and discharge of fuel as the plunger reciprocates by an energization control to the electric actuator. The control method includes: executing, by an electronic control unit, an inter-injection discharge control of executing fuel discharge from the fuel pump at a predetermined timing between an Nth fuel injection and an (N+1)th fuel injection from the fuel injection valve; and changing, by the electronic control unit, a discharge ratio in accordance with an operational state of the internal combustion engine during the execution of the inter-injection discharge control, is the discharge ratio being a ratio of the number of times of discharge of fuel from the fuel pump to the fuel pipe to the number of times of fuel injection from the fuel injection valve.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

First Embodiment

Figure 1:
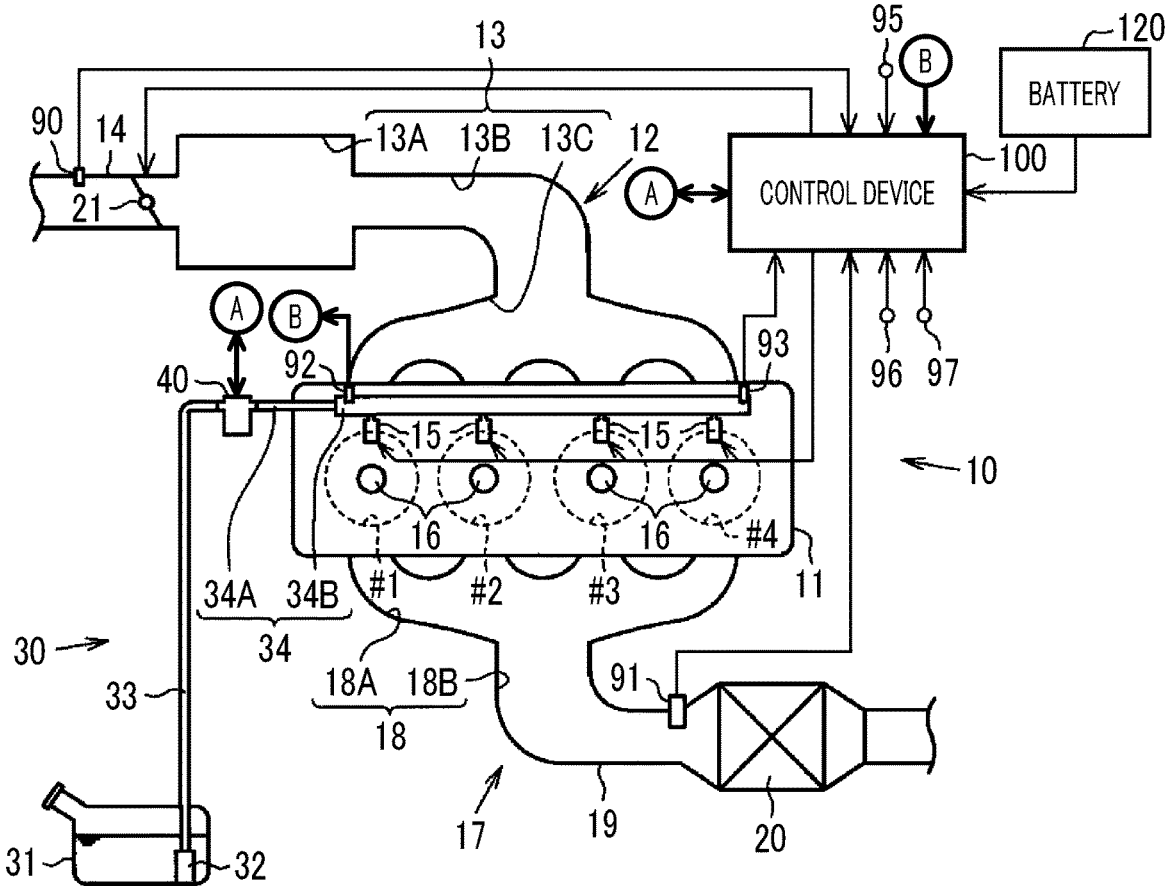
FIG. 1 is a schematic view illustrating the configuration of an internal combustion engine having a control device for a fuel pump of a first embodiment.

A first embodiment of a control device for a fuel pump will be described with reference to FIGS. 1 to 6. As illustrated in FIG. 1, four cylinders (a first cylinder #1 to a fourth cylinder #4) are disposed in an engine body 11 of an internal combustion engine 10 mounted on a vehicle. An intake passage 12 is coupled to the engine body 11. The intake passage 12 includes an intake manifold 13 and an intake pipe 14 connected to an intake upstream end part of the intake manifold 13. The intake manifold 13 includes a surge tank 13A to which the intake pipe 14 is coupled, an intake introduction part 13B provided on an intake downstream side of the surge tank 13A, and an intake branching part 13C provided on an intake downstream side of the intake introduction part 13B. The surge tank 13A has a passage cross-sectional area larger than the intake pipe 14 and the intake introduction part 13B. An intake downstream end part of the intake branching part 13C are branched into four end parts, and the branched end parts are respectively connected to the separate cylinders. The intake pipe 14 is provided with a throttle valve 21. By controlling the opening degree of the throttle valve 21, the flow rate of intake air flowing through the intake passage 12 is controlled. The air that has flowed into the intake manifold 13 from the intake pipe 14 is supplied to the respective cylinders #1 to #4. The intake pipe 14 is provided with an air flow meter 90 that detects the flow rate of the intake air flowing through the intake passage 12 to an intake upstream side of the throttle valve 21.

The engine body 11 is provided with a plurality of fuel injection valves 15. One fuel injection valve 15 is provided for each of the cylinders. The fuel injection valve 15 is disposed within the cylinder of the internal combustion engine 10 to inject fuel into the cylinder. Each of the cylinders #1 to #4 is provided with an ignition plug 16. In each of the cylinders #1 to #4, the intake air introduced from the intake passage 12 and the fuel injected from the fuel injection valve 15 are mixed with each other to generate an air-fuel mixture. The mass ratio of the intake air and the fuel in the air-fuel mixture is called an air-fuel ratio. The air-fuel mixture is ignited and combusted by the ignition plug 16.

An exhaust passage 17 is coupled to the engine body 11. The exhaust passage 17 includes an exhaust manifold 18, and an exhaust pipe 19 connected to an exhaust downstream end part of the exhaust manifold 18. The exhaust manifold 18 includes an exhaust branching part 18A coupled to the engine body 11, and an exhaust joining part 18B provided on an exhaust downstream side of the exhaust branching part 18A. An exhaust upstream end part of the exhaust branching part 18A is branched into four end parts, and the branched end parts are respectively connected to the separate cylinders. In each of the cylinder #1 to #4, the exhaust gas generated by the combustion of the air-fuel mixture is discharged to the exhaust manifold 18. The exhaust passage 17 is provided with a catalyst 20 that is disposed at the exhaust pipe 19 to control the exhaust gas. An air-fuel ratio sensor 91 is disposed on an exhaust upstream side of the catalyst 20 in the exhaust pipe 19. The air-fuel ratio sensor 91 outputs an electrical signal in accordance with the oxygen concentration of exhaust gas flowing through the exhaust passage 17, that is, the air-fuel ratio of the combusted air-fuel mixture.

The internal combustion engine 10 is provided with a fuel supply device 30 for supplying fuel to the fuel injection valves 15. The fuel supply device 30 has a fuel tank 31 in which fuel is stored. A low-pressure fuel pump 32 is disposed inside the fuel tank 31. A first end of a low-pressure fuel pipe 33 is coupled to the low-pressure fuel pump 32. The low-pressure fuel pump 32 is an electric fuel pump, and pumps up the fuel within the fuel tank 31 to discharge the pumped oil to the low-pressure fuel pipe 33. A high-pressure fuel pump 40 is coupled to a second end of the low-pressure fuel pipe 33. A high-pressure fuel pipe 34 is coupled to the high-pressure fuel pump 40. The high-pressure fuel pipe 34 includes a discharge pipe 34A coupled to the high-pressure fuel pump 40, and a delivery pipe 34B connected to the discharge pipe 34A. The respective fuel injection valves 15 are coupled to the delivery pipe 34B. The fuel discharged from the low-pressure fuel pump 32 to the low-pressure fuel pipe 33 is suctioned to the high-pressure fuel pump 40. In the high-pressure fuel pump 40, the suctioned fuel is pressurized and discharged to the discharge pipe 34A. The fuel discharged to the discharge pipe 34A is supplied to the delivery pipe 34B and is injected into a cylinder from each fuel injection valve 15. In the high-pressure fuel pipe 34, a pressure sensor 92 is provided at an end part of the delivery pipe 34B on the discharge pipe 34A side. The pressure sensor 92 detects a fuel pressure Pr within the high-pressure fuel pipe 34. In the high-pressure fuel pipe 34, a fuel temperature sensor 93 is provided at an end part of the delivery pipe 34B opposite to the discharge pipe 34A. The fuel temperature sensor 93 measures the temperature of the fuel within the high-pressure fuel pipe 34.

Figure 2:
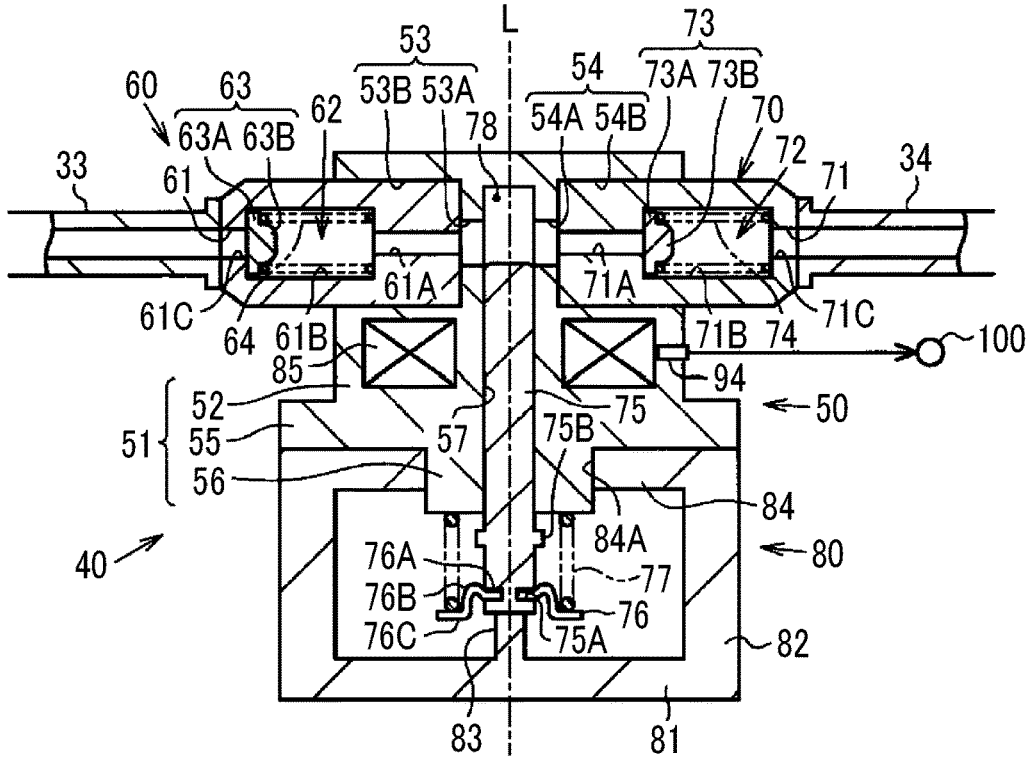
FIG. 2 is a sectional view of a high-pressure fuel pump.

As illustrated in FIG. 2, the high-pressure fuel pump 40 has a pump part 50 that suctions and pressurizes fuel, and a case part 80 to which the pump part 50 is coupled. The case part 80 is formed in a box shape. The case part 80 has a bottom wall 81 formed in a disk shape, and a peripheral side wall 82 erected from a peripheral edge of the bottom wall 81. A central portion of the bottom wall 81 provided with a columnar protruding part 83 protruding toward an inner region side of the case part 80. The peripheral side wall 82 is provided continuously over the entire peripheral edge of the bottom wall 81 and is formed in a cylindrical shape. An upper end of the peripheral side wall 82 is connected to a top wall 84. The top wall 84 is formed in a disk shape, and a through hole 84A is formed at a central portion of the top wall 84.

The pump part 50 has a housing 51 fixed to an upper end surface of the top wall 84. The housing 51 includes a body part 52 formed in a columnar shape, a flange part 55 disposed between the body part 52 and the top wall 84, and an insertion part 56 erected from the flange part 55. The flange part 55 has a larger diameter than the body part 52 and abuts against the top wall 84. The insertion part 56 passes through the through hole 84A from the flange part 55 and extends up to an inner region of the case part 80. The external diameter of the insertion part 56 is the same as the internal diameter of the through hole 84A. For that reason, an outer peripheral surface of the insertion part 56 abuts against the inner peripheral surface of the through hole 84A of the top wall 84. A cylinder 57 is formed in the housing 51. The cylinder 57 extends from a first end surface (lower end surface of FIG. 2) of the insertion part 56 to the interior of the body part 52. In the following, an extension direction (upward-downward direction of FIG. 2) of a central axis L of the cylinder 57 is simply referred to as an axial direction.

A first orthogonal hole 53 and a second orthogonal hole 54, which extend in an orthogonal direction (rightward-leftward direction of FIG. 2) orthogonal to the axial direction and communicate with the cylinder 57, are formed in the body part 52. The first orthogonal hole 53 and the second orthogonal hole 54 extend in mutually opposite directions from the cylinder 57. The first orthogonal hole 53 has a first smaller-diameter part 53A communicating with the cylinder 57, a first larger-diameter part 53B extending and opening from the first smaller-diameter part 53A to a side peripheral surface of the body part 52. A suction valve 60 is inserted and fitted into the first larger-diameter part 53B.

The suction valve 60 is formed in a columnar shape and is attached in a state where the suction valve protrudes from the body part 52. A suction passage 61, which penetrates and extends in the orthogonal direction, is formed in the suction valve 60. The suction passage 61 includes a first suction path 61A connected to the first smaller-diameter part 53A, a second suction path 61B that is connected to the first suction path 61A and has a larger diameter than the first suction path 61A, and a third suction path 61C connected to and the second suction path 61B and having the same diameter as the first suction path 61A. A first check valve 62 is disposed in the second suction path 61B. The first check valve 62 includes a first valve body 63, and a first spring 64 that biases the first valve body 63 to the third suction path 61C side. The first valve body 63 includes a first biasing part 63A that abuts against an end surface on the third suction path 61C side (a left side of FIG. 2), and a first bulge part 63B that bulges from a central part of the first biasing part 63A to the first suction path 61A side (a right side of FIG. 2). The first bulge part 63B is formed in a hemispherical shape. The first spring 64 has a first end abutting against an end surface of the second suction path 61B on the first suction path 61A side and has the second end abutting against the first biasing part 63A of the first valve body 63. The low-pressure fuel pipe 33 is coupled to the suction valve 60, and fuel is supplied from the low-pressure fuel pipe 33 to the third suction path 61C.

The second orthogonal hole 54 has a second smaller-diameter part 54A communicating with the cylinder 57, and a second larger-diameter part 54B extending and opening from the second smaller-diameter part 54A to the side peripheral surface of the body part 52. A discharge valve 70 is inserted and fitted into the second larger-diameter part 54B. The discharge valve 70 is formed in a columnar shape and is attached in a state where the discharge valve protrudes from the body part 52. The discharge valve 70 and the suction valve 60 are disposed side by side on the same axis extending in the orthogonal direction. A discharge passage 71, which penetrates and extends in the orthogonal direction, is formed in the discharge valve 70. The discharge passage 71 includes a first discharge path 71A connected to the second smaller-diameter part 54A, a second discharge path 71B connected to the first discharge path 71A and having a larger diameter than the first discharge path 71A, and a third discharge passage 71C connected to the second discharge path 71B and having the same diameter as the first discharge path 71A and where a diameter. A second check valve 72 is disposed in the second discharge path 71B.

The second check valve 72 includes a second valve body 73, and a second spring 74 that biases the second valve body 73 to the first discharge path 71A side. The second valve body 73 includes a second biasing part 73A that abuts against an end surface on the first discharge path 71A side (the left side of FIG. 2), and a second bulge part 73B that bulges from a central part of the second biasing part 73A to the third discharge passage 71C side (the right side of FIG. 2). The second bulge part 73B is formed in a hemispherical shape. The second spring 74 has a first end abutting against an end surface of the second discharge path 71B on the third discharge passage 71C side and has a second end abutting against the second biasing part 73A of the second valve body 73. The high-pressure fuel pipe 34 is coupled to the discharge valve 70.

The pump part 50 is inserted through the cylinder 57, and has a plunger 75 that is slidable inside the cylinder 57. The plunger 75 is made of a magnetic material. The plunger 75 is formed in a columnar rod shape, and a first end part (an upper end part of FIG. 2) of the plunger 75 is inserted through the cylinder 57 from the insertion part 56 side. A second end part of the plunger 75 is disposed in the inner region of the case part 80. A recessed strip 75A is formed at the second end part of the plunger 75. The recessed strip 75A extends over the entire periphery in a circumferential direction. For that reason, the plunger 75 is adapted such that a portion in which the recessed strip 75A is formed is partially reduced in diameter. An annular plate-shaped seat 76 is coupled to the recessed strip 75A. The seat 76 includes a central part 76A inserted through the recessed strip 75A, a curved part 76B that is curved radially outward and extends from the central part 76A, and a flat plate part 76C extending in a flat plate shape radially outward from the curved part 76B. A compression spring 77 is disposed between the flat plate part 76C and the insertion part 56 of the housing 51. The compression spring 77 is biased in a direction in which the seat 76 is separated from the housing 51, that is, a direction in which the plunger 75 is pulled out from the cylinder 57 (a lower side of FIG. 2). The second end face of the plunger 75 is pressed against an upper end surface of the protruding part 83 of the case part 80 by the biasing force of the compression spring 77. A protruding portion 75B is formed at the second end part of the plunger 75 closer to a first end side than the recessed strip 75A. The protruding portion 75B extends over the entire periphery in the circumferential direction. For that reason, the plunger 75 is adapted such that a portion on which the protruding portion 75B is formed is partially increased in diameter. The diameter of the protruding portion 75B is larger than the diameter of the cylinder 57. A pressurizing chamber 78 of the pump part 50 is constituted of the cylinder 57, a plunger 75, the first smaller-diameter part 53A, the first suction path 61A, the second suction path 61B, the second smaller-diameter part 54A, and the first discharge path 71A.

In the high-pressure fuel pump 40, a coil 85 is disposed in the body part 52 of the housing 51 so as to surround the periphery of the cylinder 57. The coil 85 generates a magnetic field by being energized. When the coil 85 is energized in the high-pressure fuel pump 40, the plunger 75 is excited by the magnetic field generated around the coil 85.

Figure 3:
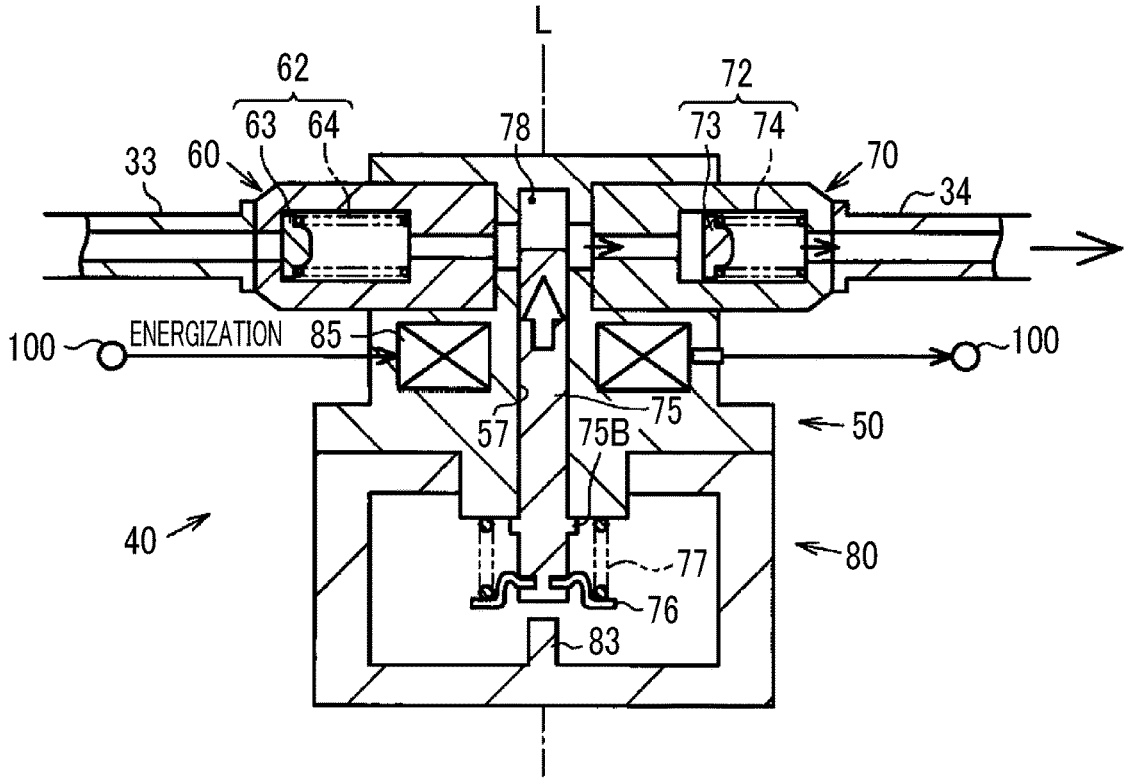
FIG. 3 is a sectional view illustrating a state at the time of fuel discharge in the high-pressure fuel pump.

When the plunger 75 is excited as indicated by an outlined arrow in FIG. 3, the plunger 75 moves to a first side (upper side of FIG. 3) in the axial direction against the biasing force of the compression spring 77. The plunger 75 moves to the first side until the protruding portion 75B abuts against the insertion part 56. As described above, when the plunger 75 has moved, the volume of the pressurizing chamber 78 of the pump part 50 decreases, and the pressure within the pressurizing chamber 78 increases. Since fuel is supplied to the pressurizing chamber 78 of the pump part 50 as will be described below, the discharge valve 70 of the pump part 50 is opened as the pressure of the pressurizing chamber 78 increases. That is, the pressure within the pressurizing chamber 78 acts on the second valve body 73 of the discharge valve 70 in the valve opening direction, and the pressure within the high-pressure fuel pipe 34 and the biasing force of the second spring 74 act on the second valve body 73 in a valve closing direction. When the pressure within the pressurizing chamber 78 increases and a force biasing the second valve body 73 in the valve opening direction becomes stronger than a force biasing the second valve body 73 in the valve closing direction, the second valve body 73 is opened. When the second valve body 73 is opened, fuel is discharged from the pressurizing chamber 78 to the high-pressure fuel pipe 34 as indicated by a solid-line arrow in FIG. 3. When fuel is discharged from the high-pressure fuel pump 40 to the high-pressure fuel pipe 34, the suction valve 60 is held in a valve-closed state due to the pressure within the pressurizing chamber 78. When the energization to the coil 85 is stopped, the excitation of the plunger 75 is released.

Figure 4:
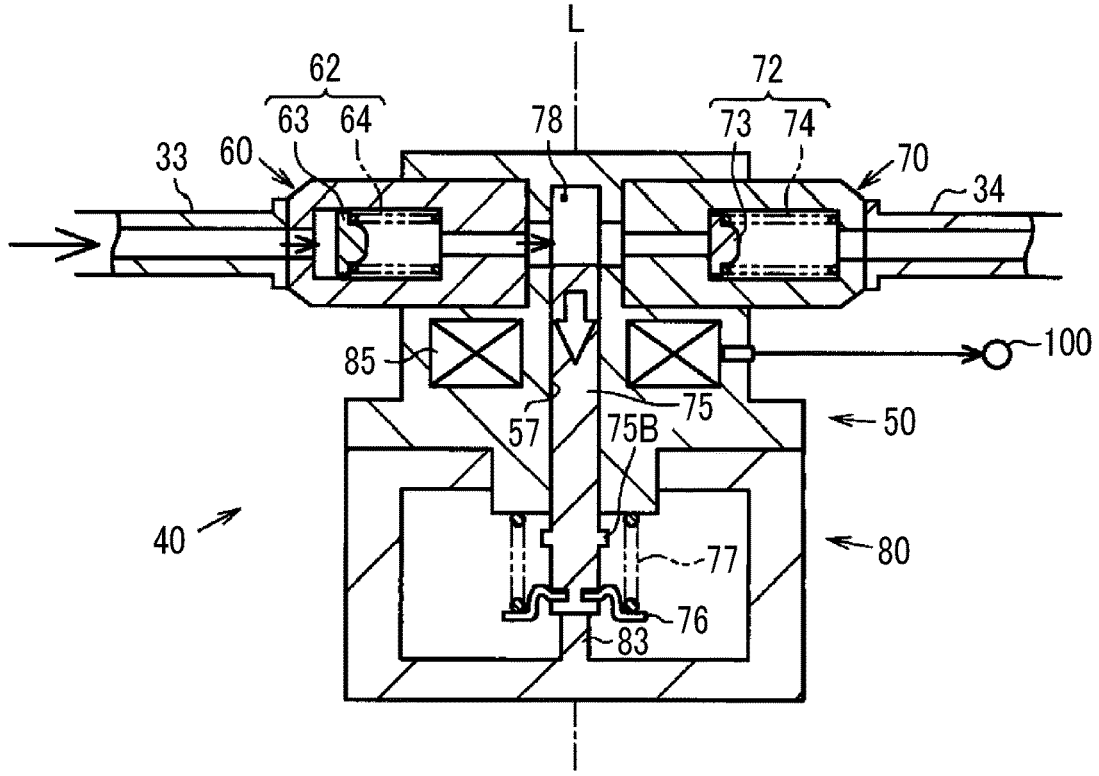
FIG. 4 is a sectional view illustrating a state at the time of fuel suction in the high-pressure fuel pump.

When the excitation of the plunger 75 is released as indicated by an outlined arrow in FIG. 4, the plunger 75 moves to a second side (lower side of FIG. 4) in the axial direction due to the biasing force of the compression spring 77 so as to be pulled out from the cylinder 57. The plunger 75 moves to the second side until the second end part of the plunger 75 abuts against the protruding part 83. As described above, when the plunger 75 has moved, the volume of the pressurizing chamber 78 of the pump part 50 increases, and the pressure within the pressurizing chamber 78 decreases. The pressure within the low-pressure fuel pipe 33 acts on the first valve body 63 of the suction valve 60 of the pump part 50 in the valve opening direction, and the pressure within the pressurizing chamber 78 and the biasing force of the first spring 64 act on the first valve body 63 in the valve closing direction. When the pressure within the pressurizing chamber 78 decreases and a force biasing the first valve body 63 in the valve closing direction becomes weaker than a force biasing the first valve body 63 in the valve opening direction, the first valve body 63 is opened. When the first valve body 63 is opened, fuel is supplied from the low-pressure fuel pipe 33 to the pressurizing chamber 78 as indicated by a solid-line arrow in FIG. 4. As described above, when the high-pressure fuel pump 40 is suctioning the fuel from the low-pressure fuel pipe 33, the discharge valve 70 is held in a valve-closed state due to the pressure within the high-pressure fuel pipe 34.

As described above, the plunger 75 reciprocates between the first side and the second side in the axial direction inside the cylinder 57 in accordance with the state of energization to the coil 85. For that reason, the coil 85 is equivalent to an electric actuator for moving the plunger 75. Whenever the plunger 75 reciprocates once, the high-pressure fuel pump 40 performs a suction function of suctioning fuel and a discharge function of pressurizing and discharging the suctioned fuel. The body part 52 of the fuel pump is provided with a coil temperature sensor 94. The coil temperature sensor 94 detects the temperature of the coil 85.

As illustrated in FIG. 1, the fuel supply device 30 has an electronic control unit 100 for the fuel pump. The internal combustion engine 10 is provided with a battery 120. The battery 120 supplies electrical power to the respective parts of the internal combustion engine 10, such as the electronic control unit 100 for the fuel pump.

Output signals from the air flow meter 90, the air-fuel ratio sensor 91, the pressure sensor 92, the fuel temperature sensor 93, and the coil temperature sensor 94 are input to the electronic control unit 100. An output signal of a crank angle sensor 95 that detects an engine speed NE that is the rotation speed of a crankshaft of the internal combustion engine 10 and a crank angle CA that is the rotational phase of the crankshaft is also input to the electronic control unit 100. Output signals from various sensors, such as an accelerator sensor 96 that detects an accelerator operation amount Acc that is the operation amount of an accelerator pedal, and a vehicle speed sensor 97 that detects a vehicle speed V, are also input to the electronic control unit 100. The electronic control unit 100 includes a central processing unit (CPU), a read-only memory (ROM), and a random access memory (RAM). The electronic control unit 100 controls driving of the fuel injection valves 15, driving of the throttle valve 21, and driving of the high-pressure fuel pump 40 as the CPU executes a program stored in the ROM.

Figure 5:
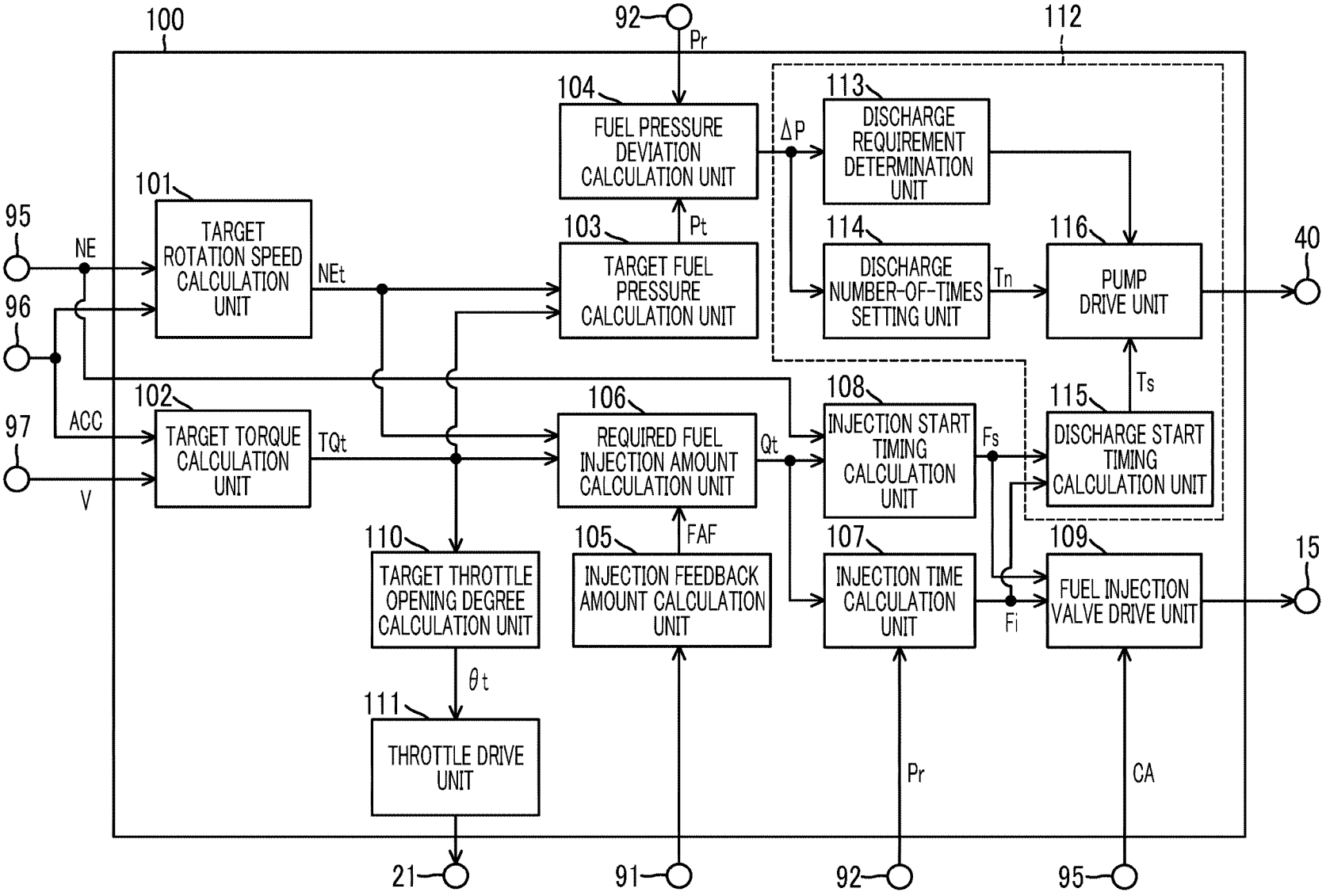
FIG. 5 is a functional block diagram of a control device.

As illustrated in FIG. 5, the electronic control unit 100 includes, as functional units, a target rotation speed calculation unit 101, a target torque calculation unit 102, a target fuel pressure calculation unit 103, a fuel pressure deviation calculation unit 104, an injection feedback amount calculation unit 105, a required fuel injection amount calculation unit 106, an injection time calculation unit 107, an injection start timing calculation unit 108, and a fuel injection valve drive unit 109. The electronic control unit 100 also includes, as functional units, a target throttle opening degree calculation unit 110, a throttle drive unit 111, and an inter-injection discharge control execution unit 112.

The target rotation speed calculation unit 101 calculates a target rotation speed NEt, which is a target value of the engine speed NE, based on the engine speed NE detected by the crank angle sensor 95 and the accelerator operation amount Acc detected by the accelerator sensor 96.

The target torque calculation unit 102 calculates a target torque TQt, which is a target value of the output torque of the crankshaft of the internal combustion engine 10, based on the vehicle speed V detected by the vehicle speed sensor 97 and the accelerator operation amount Acc detected by the accelerator sensor 96.

The target fuel pressure calculation unit 103 calculates a target fuel pressure Pt, which is a target value of the fuel pressure within the high-pressure fuel pipe 34, based on the target rotation speed NEt calculated by the target rotation speed calculation unit 101 and the target torque TQt calculated by the target torque calculation unit 102. A map showing a relationship between the target rotation speed NEt and the target torque TQt, and the target fuel pressure Pt is stored in the target fuel pressure calculation unit 103. The map showing the relationship between the target rotation speed NEt and the target torque TQt, and the target fuel pressure Pt is obtained in advance by experiments or simulations. The target fuel pressure Pt is calculated so as to be higher when the target rotation speed NEt is relatively high than when the target rotation speed NEt is relatively low. The target fuel pressure Pt is calculated so as to be higher when the target torque TQt is relatively large than when the target torque TQt is relatively small.

The fuel pressure deviation calculation unit 104 calculates a fuel pressure deviation $\Delta P$ (=Pt−Pr) that is a difference obtained by subtracting the fuel pressure Pr within the high-pressure fuel pipe 34 detected by the pressure sensor 92 from the target fuel pressure Pt calculated by the target fuel pressure calculation unit 103.

The injection feedback amount calculation unit 105 calculates an injection feedback amount FAF for controlling feedback of an actual air-fuel ratio detected by the air-fuel ratio sensor 91 to a target air-fuel ratio that is a target value of the air-fuel ratio. The target air-fuel ratio is calculated by the electronic control unit 100 based on the operational state of the internal combustion engine 10. The injection feedback amount calculation unit 105 calculates the injection feedback amount FAF as the sum of respective output values of a proportional element, an integral element, and a derivative element having a value obtained by subtracting the actual air-fuel ratio from the target air-fuel ratio as an input value.

The required fuel injection amount calculation unit 106 calculates a required fuel injection amount Qt that is each target value of the amount of fuel injected from each fuel injection valve 15. The required fuel injection amount calculation unit 106 calculates a base injection amount Qb, based on the target rotation speed NEt calculated by the target rotation speed calculation unit 101 and the target torque TQt calculated by the target torque calculation unit 102. The base injection amount Qb is calculated so as to be larger when the target rotation speed NEt is relatively high than when the target rotation speed NEt is relatively low. The base injection amount Qb is calculated so as to be larger when the target torque TQt is relatively large than when the target torque TQt is relatively small. The base injection amount Qb is calculated as a fuel injection amount corresponding to the target air-fuel ratio. The required fuel injection amount calculation unit 106 calculates the required fuel injection amount Qt by multiplying the base injection amount Qb by the injection feedback amount FAF calculated by the injection feedback amount calculation unit 105.

The injection time calculation unit 107 calculates an injection time Fi that is the execution time of fuel injection in each fuel injection valve 15, based on the required fuel injection amount Qt calculated by the required fuel injection amount calculation unit 106 and the fuel pressure Pr detected by the pressure sensor 92.

The injection start timing calculation unit 108 calculates an injection start timing Fs that is a timing at which fuel injection is started from each fuel injection valve 15, based on the required fuel injection amount Qt calculated by the required fuel injection amount calculation unit 106, the injection time Fi calculated by the injection time calculation unit 107, and the engine speed NE detected by the crank angle sensor 95. Each injection start timing Fs in the fuel injection valve 15 is calculated such that fuel injection equivalent to the required fuel injection amount Qt is completed till the ignition timing of a cylinder in which the fuel injection valve 15 is disposed.

The fuel injection valve drive unit 109 drives each fuel injection valve 15, based on the crank angle CA detected by the crank angle sensor 95. The fuel injection valve drive unit 109 controls the driving of the fuel injection valve 15 such that the fuel injection from the fuel injection valve 15 is started, at the injection start timing Fs of each fuel injection valve 15 calculated by the injection start timing calculation unit 108. When fuel injection is continued during the injection time Fi calculated by the injection time calculation unit 107 after the fuel injection is started, the fuel injection valve drive unit 109 ends the fuel injection from the fuel injection valve 15.

The target throttle opening degree calculation unit 110 calculates a target throttle opening degree θt, which is a target value of the opening degree of the throttle valve 21, based on the target torque TQt calculated by the target torque calculation unit 102.

The throttle drive unit 111 controls the opening degree of the throttle valve 21 so as to be the target throttle opening degree θt calculated by the target throttle opening degree calculation unit 110. The inter-injection discharge control execution unit 112 executes an inter-injection discharge control of executing fuel discharge from the high-pressure fuel pump 40 at a predetermined timing between an Nth fuel injection and an (N+1)th fuel injection from the fuel injection valve 15. In the inter-injection discharge control of the first embodiment, when the high-pressure fuel pump 40 is driven to discharge fuel, discharge amount is controlled such that the discharged fuel discharge amount is always the maximum discharge amount. The maximum discharge amount is the maximum value of a discharge amount capable of being realized in one fuel discharge in the high-pressure fuel pump 40. The maximum discharge amount is determined depending on the volume of the pressurizing chamber 78 and the maximum movement distance of the plunger 75, is obtained in advance, and is stored in the electronic control unit 100. The maximum movement distance of the plunger 75 is a movement distance until the protruding portion 75B of the plunger 75 abuts against the insertion part 56 from a state where the second end of the plunger 75 abuts against the protruding part 83. In the first embodiment, the period between the Nth fuel injection and the (N+1)th fuel injection means a period until the (N+1)th fuel injection is started from the end of the Nth fuel injection from the fuel injection valve 15.

The inter-injection discharge control execution unit 112 has a discharge requirement determination unit 113, a discharge number-of-times setting unit 114, a discharge start timing calculation unit 115, and a pump drive unit 116, as functional units. The discharge requirement determination unit 113 determines that the fuel discharge from the high-pressure fuel pump 40 is required when the fuel pressure deviation ΔP calculated by the fuel pressure deviation calculation unit 104 is equal to or more than a predetermined value. The predetermined value is set to a value slightly smaller than the amount of change of the fuel pressure Pr when fuel equivalent to the maximum discharge amount of the high-pressure fuel pump 40 is supplied from the high-pressure fuel pump 40 to the high-pressure fuel pipe 34. That is, when the fuel pressure deviation ΔP is smaller than the predetermined value and a difference between an actual fuel pressure Pr and the target fuel pressure Pt is small, the discharge requirement determination unit 113 determines that fuel discharge from the high-pressure fuel pump 40 is not required.

When the discharge requirement determination unit 113 determines that the fuel discharge from the high-pressure fuel pump 40 is required, the discharge number-of-times setting unit 114 sets the number of times fuel is discharged from the high-pressure fuel pump 40 to the high-pressure fuel pipe 34, based on the fuel pressure deviation ΔP. The discharge number-of-times setting unit 114 calculates a fuel discharge amount, which is required to set the fuel pressure Pr within the high-pressure fuel pipe 34 to the target fuel pressure Pt, based on the fuel pressure deviation ΔP. The smallest number of times of discharge among the number of times of discharge required to supply fuel equivalent to the calculated fuel discharge amount is set as a discharge number-of-times Tn. For example, in a case where the required fuel discharge amount is equal to or smaller than the maximum discharge amount of the high-pressure fuel pump 40, the discharge number-of-times Tn is set to one time. In a case where the required fuel discharge amount is larger than the maximum discharge amount and equal to or smaller than twice the maximum discharge amount, the discharge number-of-times Tn is set to two times.

When the discharge requirement determination unit 113 determines that the fuel discharge from the high-pressure fuel pump 40 is required, the discharge start timing calculation unit 115 calculates a discharge start timing Ts that is a start timing when fuel discharge is performed from the high-pressure fuel pump 40 to the high-pressure fuel pipe 34. The discharge start timing Ts is calculated based on the timing of the fuel injection from the fuel injection valve 15.

In the first embodiment, a timing at which a predetermined preparation time has elapsed from an end timing Fe of the fuel injection from the fuel injection valve 15 is defined as the discharge start timing Ts. The end timing Fe of the fuel injection can be calculated based on the injection time Fi calculated by the injection time calculation unit 107 and the injection start timing Fs calculated by the injection start timing calculation unit 108. The preparation time is set to a time that is required to stabilize the fuel pressure deviation ΔP after the fuel injection from the fuel injection valve 15 ends.

When the discharge requirement determination unit 113 determines that the fuel discharge from the high-pressure fuel pump 40 is required, the pump drive unit 116 performs an energization control to the coil 85 of the high-pressure fuel pump 40 at the discharge start timing Ts calculated by the discharge start timing calculation unit 115. The pump drive unit 116 executes suction of fuel and discharge of fuel in the high-pressure fuel pump 40 by reciprocating the plunger 75 by the energization control. The pump drive unit 116 ends the energization when a preset lift time Ti has elapsed after the energization control to the high-pressure fuel pump 40 is started. The lift time Ti is set to the time slightly longer than the time required for the plunger 75 to move toward the first side from a state where the second end of the plunger 75 abuts against the protruding part 83 until the protruding portion 75B abuts against the insertion part 56. The lift time Ti is obtained in advance by experiments or simulations and is stored in the electronic control unit 100.

In a case where the discharge number-of-times Tn set by the discharge number-of-times setting unit 114 is two times or more, the pump drive unit 116 ends the energization control at a timing at which the lift time Ti has elapsed after the energization control is started, and executes the energization control again at a timing at which a predetermined standby time has elapsed from the ended timing. The energization control is again ended at a timing at which the lift time Ti has elapsed after the energization control is again started. As described above, repeatedly executing the energization control, fuel discharge is executed a plurality of times from the high-pressure fuel pump 40. The standby time is set to a time equal to the time required for the plunger 75 to move toward the second side from a state where the protruding portion 75B of the plunger 75 of the high-pressure fuel pump 40 abuts against the insertion part 56 until the plunger 75 abuts against the protruding part 83.

The functions and the effects of the first embodiment will be described with reference to FIG. 6.

(1-1)

Figure 6:
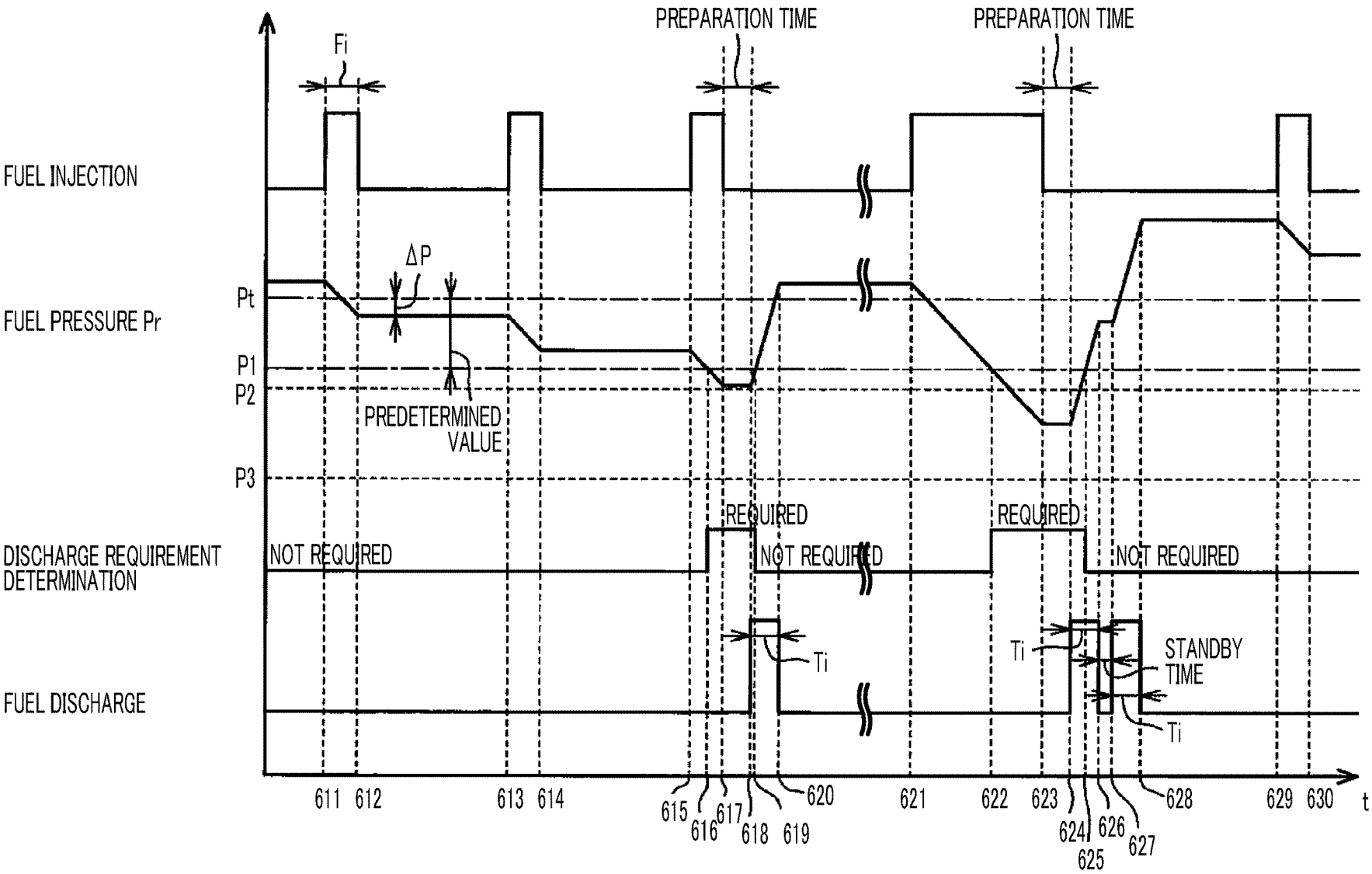
FIG. 6 is a timing chart schematically illustrating transitions of respective parameters in inter-injection discharge control.

As illustrated in FIG. 6, fuel injection is repeatedly executed from each fuel injection valve 15 with the operation of the internal combustion engine 10. As illustrated in FIG. 6, before fuel injection is started at timing t611, the fuel pressure Pr within the high-pressure fuel pipe 34 is higher than the target fuel pressure Pt. The fuel injection valve drive unit 109 starts the fuel injection at the timing t611 that is the injection start timing Fs calculated by the injection start timing calculation unit 108. The fuel injection valve drive unit 109 continues the fuel injection during the injection time Fi calculated by the injection time calculation unit 107, and ends the fuel injection at timing t612 at which the injection time Fi has elapsed from the timing t611.

As described above, by executing the fuel injection, the fuel within the high-pressure fuel pipe 34 is supplied to a cylinder, and as illustrated in FIG. 6, the fuel pressure Pr decreases. Although the fuel pressure Pr decreases below the target fuel pressure Pt at the timing t612 at which the fuel injection has ended, the fuel pressure Pr is higher than a first fuel pressure P1. The first fuel pressure P1 is set to a value slightly higher than a second fuel pressure P2 (P1>P2). The second fuel pressure P2 is a pressure obtained by subtracting a pressure equivalent to the amount of change of the fuel pressure Pr when fuel equivalent to the maximum discharge amount of the high-pressure fuel pump 40 is supplied to the high-pressure fuel pipe 34 from the target fuel pressure Pt. That is, when fuel equivalent to the maximum discharge amount is discharged one time from the high-pressure fuel pump 40 to the high-pressure fuel pipe 34 when the fuel pressure Pr is the second fuel pressure P2, the fuel pressure Pr becomes the target fuel pressure Pt. A difference between the first fuel pressure P1 and the target fuel pressure Pt is equivalent to the predetermined value for determining the requirement of the fuel discharge from the high-pressure fuel pump 40 in the discharge requirement determination unit 113. At the timing t612, the fuel pressure deviation ΔP is smaller than the predetermined value and the difference between the actual fuel pressure Pr and the target fuel pressure Pt is small, as illustrated in FIG. 6, the fuel discharge from the high-pressure fuel pump 40 is determined not to be required.

As illustrated in FIG. 6, by executing the next fuel injection from the fuel injection valve 15 during the period from timing t613 to timing t614, the fuel pressure Pr further decreases as illustrated in FIG. 6. At the timing t614, the fuel pressure Pr is higher than the first fuel pressure P1, and the fuel pressure deviation ΔP is smaller than the predetermined value. For that reason, as illustrated in FIG. 6, the fuel discharge from the high-pressure fuel pump 40 is determined not to be required.

Thereafter, as illustrated in FIG. 6, when fuel injection is executed during the period from timing t615 to timing t617, as illustrated in FIG. 6, the fuel pressure Pr decreases below the first fuel pressure P1. Accordingly, as illustrated in FIG. 6, at timing t616 at which the fuel pressure Pr decreases below the first fuel pressure P1, that is, a timing at which the fuel pressure deviation ΔP is equal to or more than the predetermined value, the discharge requirement determination unit 113 determines that the fuel discharge from the high-pressure fuel pump 40 is required. As described above, when the fuel discharge is determined to be required, the discharge number-of-times setting unit 114 sets the number of times of discharge when fuel is discharged from the high-pressure fuel pump 40 to the high-pressure fuel pipe 34, based on the fuel pressure deviation ΔP after the timing t617 at which the fuel injection has ended. The discharge number-of-times setting unit 114 calculates the fuel discharge amount, which is required to set the fuel pressure Pr within the high-pressure fuel pipe 34 to the target fuel pressure Pt, based on the fuel pressure deviation ΔP. In the example illustrated in FIG. 6, although the fuel pressure Pr decreases below the first fuel pressure P1, the fuel pressure Pr is higher than the second fuel pressure P2 (P1>Pr>P2). For that reason, the required fuel discharge amount to be calculated based on the fuel pressure deviation ΔP is smaller than the maximum discharge amount of the high-pressure fuel pump 40. In this case, the discharge number-of-times setting unit 114 sets the discharge number-of-times Tn to one time.

When the discharge requirement determination unit 113 determines that the fuel discharge from the high-pressure fuel pump 40 is required at the timing t616, the discharge start timing calculation unit 115 calculates the discharge start timing Ts that is a start timing when fuel discharge is performed from the high-pressure fuel pump 40 to the high-pressure fuel pipe 34. The discharge start timing calculation unit 115 sets timing t618, at which the preparation time has elapsed from the end timing Fe (timing t617) of the fuel injection to the discharge start timing Ts.

The pump drive unit 116 executes the energization control when the fuel discharge from the high-pressure fuel pump 40 is determined to be required, and drives the high-pressure fuel pump 40 such that fuel discharge is executed by the set discharge number-of-times Tn from the set discharge start timing Ts.

As illustrated in FIG. 6, the high-pressure fuel pump 40 performs one fuel discharge from the high-pressure fuel pump 40 to the high-pressure fuel pipe 34 at the discharge start timing Ts (timing t618). The fuel discharge is executed from the timing t618 to timing t620 at which the lift time Ti elapses. Accordingly, fuel equivalent to the maximum discharge amount is supplied from the high-pressure fuel pump 40 to the high-pressure fuel pipe 34, and the fuel pressure Pr rises to the target fuel pressure Pt or higher. At timing t619 of the process in which the fuel pressure Pr rises to the target fuel pressure Pt or higher, the fuel pressure Pr is higher than the first fuel pressure P1, and as illustrated in FIG. 6, the discharge requirement determination unit 113 determines that the fuel discharge from the high-pressure fuel pump 40 is not required.

In the above-described example, when the fuel injection from the fuel injection valve 15 is performed three times, discharge from the high-pressure fuel pump 40 to the high-pressure fuel pipe 34 is performed one time. Hence, a discharge ratio that is a ratio of the number of times of discharge of the fuel from the high-pressure fuel pump 40 to the high-pressure fuel pipe 34 to the number of times of injection of the fuel from the fuel injection valve 15 is "⅓".

As described above, the fuel injection amount from the fuel injection valve 15 changes in accordance with the operational state of the internal combustion engine 10, that is, the target torque TQt, the target rotation speed NEt, and the like. As illustrated in FIG. 6, the fuel injection amount during the period from t621 to timing t623 is set to be larger than the fuel injection amount during the period from the timing t611 to the timing t612 as described above. For that reason, in the fuel injection, as illustrated in FIG. 6, the fuel pressure Pr decreases to a pressure lower than the second fuel pressure P2. In this case, as illustrated in FIG. 6, at timing t622 at which the fuel pressure Pr decreases below the first fuel pressure P1, that is, a timing at which the fuel pressure deviation ΔP is equal to or more than the predetermined value, the discharge requirement determination unit 113 determines that the fuel discharge from the high-pressure fuel pump 40 is required.

As described above, when the fuel discharge is determined to be required, the discharge number-of-times setting unit 114 sets the number of times that fuel is discharged from the high-pressure fuel pump 40 to the high-pressure fuel pipe 34, based on the fuel pressure deviation ΔP after the timing t623 at which the fuel injection has ended. As illustrated in FIG. 6, although the fuel pressure Pr decreases below the second fuel pressure P2 at the timing t623 at which the fuel injection has ended, the fuel pressure Pr is higher than a third fuel pressure P3 set to a value lower than the second fuel pressure (P2>P3). The third fuel pressure P3 is a pressure obtained by subtracting a pressure equivalent to the amount of change of the fuel pressure Pr when fuel equivalent to twice the maximum discharge amount of the high-pressure fuel pump 40 is supplied to the high-pressure fuel pipe 34 from the target fuel pressure Pt. That is, when fuel equivalent to the maximum discharge amount is discharged two times from the high-pressure fuel pump 40 to the high-pressure fuel pipe 34 when the fuel pressure Pr is the third fuel pressure P3, the fuel pressure Pr rises to the target fuel pressure Pt. When the fuel pressure Pr is lower than the second fuel pressure P2 and higher than the third fuel pressure P3 (P2>Pr>P3), in the discharge number-of-times setting unit 114, the required fuel discharge amount calculated based on the fuel pressure deviation ΔP is larger than the maximum discharge amount of the high-pressure fuel pump 40 and is smaller than twice the maximum discharge amount. For that reason, the discharge number-of-times setting unit 114 sets two times as the discharge number-of-times Tn. Since the first fuel pressure P1, the second fuel pressure P2, and the third fuel pressure P3 are set based on the target fuel pressure Pt, when the target fuel pressure Pt has changed, the first fuel pressure P1, the second fuel pressure P2, and the third fuel pressure P3 also change in conformity with the change in the target fuel pressure Pt.

When the discharge requirement determination unit 113 determines that the fuel discharge from the high-pressure fuel pump 40 is required at the timing t622, the discharge start timing calculation unit 115 calculates the discharge start timing Ts that is a start timing when fuel discharge is performed from the high-pressure fuel pump 40 to the high-pressure fuel pipe 34. The discharge start timing calculation unit 115 sets timing t624, at which the preparation time has elapsed from the end timing Fe (timing t623) of the fuel injection to the discharge start timing Ts.

The pump drive unit 116 executes the energization control when the fuel discharge from the high-pressure fuel pump 40 is determined to be required, and drives the high-pressure fuel pump 40 such that fuel discharge is executed by the set discharge number-of-times Tn from the set discharge start timing Ts. As illustrated in FIG. 6, the pump drive unit 116 performs two-times fuel discharge from the high-pressure fuel pump 40 to the high-pressure fuel pipe 34 at the discharge start timing Ts (timing t624). A first fuel discharge is executed from the timing t624 to timing t626 at which the lift time Ti elapses. Accordingly, fuel equivalent to the maximum discharge amount is supplied from the high-pressure fuel pump 40 to the high-pressure fuel pipe 34, and the fuel pressure Pr rises. In the above-described example, the fuel pressure Pr rises to a pressure higher than the first fuel pressure P1 and lower than the target fuel pressure Pt. For that reason, in the first fuel discharge, the discharge requirement determination unit 113 determines that the fuel discharge from the high-pressure fuel pump 40 is not required as illustrated in FIG. 6, at timing t625 at which that the fuel pressure Pr is higher than the first fuel pressure P1. Since the number of times of fuel discharge is already set to two times, the pump drive unit 116 continuously executes the fuel discharge from the high-pressure fuel pump 40 even after the discharge requirement determination unit 113 determines that the fuel discharge from the high-pressure fuel pump 40 is not required. The pump drive unit 116 starts fuel discharge at timing t627 at which the standby time has elapsed from the timing t626 at which the first fuel discharge is ended. A second fuel discharge is executed from the timing t627 to timing t628 at which the lift time Ti elapses. Accordingly, fuel equivalent to the maximum discharge amount is supplied from the high-pressure fuel pump 40 to the high-pressure fuel pipe 34, and the fuel pressure Pr rises to the target fuel pressure Pt or higher. As described above, when the pump drive unit 116 repeatedly executes the fuel discharge such that the discharge number-of-times Tn reaches the set number of times of discharge, the driving of the high-pressure fuel pump 40 is stopped. Thereafter, the fuel pressure Pr decreases as the next fuel injection is executed during the period from timing t629 to timing t630. Thereafter, whenever the fuel pressure deviation ΔP becomes equal to or more than a predetermined value, discharge of fuel is executed by a predetermined number of times of discharge.

In the above-described example, when the fuel injection from the fuel injection valve 15 is performed one time, fuel is discharged two times from the high-pressure fuel pump 40 to the high-pressure fuel pipe 34. For that reason, the discharge ratio that is the ratio of the number of times of discharge of the fuel from the high-pressure fuel pump 40 to the high-pressure fuel pipe 34 to the number of times of fuel injection from the fuel injection valve 15 is "2".

As described above, in the first embodiment, the discharge start timing Ts of the high-pressure fuel pump 40 is set when a preparation period has elapsed from the end timing Fe of the fuel injection, and the inter-injection discharge control of executing the fuel discharge at the predetermined timing between the Nth fuel injection and the (N+1)th fuel injection is performed. During the execution of the inter-injection discharge control, when the fuel pressure deviation ΔP is equal to or more than the predetermined value, the fuel discharge number-of-times Tn is set, and the discharge ratio is changed by executing fuel discharge from the high-pressure fuel pump 40 in accordance with a change in the operational state of the internal combustion engine. That is, when the fuel pressure deviation ΔP is less than the predetermined value, the fuel discharge from the high-pressure fuel pump 40 is not performed one time until the next fuel injection is performed after fuel injection is performed from the fuel injection valve 15. Accordingly, the discharge ratio can be changed to a value smaller than one. When the fuel pressure deviation ΔP is equal to or more than the predetermined value, one time or a plurality of times of fuel discharge is performed from the high-pressure fuel pump 40 until the next fuel injection is performed after fuel injection is performed from the fuel injection valve 15. Accordingly, the discharge ratio can be changed to a value equal to or larger than one. Hence, it is possible to execute fuel discharge matched with the fuel injection amount by determining execution requirement of the discharge of fuel in accordance with the fuel injection amount correlated with the operational state of the internal combustion engine.

By the inter-injection discharge control, fuel discharge is executed at the predetermined timing between the Nth fuel injection and the (N+1)th fuel injection from the fuel injection valve 15. For that reason, the fluctuation of the timing of the fuel discharge with respect to the timing of the fuel injection can be suppressed, and variations in the degree of change in the fuel pressure Pr in an fuel injection period resulting from the above-described fluctuation can be suppressed. For that reason, according to the first embodiment, an effect of improving the controllability of the fuel pressure Pr in the high-pressure fuel pipe 34 is obtained.

(1-2)

In the first embodiment, when the discharge requirement determination unit 113 determines that the fuel discharge from the high-pressure fuel pump 40 is required, fuel discharge is not immediately performed from the high-pressure fuel pump 40 to the high-pressure fuel pipe 34, and fuel discharge is performed from the high-pressure fuel pump 40 at the discharge start timing Ts at which the preparation time has elapsed from the end timing Fe (timing t623) of the Nth fuel injection. As described above, by executing the inter-injection discharge control so as to perform fuel discharge after the end of the Nth fuel injection, fuel discharge is started so as not to overlap an Nth fuel injection period in the fuel injection valve 15. For that reason, when the fuel injection from the fuel injection valve 15 is performed, it is possible to restrain fuel from being discharged from the high-pressure fuel pump 40. Hence, the influence of fluctuation of the fuel pressure Pr within the high-pressure fuel pipe 34 resulting from the fuel discharge from the high-pressure fuel pump 40 can be made difficult to occur in the fuel injection, and the timing of supply of fuel to the high-pressure fuel pipe 34 can be appropriately controlled.

(1-3)

In the first embodiment, when fuel is supplied to the high-pressure fuel pipe 34, fuel discharge can be performed a plurality of times from the high-pressure fuel pump 40 until the next fuel injection is performed after fuel injection is performed from the fuel injection valve 15. That is, the discharge ratio can be changed to a value equal to or larger than one. For that reason, it is possible to set the maximum discharge amount of the high-pressure fuel pump 40 to be smaller, and a smaller-sized high-pressure fuel pump 40 can also be selected so as to match the maximum discharge amount of the high-pressure fuel pump 40.

(1-4)

When the fuel pressure deviation ΔP is less than the predetermined value, the fuel discharge from the high-pressure fuel pump 40 is not performed one time until the next fuel injection is performed after fuel injection is performed from the fuel injection valve 15. For that reason, when the difference between the target fuel pressure Pt and the fuel pressure Pr is small, it is also possible to stop the driving of the high-pressure fuel pump 40, and the driving frequency of the high-pressure fuel pump 40 can be lowered as compared to a case where the driving of the high-pressure fuel pump 40 is continued irrespective of the fuel pressure deviation ΔP. For that reason, an effect of suppressing electrical power consumption can also be obtained.

Second Embodiment

A second embodiment of a control device for a fuel pump will be described with reference to FIGS. 7 and 8. A discharge mode of fuel in the inter-injection discharge control in the second embodiment is different from that of the first embodiment. The same components as those of the first embodiment will be designated by common reference signs and the description thereof will be omitted.

Figure 7:
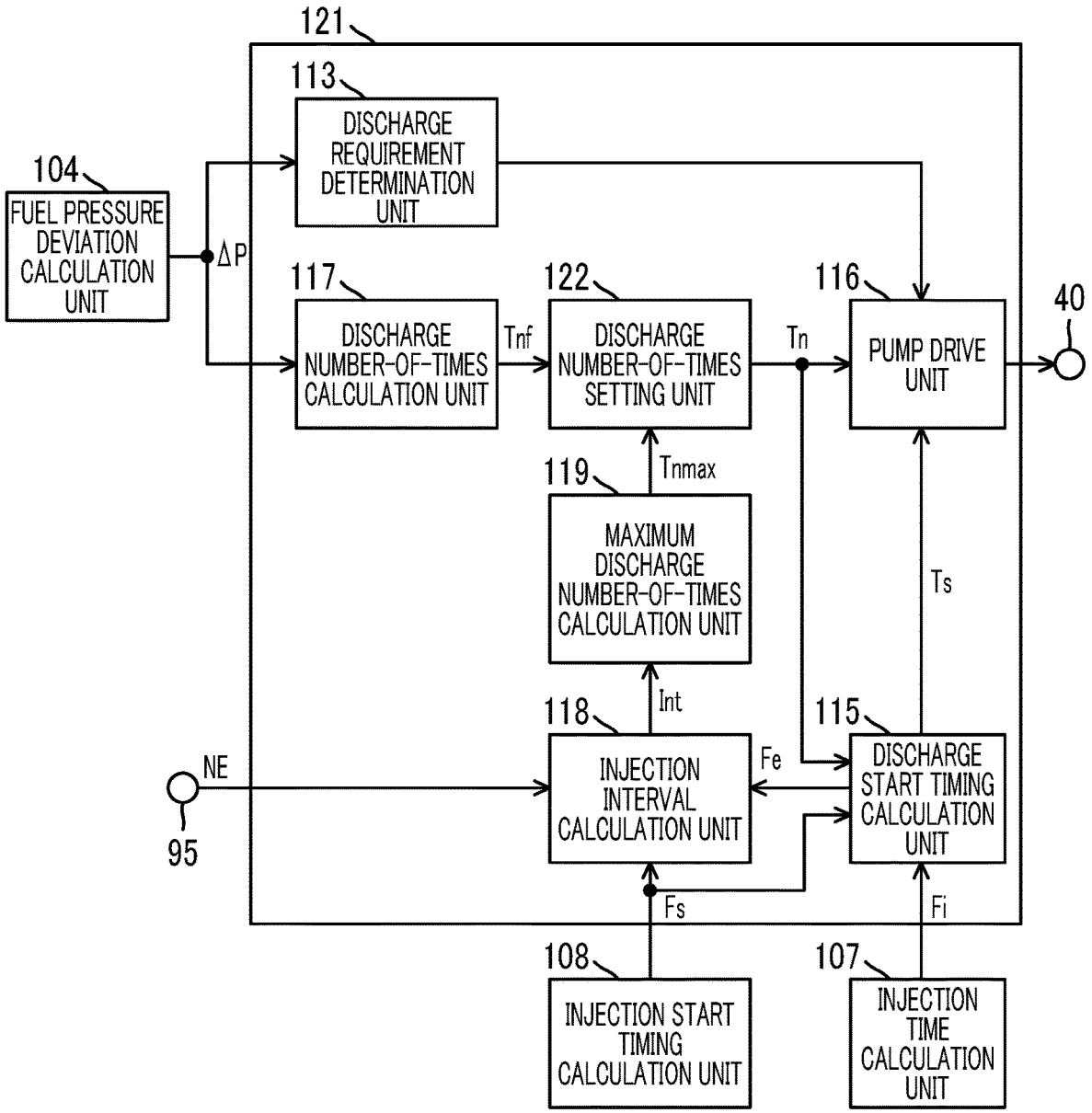
FIG. 7 is a functional block diagram of a portion in a control device for a fuel pump of a second embodiment.

As illustrated in FIG. 7, an inter-injection discharge control execution unit 112 of the electronic control unit 100 has the discharge requirement determination unit 113, a discharge number-of-times calculation unit 117, an injection interval calculation unit 118, a maximum discharge number-of-times calculation unit 119, a discharge number-of-times setting unit 122, a discharge start timing calculation unit 115, and the pump drive unit 116, as functional units.

The discharge requirement determination unit 113 determines that the fuel discharge from the high-pressure fuel pump 40 is required when the fuel pressure deviation ΔP calculated by the fuel pressure deviation calculation unit 104 is equal to or more than the predetermined value. The predetermined value is set to a value slightly smaller than the amount of change of the fuel pressure Pr when fuel equivalent to the maximum discharge amount of the high-pressure fuel pump 40 is supplied from the high-pressure fuel pump 40 to the high-pressure fuel pipe 34. That is, when the fuel pressure deviation ΔP is smaller than the predetermined value and the difference between the actual fuel pressure Pr and the target fuel pressure Pt is small, the discharge requirement determination unit 113 determines that fuel discharge from the high-pressure fuel pump 40 is not required.

When the discharge requirement determination unit 113 determines that the fuel discharge from the high-pressure fuel pump 40 is required, discharge number-of-times calculation unit 117 calculates a required discharge number-of-times Tnf when fuel is discharged from the high-pressure fuel pump 40 to the high-pressure fuel pipe 34, based on the fuel pressure deviation ΔP. The discharge number-of-times setting unit 122 calculates the fuel discharge amount, which is required to set the fuel pressure Pr within the high-pressure fuel pipe 34 to the target fuel pressure Pt, based on the fuel pressure deviation ΔP. The smallest number of times of discharge among the number of times of discharge required to supply the fuel equivalent to the calculated fuel discharge amount is calculated as the required discharge number-of-times Tnf. For example, in a case where the required fuel discharge amount is equal to or smaller than the maximum discharge amount of the high-pressure fuel pump 40, the required discharge number-of-times Tnf is calculated as one time. In a case where the required fuel discharge amount is larger than the maximum discharge amount and equal to or smaller than twice the maximum discharge amount, the required discharge number-of-times Tnf is calculated as two times.

The injection interval calculation unit 118 calculates a fuel injection interval Int, based on the calculated end timing Fe of the fuel injection from the fuel injection valve 15, the injection start timing Fs calculated by the injection start timing calculation unit 108, and the engine speed NE detected by the crank angle sensor 95, in the discharge start timing calculation unit 115 to be described below. In the second embodiment, the fuel injection interval Int is calculated as the time after an end of the fuel injection from the fuel injection valve 15 provided in the predetermined cylinder and before a start of fuel injection from a fuel injection valve 15 provided in a cylinder in which ignition is executed next to a predetermined cylinder. For example, in the respective cylinders #1 to #4, ignition is performed in order of the first cylinder #1, the third cylinder #3, the fourth cylinder #4, and the second cylinder #2. The fuel injection interval Int is shorter as the end timing Fe of the fuel injection is later, the injection start timing Fs is earlier, and the engine speed NE is higher.

The maximum discharge number-of-times calculation unit 119 calculates a maximum discharge number-of-times Tnmax of the fuel discharge from the high-pressure fuel pump 40 capable of being executed within the injection interval Int, based on the injection interval Int calculated by the injection interval calculation unit 118. That is, the maximum discharge number-of-times calculation unit 119 calculates a time obtained by subtracting the preparation time from the injection interval Int as a discharge allowable time Intc. The preparation time is set to the time that is required to stabilize the fuel pressure deviation ΔP after the fuel injection from the fuel injection valve 15 ends. The maximum discharge number-of-times is calculated based on the discharge allowable time Intc and a required time Tmin for performing discharge of fuel from the high-pressure fuel pump 40. The required time Tmin is a time equal to the lift time Ti when the high-pressure fuel pump 40 performs discharge of fuel one time. The required time Tmin is a time equal to the sum of a time n times the lift time Ti and a time n−1 times the standby time (2≤n) when the high-pressure fuel pump 40 performs discharge of fuel n times that are a plurality of times.

In the second embodiment, the lift time Ti is set to a time equal to the time required for the plunger 75 to move toward the first side, after the energization control for the high-pressure fuel pump 40 is started, until the protruding portion 75B abuts against the insertion part 56 from a state where the second end of the plunger 75 of the high-pressure fuel pump 40 abuts against the protruding part 83. The standby time is set to a time equal to the time required for the plunger 75 to move toward the second side, after the energization control for the high-pressure fuel pump 40 ends, until the plunger 75 abuts against the protruding part 83 from a state where the protruding portion 75B of the plunger 75 of the high-pressure fuel pump 40 abuts against the insertion part 56. The lift time Ti and the standby time are obtained in advance by experiments or simulations and are stored in the electronic control unit 100. The maximum discharge number-of-times calculation unit 119 sets the maximum discharge number-of-times Tnmax to one, for example, when the discharge allowable time Intc is equal to or longer than the required time Tmin, which is a time required to perform fuel discharge one time and is shorter than the required time Tmin, which is a time required to perform fuel discharge two times. The maximum discharge number-of-times calculation unit 119 sets the maximum discharge number-of-times Tnmax to two, for example, when the discharge allowable time Intc is equal to or longer than the required time when discharge of fuel is performed two times and is shorter than the required time Tmin when discharge of fuel is performed three times.

The discharge number-of-times setting unit 122 sets the discharge number-of-times Tn that is the number of times that fuel is discharged from the high-pressure fuel pump 40 to the high-pressure fuel pipe 34, based on the required discharge number-of-times Tnf calculated by the discharge number-of-times calculation unit 117 and the maximum discharge number-of-times Tnmax calculated by the maximum discharge number-of-times calculation unit 119. That is, the discharge number-of-times setting unit 122 sets the discharge number-of-times Tn to the same number of times as the required discharge number-of-times Tnf, in a case where the required discharge number-of-times Tnf is equal to or less than the maximum discharge number-of-times Tnmax (Tnf≤Tnmax). The discharge number-of-times setting unit 122 sets the discharge number-of-times Tn to the same number of times as the maximum discharge number-of-times Tnmax, in a case where the required discharge number-of-times Tnf is larger than the maximum discharge number-of-times Tnmax (Tnmax<Tnf). In a case where the discharge number-of-times Tn is set to the same number of times as the maximum discharge number-of-times Tnmax as described above, the fuel discharge number-of-times Tn is set based on the number of times that is the difference between the required discharge number-of-times Tnf and the maximum discharge number-of-times Tnmax, for an injection interval (n+1) next to the injection interval Int (n) at which the fuel discharge is performed the number of times equal to the maximum discharge number-of-times. For example, when the maximum discharge number-of-times Tnmax at the next injection interval (n+1) is one time and the number of times that is the difference is two times, the discharge number-of-times Tn in the injection interval (n+1) is set to one time that is the same as the maximum discharge number-of-times Tnmax, and the remaining one time among the required discharge number-of-times Tnf is set such that the fuel is discharged in the next injection interval (n+2) or thereafter.

When the discharge requirement determination unit 113 determines that the fuel discharge from the high-pressure fuel pump 40 is required, the discharge start timing calculation unit 115 calculates the discharge start timing Ts that is the start timing when fuel discharge is performed from the high-pressure fuel pump 40 to the high-pressure fuel pipe 34. The discharge start timing Ts is calculated based on the timing of the fuel injection from the fuel injection valve 15. In the second embodiment, the end timing Fe of the fuel injection from the fuel injection valve 15 is calculated, and the timing at which the preparation time has elapsed from the end timing Fe is defined as the discharge start timing Ts. The end timing Fe of the fuel injection can be calculated based on the injection time Fi calculated by the injection time calculation unit 107 and the injection start timing Fs calculated by the injection start timing calculation unit 108. The discharge start timing calculation unit 115 calculates the discharge start timing Ts in each injection interval Int for which the discharge number-of-times Tn is set by the discharge number-of-times setting unit 122.

When the discharge requirement determination unit 113 determines that the fuel discharge from the high-pressure fuel pump 40 is required, the pump drive unit 116 performs the energization control to the coil 85 of the high-pressure fuel pump 40 at the discharge number-of-times Tn set in the discharge number-of-times setting unit 122 and at the discharge start timing Ts calculated by the discharge start timing calculation unit 115. The pump drive unit 116 causes the high-pressure fuel pump 40 to perform suction of fuel and discharge of the fuel by causing the plunger 75 to reciprocate through the energization control. The pump drive unit 116 ends the energization when the lift time Ti has elapsed after the energization control for the high-pressure fuel pump 40 is started. In a case where the discharge number-of-times Tn set by the discharge number-of-times setting unit 122 is two times or more, the pump drive unit 116 ends the energization control at the timing at which the lift time Ti has elapsed after the energization control is started, and executes the energization control again at the timing at which the standby time has elapsed from the ended timing. The energization control is again ended at the timing at which the lift time Ti has elapsed after the energization control is again started. As described above, by repeatedly executing the energization control, fuel discharge is executed a plurality of times from the high-pressure fuel pump 40.

The operations and the effects of the second embodiment will be described with reference to FIG. 8. In the second embodiment, the following functions and effects are obtained in addition to the same functions and effects as the above (1-3) and (1-4).

(2-1)

Figure 8:
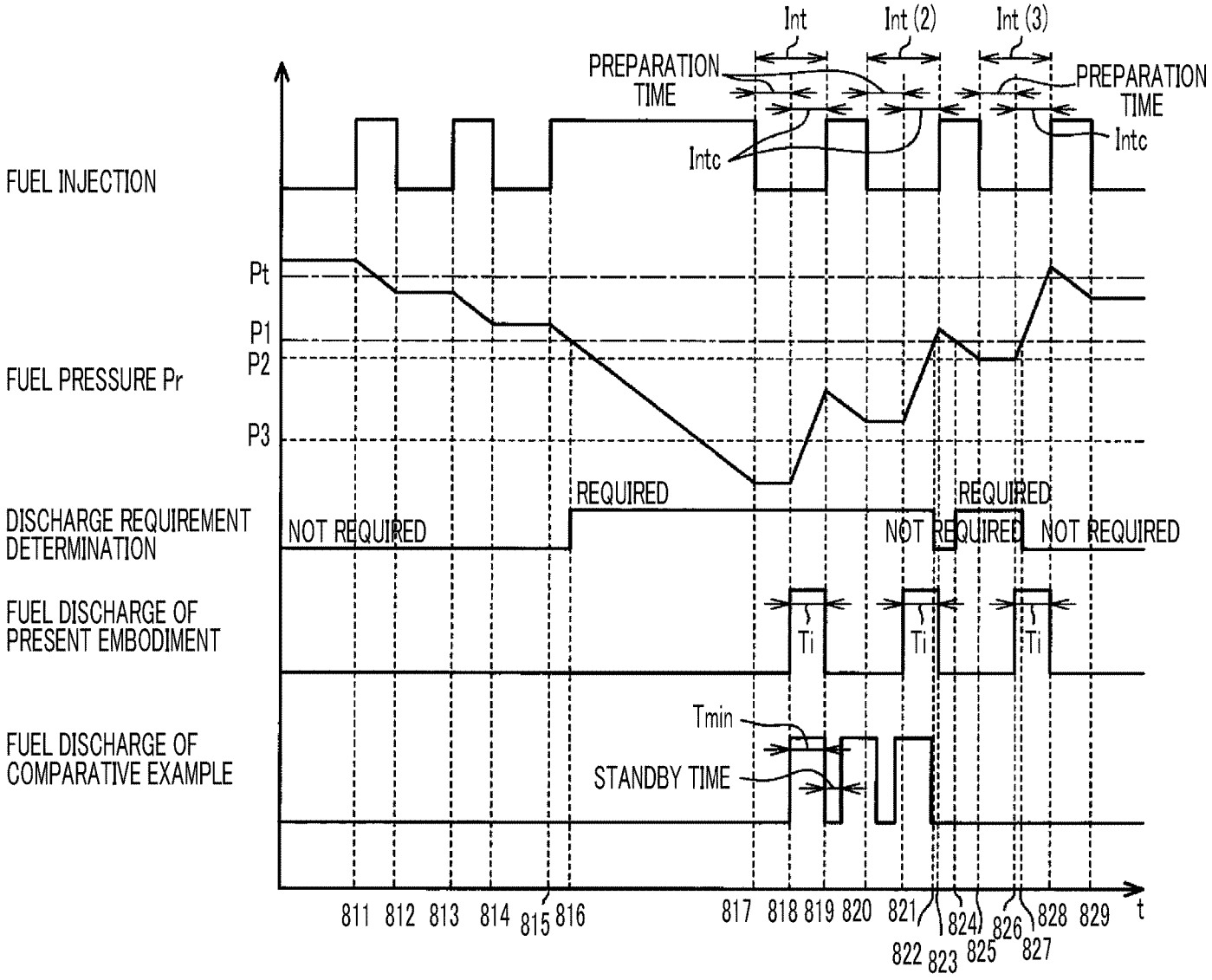
FIG. 8 is a timing chart schematically illustrating transitions of respective parameters in inter-injection discharge control.

As illustrated in FIG. 8, fuel injection is repeatedly executed from each fuel injection valve 15 with the operation of the internal combustion engine 10. As illustrated in FIG. 8, before fuel injection is started at timing t811, the fuel pressure Pr in the high-pressure fuel pipe 34 is higher than the target fuel pressure Pt. The fuel injection valve drive unit 109 starts the fuel injection at the timing t811 that is the discharge start timing Ts calculated by the discharge start timing calculation unit 115. The fuel injection valve drive unit 109 continues the fuel injection during the injection time Fi calculated by the injection time calculation unit 107, and ends the fuel injection at timing t812 at which the injection time Fi has elapsed from the timing t811. As described above, by executing the fuel injection, the fuel within the high-pressure fuel pipe 34 is supplied to a cylinder, and as illustrated in FIG. 8, the fuel pressure Pr decreases. Although the fuel pressure Pr falls below the target fuel pressure Pt at timing t812 at which the fuel injection ends, the fuel pressure Pr is higher than the first fuel pressure P1. At timing t812, the fuel pressure deviation ΔP is smaller than the predetermined value and the difference between the actual fuel pressure Pr and the target fuel pressure Pt is small, as illustrated in FIG. 8, fuel discharge from the high-pressure fuel pump 40 is determined not to be required.

As illustrated in FIG. 8, by executing the next fuel injection from the fuel injection valve 15 during the period from timing t813 to timing t814, the fuel pressure Pr further decreases as illustrated in FIG. 8. At timing t814, the fuel pressure Pr is higher than the first fuel pressure P1, and the fuel pressure deviation ΔP is smaller than the predetermined value. For that reason, as illustrated in FIG. 8, the fuel discharge from the high-pressure fuel pump 40 is determined not to be required.

Thereafter, as illustrated in FIG. 8, the fuel pressure Pr becomes lower than the first fuel pressure P1 when fuel injection is executed from the fuel injection valve 15 during the period from timing t815 to timing t817. Accordingly, as illustrated in FIG. 8, at timing t816 at which the fuel pressure Pr falls below the first fuel pressure P1, that is, a timing at which the fuel pressure deviation ΔP becomes equal to or more than the predetermined value, the discharge requirement determination unit 113 determines that fuel discharge from the high-pressure fuel pump 40 is required. As described above, when fuel discharge is determined to be required, the number of times of discharge when fuel is discharged from the high-pressure fuel pump 40 to the high-pressure fuel pipe 34 is set. In this processing, the discharge number-of-times calculation unit 117 calculates the required discharge number-of-times Tnf, based on the fuel pressure deviation ΔP after the timing t817 at which the fuel injection ends. As illustrated in FIG. 8, the fuel injection amount during the period from the timing t815 to the timing t817 is larger than the fuel injection amount during a period from the timing t813 to the timing t814, or the like. For that reason, as illustrated in FIG. 8, at the timing t817 at which the fuel injection ends, the fuel pressure Pr decreases to a pressure slightly lower than the third fuel pressure P3. As described above, in a case where the fuel pressure Pr is a pressure slightly lower than the third fuel pressure P3, the required fuel discharge amount calculated based on the fuel pressure deviation ΔP in the discharge number-of-times setting unit 122 is larger than twice the maximum discharge amount for the high-pressure fuel pump 40 and smaller than three times the maximum discharge amount. For that reason, the discharge number-of-times calculation unit 117 sets three times as the required discharge number-of-times Tnf.

The maximum discharge number-of-times calculation unit 119 calculates the maximum discharge number-of-times Tnmax when fuel discharge is determined to be required at timing t816. As illustrated in FIG. 8, the maximum discharge number-of-times calculation unit 119 calculates a time obtained by subtracting the preparation time from the fuel injection interval Int calculated by the injection interval calculation unit 118 as the discharge allowable time Intc. The maximum discharge number-of-times is calculated based on the discharge allowable time Intc and the required time Tmin for performing discharge of fuel from the high-pressure fuel pump 40. In the example illustrated in FIG. 8, since the discharge allowable time Intc is equal to the required time Tmin (=Ti) when the high-pressure fuel pump 40 performs discharge of fuel one time, the maximum discharge number-of-times calculation unit 119 calculates the maximum discharge number-of-times Tnmax as one time.

After that, the discharge number-of-times setting unit 122 sets the discharge number-of-times Tn that is the number of times that the fuel is discharged from the high-pressure fuel pump 40 to the high-pressure fuel pipe 34, based on the required discharge number-of-times Tnf calculated by the discharge number-of-times calculation unit 117 and the maximum discharge number-of-times Tnmax calculated by the maximum discharge number-of-times calculation unit 119. In the second embodiment, since the required discharge number-of-times Tnf (=3) is larger than the maximum discharge number-of-times Tnmax (=1), the discharge number-of-times setting unit 122 sets the discharge number-of-times Tn to the same number of times as the maximum discharge number-of-times Tnmax (Tn=1). As described above, in a case where the discharge number-of-times Tn is set to the same number of times as the maximum discharge number-of-times Tnmax, the fuel is discharged the number of times (=2) that is the difference between the required discharge number-of-times Tnf (=3) and the maximum discharge number-of-times Tnmax (=1) as follows. That is, the injection interval calculation unit 118 calculates the next injection interval Int (2), that is, the interval between fuel injection during the period from timing t819 to timing t820 and fuel injection during the period from timing t823 to timing t825. The maximum discharge number-of-times calculation unit 119 calculates the maximum discharge number-of-times Tnmax at the injection interval Int (2). In the second embodiment, the discharge allowable time Intc at the injection interval Int (2) illustrated in FIG. 8 is equal to the required time Tmin (=Ti) when the high-pressure fuel pump 40 performs discharge of fuel one time. For that reason, the maximum discharge number-of-times calculation unit 119 calculates the maximum discharge number-of-times Tnmax at the injection interval Int (2) as one time.

The discharge number-of-times setting unit 122 sets the fuel discharge number-of-times Tn in the next injection interval Int (2), based on the maximum discharge number-of-times Tnmax (=1) in the injection interval Int (2), which is calculated by the maximum discharge number-of-times calculation unit 119, and the number of times (=2) that is the difference. In this case, since the number of times (=2) that is the difference is larger than the maximum discharge number-of-times Tnmax (=1), the discharge number-of-times setting unit 122 sets the discharge number-of-times Tn to the same number of times as the maximum discharge number-of-times Tnmax (Tn=1). Accordingly, one time is set as the discharge number-of-times Tn in the injection interval Int (2).

As described above, in a case where one time is set as the discharge number-of-times Tn in the injection interval Int (2), fuel discharge is performed the remaining number of times (=1) obtained by subtracting the maximum discharge number-of-times Tnmax (=1) from the number of times (=2) that is the difference, as follows. That is, the injection interval calculation unit 118 calculates the next injection interval Int (3), that is, the interval between fuel injection from timing t823 to timing t825 and fuel injection during the period from timing t828 to timing t829. The maximum discharge number-of-times calculation unit 119 calculates the maximum discharge number-of-times Tnmax in the injection interval Int (3). In the second embodiment, the discharge allowable time Intc in the injection interval Int (3) illustrated in FIG. 8 is equal to the required time Tmin (=Ti) required for the high-pressure fuel pump 40 to perform fuel discharge one time. For that reason, the maximum discharge number-of-times calculation unit 119 calculates the maximum discharge number-of-times Tnmax in the injection interval Int (3) as one time.

The discharge number-of-times setting unit 122 sets the fuel discharge number-of-times Tn in the next injection interval Int (3), based on the maximum discharge number-of-times Tnmax (=1) in the injection interval Int (3), which is calculated by the maximum discharge number-of-times calculation unit 119, and the remaining number of times (=1). In this case, since the remaining number of times (=1) is equal to or smaller than the maximum discharge number-of-times Tnmax (=1), the discharge number-of-times setting unit 122 sets the discharge number-of-times Tn to the same number of times as the remaining number of times Tn (Tn=1). Accordingly, one time is set as the discharge number-of-times Tn in the injection interval Int (3).

As described above, the discharge number-of-times setting unit 122 sets the fuel discharge number-of-times Tn in each injection interval Int such that the fuel discharge is performed the required discharge number-of-times Tnf calculated by the discharge number-of-times calculation unit 117.

When the discharge requirement determination unit 113 determines at the timing t816 that fuel discharge from the high-pressure fuel pump 40 is required, the discharge start timing calculation unit 115 calculates the discharge start timing Ts that is the start timing from which fuel discharge from the high-pressure fuel pump 40 to the high-pressure fuel pipe 34 is performed. The discharge start timing calculation unit 115 calculates the discharge start timing Ts in each of the injection interval (Int, Int (2), Int (3)) for which the discharge number-of-times Tn is set by the discharge number-of-times setting unit 122. The discharge start timing calculation unit 115 sets the discharge start timing Ts to a timing (the timing t818, the timing t821, or the timing t826) at which the preparation time has elapsed from the end timing Fe (the timing t817, the timing t820, or the timing t825) of fuel injection.

The pump drive unit 116 executes the energization control when the fuel discharge from the high-pressure fuel pump 40 is determined to be required, and drives the high-pressure fuel pump 40 such that fuel discharge is executed by the set discharge number-of-times Tn from the set discharge start timing Ts.

As illustrated in FIG. 8, the pump drive unit 116 causes the high-pressure fuel pump 40 to perform fuel discharge to the high-pressure fuel pipe 34 one time at the discharge start timing Ts (timing t818). The fuel discharge is executed during the period from timing t818 to timing t819 at which the lift time Ti elapses. The fuel discharge is completed within the injection interval Int. By performing the fuel discharge as described above, the fuel in an amount corresponding to the maximum discharge amount is supplied from the high-pressure fuel pump 40 to the high-pressure fuel pipe 34, and the fuel pressure Pr rises to a pressure higher than the third fuel pressure P3 and lower than the second fuel pressure P2. In this case, when the fuel injection from the fuel injection valve 15 is executed three times, fuel is discharged one time from the high-pressure fuel pump 40 to the high-pressure fuel pipe 34. Hence, the discharge ratio that is the ratio of the number of times of discharge of the fuel from the high-pressure fuel pump 40 to the high-pressure fuel pipe 34 to the number of times of injection of the fuel from the fuel injection valve 15 is "⅓". In the second embodiment, the discharge ratio is determined with the time when discharge of fuel being performed from the high-pressure fuel pump 40 as a reference. That is, the number of times of fuel injection performed during a period between the time when fuel discharge the high-pressure fuel pump 40 is performed and the time when the preceding fuel discharge is performed is used as the above-described number of times of fuel injection. The number of times of fuel discharge performed within a period from the injection start timing Fs of fuel injection immediately before a timing at which the fuel discharge is performed to the injection start timing Fs of fuel injection immediately after it, the period including a timing at which fuel discharge from the high-pressure fuel pump 40 is performed, is used as the above-described number of times of fuel discharge. When fuel discharge is performed a plurality of times within a period from when fuel injection is performed until when the next fuel injection is performed, the discharge ratio may be determined as described above using the first fuel discharge among the plurality of times of fuel discharge as a reference.

As illustrated in FIG. 8, as described above, after fuel discharge is performed, fuel injection is executed from the timing t819 at which the fuel discharge has ended to the timing t820. Accordingly, as illustrated in FIG. 8, the fuel pressure Pr decreases. After the fuel injection is performed, the pump drive unit 116 causes the high-pressure fuel pump 40 to perform fuel discharge to the high-pressure fuel pipe 34 one time at the discharge start timing Ts (timing t821). The fuel discharge is performed from timing t821 to timing t823 at which the lift time Ti elapses. The fuel discharge is completed within the injection interval Int (2).

By performing the fuel discharge as described above, the fuel in an amount corresponding to the maximum discharge amount is supplied from the high-pressure fuel pump 40 to the high-pressure fuel pipe 34, and the fuel pressure Pr rises to a pressure higher than the first fuel pressure P1 and lower than the target fuel pressure Pt. The discharge requirement determination unit 113 determines that the fuel discharge from the high-pressure fuel pump 40 is not required as illustrated in FIG. 8, at timing t822 at which that the fuel pressure Pr becomes higher than the first fuel pressure P1. Since the fuel discharge number-of-times Tn has already been set, the pump drive unit 116 continues the subsequent fuel discharge from the high-pressure fuel pump 40 even after the discharge requirement determination unit 113 determines that the fuel discharge from the high-pressure fuel pump 40 is not required. In the fuel discharge, the discharge ratio that is the ratio of the number of times of fuel discharge from the high-pressure fuel pump 40 to the high-pressure fuel pipe 34 to the number of times of fuel injection from the fuel injection valve 15 is "1".

Thereafter, as illustrated in FIG. 8, fuel injection is executed from the timing t823 at which the fuel discharge has ended to the timing t825. Accordingly, as illustrated in FIG. 8, the fuel pressure Pr is lower than the first fuel pressure P1. Accordingly, at timing t824 at which the fuel pressure Pr falls below the first fuel pressure P1, that is, a timing at which the fuel pressure deviation ΔP becomes equal to or larger than the predetermined value, the discharge requirement determination unit 113 determines that the fuel discharge from the high-pressure fuel pump 40 is required. At the timing t824, when the discharge requirement determination unit 113 determines that the fuel discharge from the high-pressure fuel pump 40 is required, the discharge number-of-times setting unit 122 already sets the discharge number-of-times Tn. In this case, the discharge number-of-times setting unit 122 does not set the discharge number-of-times Tn again at the timing t824 but holds the already set discharge number-of-times Tn.

For that reason, after the fuel injection ends at the timing t825, the pump drive unit 116 causes the high-pressure fuel pump 40 to perform fuel discharge to the high-pressure fuel pipe 34 one time at the discharge start timing Ts (timing t826). The fuel discharge is performed from the timing t826 to the timing t828 at which the lift time Ti elapses. The fuel discharge is completed within the injection interval Int (3). By performing the fuel discharge as described above, the fuel in an amount corresponding to the maximum discharge amount is supplied from the high-pressure fuel pump 40 to the high-pressure fuel pipe 34, and the fuel pressure Pr rises to a pressure higher than the target fuel pressure Pt. The discharge requirement determination unit 113 determines that the fuel discharge from the high-pressure fuel pump 40 is not required as illustrated in FIG. 8, at timing t827 at which that the fuel pressure Pr becomes higher than the first fuel pressure P1. In the fuel discharge, the discharge ratio that is the ratio of the number of times of fuel discharge from the high-pressure fuel pump 40 to the high-pressure fuel pipe 34 to the number of times of fuel injection from the fuel injection valve 15 is "1".

As described above, in the second embodiment, the discharge start timing Ts for the high-pressure fuel pump 40 is set to a timing at which a preparation period has elapsed from the end timing Fe of the fuel injection, and the inter-injection discharge control is executed at the predetermined timing between the Nth fuel injection and the (N+1)th fuel injection. During the execution of the inter-injection discharge control, the fuel discharge number-of-times Tn is set when the fuel pressure deviation ΔP becomes equal to or larger than the predetermined value, and fuel discharge from the high-pressure fuel pump 40 is performed, whereby the discharge ratio is changed in accordance with a change in the operational state of the internal combustion engine. That is, when the fuel pressure deviation ΔP is smaller than the predetermined value, fuel discharge from the high-pressure fuel pump 40 is not performed even one time during a period from when fuel injection from the fuel injection valve 15 is performed until when the next fuel injection is performed. Accordingly, the discharge ratio can be changed to a value smaller than one. When the fuel pressure deviation ΔP is equal to or larger than the predetermined value, one time or two or more times of fuel discharge is performed from the high-pressure fuel pump 40 until the next fuel injection is performed after fuel injection is performed from the fuel injection valve 15. Accordingly, the discharge ratio can be changed to a value equal to or larger than one.

(2-2)

In the second embodiment, the number of times of discharge of fuel is set such that fuel discharge is performed within the injection interval Int. In order to clarify the difference from the configuration as described above, a case where fuel discharge is successively performed with the required discharge number-of-times Tnf calculated by the discharge number-of-times calculation unit 117 in the inter-injection discharge control will be described as a comparative example to be compared to the second embodiment.

As illustrated in FIG. 8, the pump drive unit 116 performs fuel discharge of the required discharge number-of-times Tnf (=3) from the high-pressure fuel pump 40 to the high-pressure fuel pipe 34 at the discharge start timing Ts (timing t818). A first fuel discharge is executed from the timing t818 to the timing t819 at which the lift time Ti elapses. When the first fuel discharge is performed, the pump drive unit 116 starts a second fuel discharge when the standby time has elapsed. The second fuel discharge is started from the timing t819 at which the fuel injection is performed to the timing t820. For that reason, a fuel injection execution period and a fuel discharge execution period overlap each other, and a fluctuation occurs in the fuel pressure within the high-pressure fuel pipe 34 in the fuel injection execution period by performing fuel discharge from the high-pressure fuel pump 40.

The pump drive unit 116 executes fuel discharge until the lift time Ti elapses after the second fuel discharge is started. When the second fuel discharge is performed, the pump drive unit 116 starts a third fuel discharge when the standby time has elapsed. The third fuel discharge ends before the fuel injection is started at the timing t823. In the comparative example of the second embodiment, the discharge ratio when the first fuel discharge is performed is "⅓", and the discharge ratio when the second and third fuel discharges are performed is "2". In the comparative example of the second embodiment, thereafter, when the discharge requirement determination unit 113 determines that the fuel discharge from the high-pressure fuel pump 40 is required, the pump drive unit 116 performs fuel discharge with the calculated required discharge number-of-times Tnf at the set discharge start timing Ts.

In the second embodiment, the discharge number-of-times Tn is limited by the maximum discharge number-of-times Tnmax calculated based on the injection interval Int such that fuel discharge is performed within the injection interval Int. Accordingly, when the fuel injection from the fuel injection valve 15 is performed, discharge of fuel is not discharged from the high-pressure fuel pump 40. For that reason, the influence of fluctuations of the fuel pressure in the high-pressure fuel pipe 34 resulting from the fuel discharge performed by the high-pressure fuel pump 40 is less likely to be exerted on the fuel injection than when fuel discharge is performed so as to overlap both the Nth period of fuel injection from the fuel injection valve and the (N+1)th period of fuel injection from the fuel injection valve. Thus, the accuracy of control over the fuel injection amount when fuel injection is performed can be made higher than that in the comparative example. As a result, the timing of fuel supply to the high-pressure fuel pipe 34 can be made appropriate. The electronic control unit 100 for the high-pressure fuel pump 40, it is also possible to accelerate an increase in the fuel pressure Pr within the high-pressure fuel pipe 34 by controlling the fuel discharge as in the comparative example of the second embodiment.

Third Embodiment

A third embodiment of a control device for a fuel pump will be described with reference to FIGS. 9 to 11. The third embodiment is different from the first embodiment in that the fuel discharge ratio is set based on a load KL on the internal combustion engine 10 in the inter-injection discharge control. The same configurations as those of the first embodiment will be denoted by the same reference signs and the description thereof will be omitted.

Figure 9:
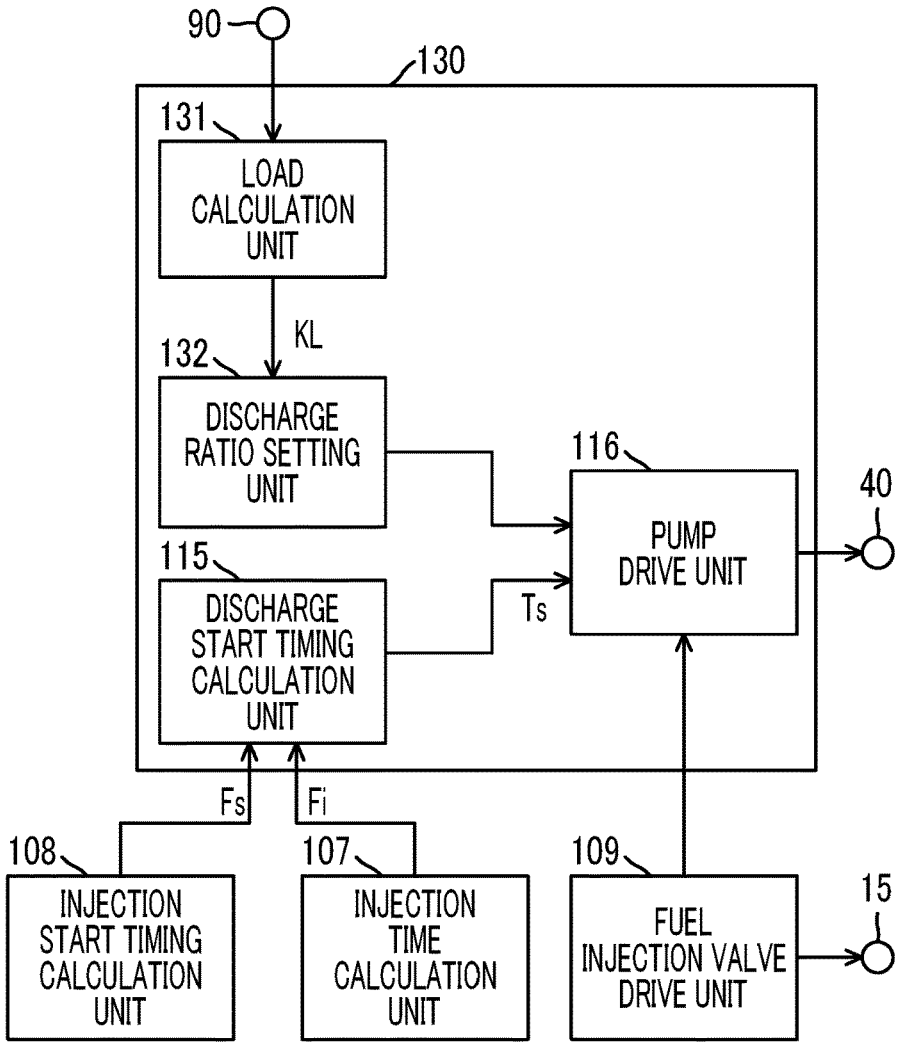
FIG. 9 is a functional block diagram of a portion in a control device for a fuel pump of a third embodiment.

As illustrated in FIG. 9, an inter-injection discharge control execution unit 130 of the electronic control unit 100 includes a load calculation unit 131, a discharge ratio setting unit 132, the discharge start timing calculation unit 115, and the pump drive unit 116, as functional units.

The load calculation unit 131 calculates the load KL on the internal combustion engine 10 based on the flow rate of intake air detected by the air flow meter 90. The discharge ratio setting unit 132 sets the discharge ratio that is the ratio of the number of times of fuel discharge from the high-pressure fuel pump 40 to the high-pressure fuel pipe 34 to the number of times of fuel injection from the fuel injection valve 15, based on the load KL calculated by the load calculation unit 131. A map showing a relationship between the load KL and the discharge ratio is stored in the discharge ratio setting unit 132.

Figure 10:
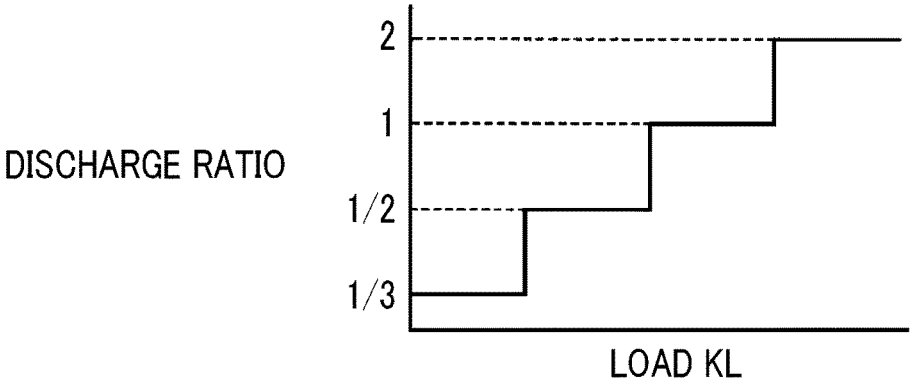
FIG. 10 is a map illustrating an example of a relationship between a load and a discharge ratio.

As illustrated in FIG. 10, the discharge ratio is set to change in a stepwise manner, such that the discharge ratio takes a higher value when the load KL is high than when the load KL is low. The load KL is a parameter correlated with the operational state of the internal combustion engine 10, and the fuel injection amount in the fuel injection valve 15 also tends to increase in a case where the load KL is high. The discharge ratio is changed in accordance with the operational state of the internal combustion engine 10 by setting the discharge ratio based on the load KL.

As illustrated in FIG. 9, the discharge start timing calculation unit 115 calculates the discharge start timing Ts, which is the start timing when fuel discharge is performed from the high-pressure fuel pump 40 to the high-pressure fuel pipe 34, by the same method as the first embodiment.

The pump drive unit 116 performs the energization control to the coil 85 of the high-pressure fuel pump 40 at the discharge start timing Ts calculated by the discharge start timing calculation unit 115 such that the discharge ratio set in the discharge ratio setting unit 132 is obtained. That is, the pump drive unit 116 controls the number of times of discharge of the high-pressure fuel pump 40 with respect to the number of times of driving of the fuel injection valve 15 by the fuel injection valve drive unit 109. The energization control to the coil 85 of the high-pressure fuel pump 40 in the pump drive unit 116 is the same as that of the first embodiment.

The functions and the effects of the third embodiment will be described with reference to FIG. 11. In the third embodiment, the following functions and effects are obtained in addition to the same functions and effects as the first embodiment.

(3-1)

Figure 11:
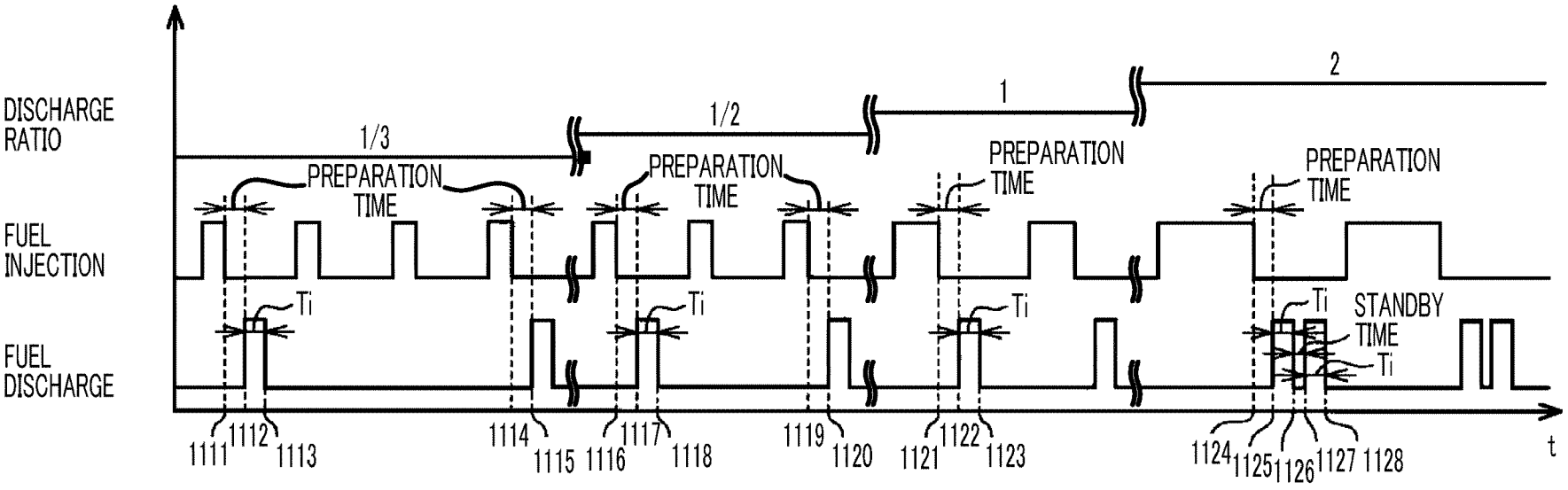
FIG. 11 is a timing chart schematically illustrating transitions of respective parameters in inter-injection discharge control.

As illustrated in FIG. 11, in a case where the discharge ratio is set to, for example, "⅓", as illustrated in FIG. 11, when fuel is injected three times after fuel is discharged one time from the high-pressure fuel pump 40 to the high-pressure fuel pipe 34, the pump drive unit 116 causes the high-pressure fuel pump 40 to discharge fuel to the high-pressure fuel pipe 34 one time again. In this case, the pump drive unit 116 causes the high-pressure fuel pump 40 to discharge fuel to the high-pressure fuel pipe 34 one time at the discharge start timing Ts (timing t1112) at which the preparation time has elapsed from a fuel injection end timing t1111. The fuel discharge is executed from the timing t1112 to the timing t1113 at which the lift time Ti elapses. Accordingly, fuel equivalent to the maximum discharge amount is supplied from the high-pressure fuel pump 40 to the high-pressure fuel pipe 34. Thereafter, the pump drive unit 116 does not perform a discharge of fuel until fuel injection is executed three times. When fuel injection is executed three times, the pump drive unit 116 causes the high-pressure fuel pump 40 to perform fuel discharge to the high-pressure fuel pipe 34 one time as described above, at the discharge start timing Ts (timing t1115) at which the preparation time has elapsed from an end timing t1114 of the third fuel injection.

As illustrated in FIG. 11, in a case where the discharge ratio is set to, for example, "½", as illustrated in FIG. 11, when the fuel is injected two times after the fuel is discharged one time from the high-pressure fuel pump 40 to the high-pressure fuel pipe 34, the pump drive unit 116 causes the high-pressure fuel pump 40 to discharge fuel to the high-pressure fuel pipe 34 one time. In this case, the pump drive unit 116 causes the high-pressure fuel pump 40 to perform fuel discharge to the high-pressure fuel pipe 34 one time at the discharge start timing Ts (timing t1117) at which the preparation time has elapsed from a fuel injection end timing t1116. The fuel discharge is executed from the timing t1117 to the timing t1118 at which the lift time Ti elapses. Thereafter, the pump drive unit 116 does not perform a discharge of fuel until fuel injection is executed two times. After fuel injection is performed two times, the pump drive unit 116 causes the high-pressure fuel pump 40 to perform fuel discharge to the high-pressure fuel pipe 34 one time as described above, at the discharge start timing Ts (timing t1120) at which the preparation time has elapsed from an end timing t1119 of the second fuel injection.

As illustrated in FIG. 11, in a case where the discharge ratio is set to, for example, "1", as illustrated in FIG. 11, when fuel is injected one time after fuel is discharged one time from the high-pressure fuel pump 40 to the high-pressure fuel pipe 34, the pump drive unit 116 causes the high-pressure fuel pump 40 to perform fuel discharge to the high-pressure fuel pipe 34 one time. In this case, since the pump drive unit 116 performs fuel discharge one time each time fuel injection is performed one time, one fuel injection and one fuel discharge are alternately performed. The pump drive unit 116 causes the high-pressure fuel pump 40 to perform fuel discharge to the high-pressure fuel pipe 34 one time at the discharge start timing Ts (timing t1122) at which the preparation time has elapsed from a fuel injection end timing t1121. The fuel discharge is performed from the timing t1122 to the timing t1123 at which the lift time Ti elapses.

As illustrated in FIG. 11, when the discharge ratio is set to, for example, "2", as illustrated in FIG. 11, when fuel is injected one time after fuel is discharged from the high-pressure fuel pump 40 to the high-pressure fuel pipe 34 two times, the pump drive unit 116 causes the high-pressure fuel pump 40 to discharge fuel to the high-pressure fuel pipe 34 two times. In this case, the pump drive unit 116 causes the high-pressure fuel pump 40 to discharge fuel to the high-pressure fuel pipe 34 two times, from the discharge start timing Ts (timing t1125) at which the preparation time has elapsed from a fuel injection end timing t1124. A first fuel discharge is executed from timing t1125 to timing t1126 at which the lift time Ti elapses. The pump drive unit 116 starts fuel discharge at timing t1127 at which the standby time has elapsed from timing t1126 at which the first fuel discharge ends. A second fuel discharge is executed from timing t1127 to timing t1128 at which the lift time Ti elapses.

The amount of fuel injected from the fuel injection valve 15 at one time tends to be larger when the load KL on the internal combustion engine 10 is high than when the load KL is low. The maximum amount of fuel discharged from the high-pressure fuel pump 40 at one time can be obtained in advance. For that reason, the discharge ratio is set to a higher value when the load KL of the internal combustion engine 10 is high than when the load KL is low, that is, the discharge ratio is set to a higher value when the amount of the fuel injected from the high-pressure fuel pipe 34 is large than when the amount of the fuel is small. Accordingly, the pressure of the fuel in the high-pressure fuel pipe 34 can be appropriately controlled.

Fourth Embodiment

A fourth embodiment of a control device for a fuel pump will be described with reference to FIGS. 12 to 14. In the fourth embodiment, the configurations of the control device for a fuel pump are different from those of the first embodiment. The same configurations as those of the first embodiment will be denoted by the same reference signs and the description thereof will be omitted.

Figure 12:
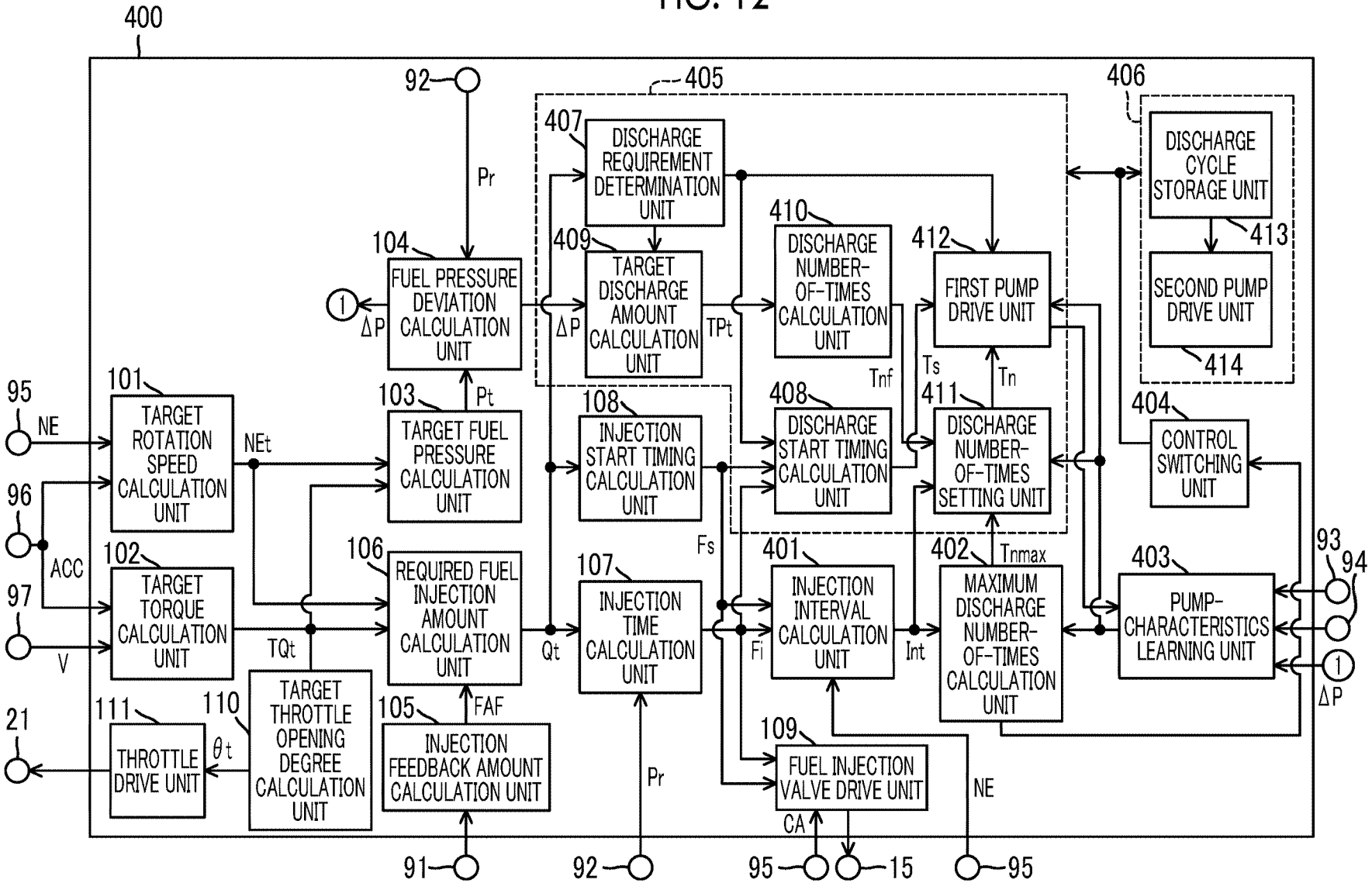
FIG. 12 is a functional block diagram in a control device for a fuel pump of a fourth embodiment.

As illustrated in FIG. 12, an electronic control unit 400 for a fuel pump has the target rotation speed calculation unit 101, the target torque calculation unit 102, the target fuel pressure calculation unit 103, the fuel pressure deviation calculation unit 104, the injection feedback amount calculation unit 105, the required fuel injection amount calculation unit 106, the injection time calculation unit 107, the injection start timing calculation unit 108, and the fuel injection valve drive unit 109, as functional units. The electronic control unit 400 has the target throttle opening degree calculation unit 110, the throttle drive unit 111, an injection interval calculation unit 401, a maximum discharge number-of-times calculation unit 402, a pump-characteristics learning unit 403, a control switching unit 404, an inter-injection discharge control execution unit 405, and an individual control execution unit 406. The functions of the target rotation speed calculation unit 101, the target torque calculation unit 102, the target fuel pressure calculation unit 103, the fuel pressure deviation calculation unit 104, the injection feedback amount calculation unit 105, the required fuel injection amount calculation unit 106, the injection time calculation unit 107, the injection start timing calculation unit 108, and the fuel injection valve drive unit 109 are the same as those of the first embodiment. The functions of the target throttle opening degree calculation unit 110 and the throttle drive unit 111 are the same as those of the first embodiment.

The injection interval calculation unit 401 calculates the fuel injection interval Int, based on the end timing Fe of the fuel injection from the fuel injection valve 15, the injection start timing Fs calculated by the injection start timing calculation unit 108, and the engine speed NE detected by the crank angle sensor 95. The fuel injection interval Int is calculated as a period of time from when fuel injection from the fuel injection valve 15 provided in a predetermined cylinder ends until when fuel injection from the fuel injection valve 15 provided in a cylinder in which ignition is performed next to the predetermined cylinder is started. For example, in the respective cylinders #1 to #4, ignition is performed in order of the first cylinder #1, the third cylinder #3, the fourth cylinder #4, and the second cylinder #2. The injection interval calculation unit 401 calculates the end timing Fe of the fuel injection based on the injection time Fi calculated by the injection time calculation unit 107 and the injection start timing Fs calculated by the injection start timing calculation unit 108. The fuel injection interval Int is shorter as the end timing Fe of fuel injection is later, the injection start timing Fs is earlier, and the engine speed NE is higher.

The maximum discharge number-of-times calculation unit 402 calculates a maximum discharge number-of-times Tnmax of the fuel discharge from the high-pressure fuel pump 40 capable of being executed within the injection interval Int, based on the fuel injection interval Int calculated by the injection interval calculation unit 401. That is, the maximum discharge number-of-times calculation unit 402 calculates the required time Tmin for performing discharge of fuel from the high-pressure fuel pump 40. The required time Tmin is a time equal to the lift time Ti when the high-pressure fuel pump 40 performs discharge of fuel one time. The required time Tmin is the time equal to the sum of the time n times the lift time Ti and the time n−1 times the standby time (2≤n) when the high-pressure fuel pump 40 performs fuel discharge n times that are a plurality of times. In the fourth embodiment, the lift time Ti is set to a period of time equal to the time required for the plunger 75 to move toward the first side, from the energization control for the high-pressure fuel pump 40 is started, until the protruding portion 75B of the plunger 75 abuts against the insertion part 56 from a state where the second end of the plunger 75 abuts against the protruding part 83. The standby time is set to the time equal to the time required for the plunger 75 to move toward the second side, after the energization control for the high-pressure fuel pump 40 ends, until the plunger 75 abuts against the protruding part 83 from a state where the protruding portion 75B of the plunger 75 of the high-pressure fuel pump 40 abuts against the insertion part 56. The lift time Ti and the standby time are obtained in advance by experiments or simulations and are stored in the electronic control unit 400.

The movement speed of the plunger 75 in the high-pressure fuel pump 40 may change due to various factors, such as fuel properties. For that reason, in the fourth embodiment, the electronic control unit 400 learns pump characteristics showing a relationship between energization time and the discharge amount of the high-pressure fuel pump 40 by the pump-characteristics learning unit 403 to be described below. The maximum discharge number-of-times calculation unit 402 calculates the required time Tmin suitable for the current characteristics of the high-pressure fuel pump 40 by correcting the lift time Ti and the standby time in conformity with the time required for the movement of the plunger 75, based on the pump characteristics learned by the pump-characteristics learning unit 403. The maximum discharge number-of-times Tnmax is calculated based on the required time Tmin and the injection interval Int. For example, when the injection interval Int is equal to or shorter than the required time Tmin when discharge of fuel is performed one time, the maximum discharge number-of-times Tnmax is set to zero. The maximum discharge number-of-times Tnmax is set to one, for example, when the injection interval Int is equal to or longer than the required time Tmin required to perform fuel discharge one time and is shorter than the required time Tmin required to perform fuel discharge two times.

The pump-characteristics learning unit 403 learns the relationship between the time of the energization to the high-pressure fuel pump 40 and the amount of fuel discharged from the high-pressure fuel pump 40 to the high-pressure fuel pipe 34 as pump characteristics. The fuel discharge amount from the high-pressure fuel pump 40 is influenced by the fuel temperature in the high-pressure fuel pipe 34 detected by the fuel temperature sensor 93, the temperature of the coil 85 detected by the coil temperature sensor 94, the battery voltage, and the like. That is, the viscosity of fuel is higher when the fuel temperature is low than when when the fuel temperature is high. For that reason, when the fuel temperature is low, the resistance to fuel discharge is larger than that when the fuel temperature is high. The force with which the plunger 75 is moved toward the pressurizing chamber 78 is weaker when the temperature of the coil 85 is high than when the temperature of the coil 85 is low. The force with which the plunger 75 is moved toward the pressurizing chamber 78 is weaker when the battery voltage is low than when the battery voltage is high.

As described above, the force that moves the plunger 75 is weaker and the movement speed of the plunger 75 is slower, as the fuel temperature is lower, as the temperature of the coil 85 is higher, and as the battery voltage is lower. Hence, the energization time required to move the plunger 75 to discharge the fuel in an amount corresponding to the maximum discharge amount tends to be longer as the fuel temperature is lower, as the temperature of the coil 85 is higher, and as the battery voltage is lower. In other words, in a case where the energization time is the same, the amount of fuel discharged from the high-pressure fuel pump 40 tends to be smaller as the fuel temperature is lower, as the temperature of the coil 85 is higher, and as the battery voltage is lower. The battery voltage can be obtained from the charge-discharge state of the battery 120. The pump-characteristics learning unit 403 calculates a fuel discharge amount achieved the high-pressure fuel pump 40 is driven for the energization period set based on a target discharge amount TPt (to be described below), on the basis of the fuel pressure deviation ΔP calculated by the fuel pressure deviation calculation unit 104, and stores the calculated fuel discharge amount together with information on the fuel temperature, the temperature of the coil 85, and the battery voltage.

The control switching unit 404 switches control modes of the high-pressure fuel pump 40, based on the maximum discharge number-of-times Tnmax calculated by the maximum discharge number-of-times calculation unit 402. That is, the control switching unit 404 performs setting such that the high-pressure fuel pump 40 is controlled by the inter-injection discharge control execution unit 405 when the maximum discharge number-of-times Tnmax is one or more. The control switching unit 404 performs switching such that the high-pressure fuel pump 40 is controlled by the individual control execution unit 406 when the maximum discharge number-of-times Tnmax is zero. As described above, when the maximum discharge number-of-times Tnmax is zero is a case where the injection interval Int is shorter than the required time that is required to discharge the fuel one time from the high-pressure fuel pump 40. In other words, the control switching unit 404 executes the inter-injection discharge control in a case where the injection interval Int is equal to or longer than the required time Tmin, and switches control so as to execute individual control in a case where the injection interval Int is shorter than the required time Tmin.

The inter-injection discharge control execution unit 405 executes the inter-injection discharge control of executing fuel discharge from the high-pressure fuel pump 40 at the predetermined timing between the Nth fuel injection and the (N+1)th fuel injection from the fuel injection valve 15. The inter-injection discharge control execution unit 405 has a discharge requirement determination unit 407, a discharge start timing calculation unit 408, a target discharge amount calculation unit 409, a discharge number-of-times calculation unit 410, a discharge number-of-times setting unit 411, and a first pump drive unit 412, as functional units.

The discharge requirement determination unit 407 determines whether or not the fuel discharge from the high-pressure fuel pump 40 is required, based on the required fuel injection amount Qt calculated by the required fuel injection amount calculation unit 106. The discharge requirement determination unit 407 performs integration each time the required fuel injection amount Qt is calculated, and calculates an integrated value ΣQ of the required fuel injection amount Qt. The discharge requirement determination unit 407 determines that the fuel discharge from the high-pressure fuel pump 40 is required when the calculated integrated value ΣQ becomes equal to or larger than a determination value. The determination value is set to, for example, an amount equal to half of the maximum discharge amount for the high-pressure fuel pump 40.

When the discharge requirement determination unit 407 determines that the fuel discharge from the high-pressure fuel pump 40 is required, the discharge start timing calculation unit 408 calculates the discharge start timing Ts that is the start timing from which fuel discharge from the high-pressure fuel pump 40 to the high-pressure fuel pipe 34 is performed. The discharge start timing Ts is calculated based on the timing of the fuel injection from the fuel injection valve 15. In the fourth embodiment, the timing at which the predetermined preparation time has elapsed from the end timing Fe of the fuel injection from the fuel injection valve 15 is defined as the discharge start timing Ts. The end timing Fe of the fuel injection can be calculated based on the injection time Fi calculated by the injection time calculation unit 107 and the injection start timing Fs calculated by the injection start timing calculation unit 108. The preparation time is set to a time that is required to stabilize the fuel pressure Pr in the high-pressure fuel pipe 34 after fuel injection from the fuel injection valve 15 ends.

When the discharge requirement determination unit 407 determines that the fuel discharge from the high-pressure fuel pump 40 is required, the target discharge amount calculation unit 409 calculates the target discharge amount TPt that is a target value of the amount of fuel to be discharged from the high-pressure fuel pump 40 to the high-pressure fuel pipe 34. The target discharge amount calculation unit 409 calculates a base discharge amount TPb, based on the required fuel injection amount Qt calculated by the required fuel injection amount calculation unit 106. The base discharge amount TPb is calculated as an amount equal to the required fuel injection amount Qt. That is, as the base discharge amount TPb increases as the required fuel injection amount Qt increases. The target discharge amount calculation unit 409 calculates a discharge feedback amount TK, based on the fuel pressure deviation ΔP calculated by the fuel pressure deviation calculation unit 104. The discharge feedback amount TK is calculated as the sum of respective output values of a proportional element, an integral element, and a derivative element each having an input value obtained by subtracting, from the target fuel pressure Pt, the actual fuel pressure Pr after the fuel discharge when discharge of fuel is performed from the high-pressure fuel pump 40 so as to achieve the target fuel pressure Pt. The target discharge amount calculation unit 409 calculates the target discharge amount TPt by multiplying the base discharge amount TPb by the discharge feedback amount TK.

The discharge number-of-times calculation unit 410 calculates the required discharge number-of-times Tnf that is the required number of times that the fuel is discharged from the high-pressure fuel pump 40 to the high-pressure fuel pipe 34, based on the target discharge amount TPt calculated by the target discharge amount calculation unit 409. The discharge number-of-times calculation unit 410 calculates the smallest number of times of discharge among the numbers of times of discharge required to discharge fuel in an amount corresponding to the target discharge amount TPt, as the required discharge number-of-times Tnf. For example, in a case where the target discharge amount TPt is equal to or smaller than the maximum discharge amount of the high-pressure fuel pump 40, the required discharge number-of-times Tnf is calculated as one time. In a case where the target discharge amount TPt is larger than the maximum discharge amount and equal to or smaller than twice the maximum discharge amount, the required discharge number-of-times Tnf is calculated as two times.

The discharge number-of-times setting unit 411 sets the discharge number-of-times Tn that the fuel is discharged from the high-pressure fuel pump 40 to the high-pressure fuel pipe 34. The discharge number-of-times setting unit 411 calculates an execution time Tnes required to perform fuel discharge equivalent to the needed discharge number-of-times Tnf calculated by the discharge number-of-times calculation unit 410, based on the pump characteristics learned by the pump-characteristics learning unit 403. The execution time Tnes is a time equal to the lift time Ti when the required discharge number-of-times Tnf is one time. The execution time Tnes is a time equal to the sum of a time n times the lift time Ti and a time n−1 times the standby time when the required discharge number-of-times Tnf is n times (2≤n), which is a plurality of times. The lift time Ti and the standby time are calculated based on the pump characteristics. When the execution time Tnes is calculated as described above, a time obtained by adding the preparation time to the execution time Tnes is calculated as an add time Tad. When the add time Tad is equal to or shorter than the injection interval Int calculated by the injection interval calculation unit 401, the discharge number-of-times setting unit 411 sets the discharge number-of times Tn to the same number of times as the required discharge number-of-times Tnf. In a case where the add time Tad exceeds the injection interval Int, the discharge number-of-times setting unit 411 sets the same number as the maximum discharge number-of-times Tnmax calculated by the maximum discharge number-of-times calculation unit 402 as the discharge number-of-times Tn.

When the discharge requirement determination unit 407 determines that the fuel discharge from the high-pressure fuel pump 40 is required, the first pump drive unit 412 executes the energization control for the coil 85 of the high-pressure fuel pump 40 at the discharge start timing Ts calculated by the discharge start timing calculation unit 408. The first pump drive unit 412 causes the high-pressure fuel pump 40 to perform suction of fuel and discharge of the fuel by causing the plunger 75 to reciprocate through the energization control. The first pump drive unit 412 ends the energization when the lift time Ti has elapsed based on the pump characteristics learned by the pump-characteristics learning unit 403 has elapsed after the energization control for the high-pressure fuel pump 40 is started. In a case where the discharge number-of-times Tn set by the discharge number-of-times setting unit 411 is two times or more, the first pump drive unit 412 ends the energization control at a timing at which the lift time Ti has elapsed after the energization control is started, and executes the energization control again at a timing at which a predetermined standby time has elapsed from the end timing. The energization control ends again at the timing at which the lift time Ti has elapsed after the energization control is again started. By repeatedly executing the energization control as described above, fuel discharge from the high-pressure fuel pump 40 is performed a plurality of times.

The individual control execution unit 406 executes individual control of repeatedly discharging the fuel from the high-pressure fuel pump 40 in a fixed cycle. In the individual control, fuel discharge is performed regardless of the timing of the fuel injection from the fuel injection valve 15. The individual control execution unit 406 has a discharge cycle storage unit 413 and a second pump drive unit 414, as functional units.

The discharge cycle storage unit 413 stores an energization cycle in which the energization control for the high-pressure fuel pump 40 is executed. In the fourth embodiment, the energization cycle is a fixed cycle, and is obtained in advance by experiments or simulations such that the fuel discharge amount from the high-pressure fuel pump 40 is the maximum discharge amount and the fastest driving cycle is achieved, and is stored.

The second pump drive unit 414 drives the high-pressure fuel pump 40 without following the timing of the fuel injection from the fuel injection valve 15 by performing the energization control in the energization cycle stored in the discharge cycle storage unit 413.

The functions and the effects of the fourth embodiment will be described with reference to FIGS. 13 and 14.

(4-1)

A case where the injection interval Int is equal to or longer than the required time Tmin and the execution of the inter-injection discharge control is set by the control switching unit 404 will be described with reference to FIG. 13.

Figure 13:
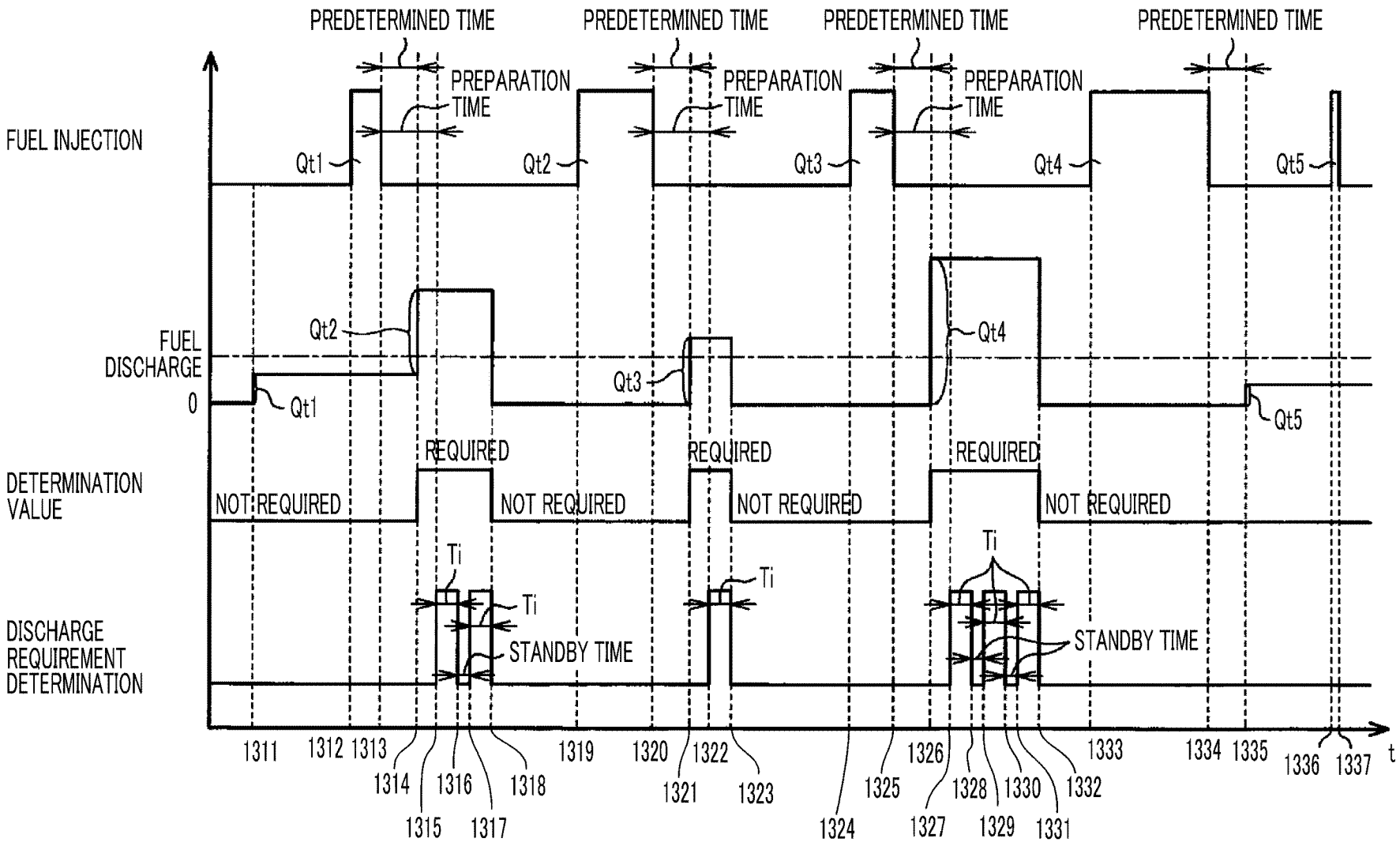
FIG. 13 is a timing chart schematically illustrating transitions of respective parameters in inter-injection discharge control.

As illustrated in FIG. 13, fuel injection from each fuel injection valve 15 is repeatedly performed along with the operation of the internal combustion engine 10. A required fuel injection amount Qt1 of the fuel injection executed during the period from timing t1312 to timing t1313 is calculated at timing t1311. When the required fuel injection amount Qt1 is calculated by the required fuel injection amount calculation unit 106 at timing t1311, as illustrated in FIG. 13, the discharge requirement determination unit 407 calculates the integrated value ΣQ obtained by integrating the required fuel injection amount Qt. Since the integrated value ΣQ is zero before the timing t1311, the integrated value ΣQ becomes a value equal to the required fuel injection amount Qt1 at the timing t1311. At the timing t1311, the integrated value ΣQ is equal to or less than the determination value. For that reason, as illustrated in FIG. 13, the discharge requirement determination unit 407 determines that the fuel discharge from the high-pressure fuel pump 40 is not required. As illustrated in FIG. 13, the fuel injection valve drive unit 109 starts fuel injection at the discharge start timing Ts (timing t1312) calculated by the discharge start timing calculation unit 115 by using the injection time Fi and the injection start timing Fs based on the required fuel injection amount Qt1. The fuel injection valve drive unit 109 continues the fuel injection for the injection time Fi calculated by the injection time calculation unit 107 based on the required fuel injection amount Qt1, and ends the fuel injection at the timing t1313 at which the injection time Fi has elapsed from the timing t1312.

Thereafter, a required fuel injection amount Qt2 for the next fuel injection is calculated by the required fuel injection amount calculation unit 106. The required fuel injection amount calculation unit 106 calculates the required fuel injection amount Qt2 at timing t1314 at which a predetermined time has elapsed after the fuel injection ends at the timing t1313. The predetermined time is a time required to appropriately stabilize the fuel pressure Pr after the fuel injection, and is shorter than the preparation time. The required fuel injection amount Qt2 is larger than the required fuel injection amount Qt1 (Qt2>Qt1). When required fuel injection amount Qt2 is calculated by the required fuel injection amount calculation unit 106, as illustrated in FIG. 13, the discharge requirement determination unit 407 adds the required fuel injection amount Qt2 to the integrated value ΣQ to newly calculate the integrated value ΣQ (ΣQ=Qt1+Qt2). At timing t1314, the integrated value ΣQ becomes equal to or larger than the determination value. Accordingly, as illustrated in FIG. 13, the discharge requirement determination unit 407 determines that the fuel discharge from the high-pressure fuel pump 40 is required.

When fuel discharge is determined to be required as described above, the target discharge amount calculation unit 409 calculates the target discharge amount TPt. The target discharge amount calculation unit 409 calculates the base discharge amount TPb, based on the required fuel injection amount Qt2 calculated by the required fuel injection amount calculation unit 106. The target discharge amount TPt is calculated by multiplying the calculated base discharge amount TPb by the discharge feedback amount TK calculated based on the fuel pressure deviation ΔP at the timing t1314. When the target discharge amount TPt is calculated as described above, the discharge number-of-times calculation unit 410 calculates the required discharge number-of-times Tnf, based on the target discharge amount TPt. Thereafter, the discharge number-of-times setting unit 411 sets the discharge number-of-times Tn, based on the required discharge number-of-times Tnf, the pump characteristics, the injection interval Int, and the maximum discharge number-of-times Tnmax. At timing t1314, the discharge number-of-times Tn is set to two times.

The discharge start timing calculation unit 115 calculates the discharge start timing Ts (timing t1315), using the injection time Fi, the injection start timing Fs, and the like based on the required fuel injection amount Qt1. The discharge start timing Ts is a timing at which the preparation time has elapsed from the end timing Fe (timing t1313) of the fuel injection.

When the discharge requirement determination unit 407 determines that the fuel discharge from the high-pressure fuel pump 40 is required, the first pump drive unit 412 performs the energization control to the coil 85 of the high-pressure fuel pump 40 such that fuel discharge of the discharge number-of-times Tn (two times) set by the discharge number-of-times calculation unit 410 is executed from the discharge start timing Ts (timing t1315) calculated by the discharge start timing calculation unit 408.

As illustrated in FIG. 13, the first pump drive unit 412 performs two-times fuel discharge from the high-pressure fuel pump 40 to the high-pressure fuel pipe 34 at the discharge start timing Ts (timing t1315). A first fuel discharge is executed from timing t1315 to timing t1316 at which the lift time Ti has elapsed from timing t1315. Accordingly, the fuel in an amount corresponding to the maximum discharge amount is supplied from the high-pressure fuel pump 40 to the high-pressure fuel pipe 34. The first pump drive unit 412 starts fuel discharge at timing t1317 at which the standby time has elapsed from timing t1316 at which the first fuel discharge is ended. A second fuel discharge is executed from timing t1317 to timing t1318 at which the lift time Ti elapses. Accordingly, fuel equivalent to the maximum discharge amount is supplied from the high-pressure fuel pump 40 to the high-pressure fuel pipe 34. When fuel discharge of the discharge number-of-times Tn is executed, the first pump drive unit 412 stops driving the high-pressure fuel pump 40. The discharge requirement determination unit 407 resets the integrated value ΣQ to zero, as illustrated in FIG. 13, at the timing t1318 at which that the fuel discharge of the discharge number-of-times Tn ends. Accordingly, the integrated value ΣQ becomes less than the determination value, and as illustrated in FIG. 13, at the timing t1318, the discharge requirement determination unit 407 determines that the fuel discharge from the high-pressure fuel pump 40 is not required.

Thereafter, as illustrated in FIG. 13, the fuel injection valve drive unit 109 starts fuel injection at the discharge start timing Ts (timing t1319) calculated by the discharge start timing calculation unit 115 based on the required fuel injection amount Qt2. The fuel injection valve drive unit 109 continues the fuel injection for the injection time Fi calculated based on the required fuel injection amount Qt2 by the injection time calculation unit 107, and ends the fuel injection at timing t1320 at which the injection time Fi has elapsed from the timing t1319.

In this case, when the fuel injection from the fuel injection valve 15 is executed one time, fuel is discharged two times from the high-pressure fuel pump 40 to the high-pressure fuel pipe 34. Hence, the discharge ratio that is the ratio of the number of times of discharge of the fuel from the high-pressure fuel pump 40 to the high-pressure fuel pipe 34 to the number of times of injection of the fuel from the fuel injection valve 15 is "2".

Thereafter, a required fuel injection amount Qt3 in the next fuel injection is calculated by the required fuel injection amount calculation unit 106. The required fuel injection amount calculation unit 106 calculates the required fuel injection amount Qt3 at timing t1321 at which a predetermined time has elapsed after the fuel injection ends at the timing t1320. The required fuel injection amount Qt3 is larger than the required fuel injection amount Qt1 and is smaller than the required fuel injection amount Qt2 (Qt2>Qt3>Qt1). When the required fuel injection amount Qt3 is calculated by the required fuel injection amount calculation unit 106, as illustrated in FIG. 13, the discharge requirement determination unit 407 calculates the integrated value ΣQ of the required fuel injection amount Qt. Since the integrated value ΣQ is reset to zero at timing t1318, the integrated value ΣQ is a value equal to the required fuel injection amount Qt3 at the timing t1321. The required fuel injection amount Qt3 is larger than the required fuel injection amount Qt1, and the integrated value ΣQ becomes equal to or larger than the determination value at the timing t1321. Accordingly, as illustrated in FIG. 13, the discharge requirement determination unit 407 determines that the fuel discharge from the high-pressure fuel pump 40 is required.

When fuel discharge is determined to be required as described above, the target discharge amount calculation unit 409 calculates the target discharge amount TPt, and the discharge number-of-times calculation unit 410 calculates the required discharge number-of-times Tnf. Thereafter, the discharge number-of-times setting unit 411 sets the discharge number-of-times Tn. At the timing t1321, since the required fuel injection amount Qt3 is smaller than the required fuel injection amount Qt2, the discharge number-of-times Tn is set to one time. The discharge start timing calculation unit 115 calculates the discharge start timing Ts (timing t1322), using the injection time Fi and the injection start timing Fs based on the required fuel injection amount Qt2. The discharge start timing Ts is a timing at which the preparation time has elapsed from the end timing Fe (timing t1320) of the fuel injection.

When the discharge requirement determination unit 407 determines that the fuel discharge from the high-pressure fuel pump 40 is required, the first pump drive unit 412 performs the energization control for the coil 85 of the high-pressure fuel pump 40 such that fuel discharge is performed the discharge number-of-times Tn (one time) set by the discharge number-of-times calculation unit 410 from the discharge start timing Ts (timing t1322) calculated by the discharge start timing calculation unit 408.

As illustrated in FIG. 13, the first pump drive unit 412 cause the high-pressure fuel pump 40 to perform fuel discharged to the high-pressure fuel pipe 34 one time at the discharge start timing Ts (timing t1322). The fuel discharge is executed from the timing t1322 to the timing t1323 at which the lift time Ti has elapsed from timing t1322. Accordingly, the fuel in an amount corresponding to the maximum discharge amount is supplied from the high-pressure fuel pump 40 to the high-pressure fuel pipe 34. After fuel discharge is performed the discharge number-of-times Tn, the first pump drive unit 412 stops driving the high-pressure fuel pump 40. The discharge requirement determination unit 407 resets the integrated value ΣQ to zero, as illustrated in FIG. 13, at timing t1323 at which that the fuel discharge of the discharge number-of-times Tn ends. Accordingly, the integrated value ΣQ becomes less than the determination value, and as illustrated in FIG. 13, at the timing t1323, the discharge requirement determination unit 407 determines that the fuel discharge from the high-pressure fuel pump 40 is not required.

Thereafter, as illustrated in FIG. 13, the fuel injection valve drive unit 109 starts fuel injection at the discharge start timing Ts (timing t1324) calculated based on the required fuel injection amount Qt3 by the discharge start timing calculation unit 115. The fuel injection valve drive unit 109 continues the fuel injection for the injection time Fi calculated based on the required fuel injection amount Qt3 by the injection time calculation unit 107, and ends the fuel injection at timing t1325 at which the injection time Fi has elapsed from the timing t1324.

In this case, when the fuel injection from the fuel injection valve 15 is executed one time, fuel discharge from the high-pressure fuel pump 40 to the high-pressure fuel pipe 34 is discharged one time. Hence, the discharge ratio that is the ratio of the number of times of fuel discharge from the high-pressure fuel pump 40 to the high-pressure fuel pipe 34 to the number of times of fuel injection from the fuel injection valve 15 is "1".

Thereafter, a required fuel injection amount Qt4 in the next fuel injection is calculated by the required fuel injection amount calculation unit 106. The required fuel injection amount calculation unit 106 calculates the required fuel injection amount Qt4 at timing t1326 at which a predetermined time has elapsed after the fuel injection ends at the timing t1325. The required fuel injection amount Qt4 is larger than the required fuel injection amount Qt2 (Qt4>Qt2). When the required fuel injection amount Qt4 is calculated by the required fuel injection amount calculation unit 106, as illustrated in FIG. 13, the discharge requirement determination unit 407 calculates the integrated value ΣQ of the required fuel injection amount Qt. Since the integrated value ΣQ is reset to zero at timing t1323, the integrated value ΣQ becomes a value equal to the required fuel injection amount Qt4 at the timing t1326. Since the required fuel injection amount Qt4 is larger than the required fuel injection amount Qt2 and is larger than the required fuel injection amount Qt3, the integrated value ΣQ becomes equal to or larger than the determination value at timing t1326. Accordingly, as illustrated in FIG. 13, the discharge requirement determination unit 407 determines that the fuel discharge from the high-pressure fuel pump 40 is required.

When fuel discharge is determined to be required as described above, the target discharge amount calculation unit 409 calculates the target discharge amount TPt, and the discharge number-of-times calculation unit 410 calculates the required discharge number-of-times Tnf. Thereafter, the discharge number-of-times setting unit 411 sets the discharge number-of-times Tn. At timing t1326, since the required fuel injection amount Qt4 is larger than an integrated value of the required fuel injection amount Qt1 and the required fuel injection amount Qt2, the discharge number-of-times Tn is set to three times. The discharge start timing calculation unit 115 calculates the discharge start timing Ts (timing t1327), using the injection time Fi and the injection start timing Fs based on the required fuel injection amount Qt3. The discharge start timing Ts is a timing at which the preparation time has elapsed from the end timing Fe (timing t1325) of the fuel injection.

When the discharge requirement determination unit 407 determines that the fuel discharge from the high-pressure fuel pump 40 is required, the first pump drive unit 412 performs the energization control to the coil 85 of the high-pressure fuel pump 40 such that fuel discharge of the discharge number-of-times Tn (three times) set by the discharge number-of-times calculation unit 410 is executed from the discharge start timing Ts (timing t1327) calculated by the discharge start timing calculation unit 408.

As illustrated in FIG. 13, the first pump drive unit 412 causes the high-pressure fuel pump 40 to perform fuel discharge to the high-pressure fuel pipe 34 three times from the discharge start timing Ts (timing t1327). A first fuel discharge is executed from timing t1327 to timing t1328 at which the lift time Ti has elapsed from timing t1327. Accordingly, the fuel in an amount corresponding to the maximum discharge amount is supplied from the high-pressure fuel pump 40 to the high-pressure fuel pipe 34. The first pump drive unit 412 starts fuel discharge at timing t1329 at which the standby time has elapsed from timing t1328 at which the first fuel discharge ends. A second fuel discharge is executed from timing t1329 to timing t1330 at which the lift time Ti has elapsed from timing t1329. Accordingly, the fuel in an amount corresponding to the maximum discharge amount is supplied from the high-pressure fuel pump 40 to the high-pressure fuel pipe 34. The first pump drive unit 412 starts fuel discharge at timing t1331 at which the standby time has elapsed from the timing t1330 at which the second fuel discharge ends. A third fuel discharge is executed from timing t1331 to timing t1332 at which the lift time Ti has elapsed from timing t1331. Accordingly, the fuel in an amount corresponding to the maximum discharge amount is supplied from the high-pressure fuel pump 40 to the high-pressure fuel pipe 34. When fuel discharge of the discharge number-of-times Tn is executed, the first pump drive unit 412 stops driving the high-pressure fuel pump 40. The discharge requirement determination unit 407 resets the integrated value ΣQ to zero, as illustrated in FIG. 13, at timing t1332 at which that the fuel discharge of the discharge number-of-times Tn ends. Accordingly, the integrated value ΣQ becomes less than the determination value, and as illustrated in FIG. 13, at timing t1332, the discharge requirement determination unit 407 determines that fuel discharge from the high-pressure fuel pump 40 is not required.

Thereafter, as illustrated in FIG. 13, the fuel injection valve drive unit 109 starts fuel injection at the discharge start timing Ts (timing t1333) calculated based on the required fuel injection amount Qt4 by the discharge start timing calculation unit 115. The fuel injection valve drive unit 109 continues the fuel injection for the injection time Fi calculated based on the required fuel injection amount Qt4 by the injection time calculation unit 107, and ends the fuel injection at timing t1334 at which the injection time Fi has elapsed from the timing t1333.

In this case, when fuel injection from the fuel injection valve 15 is performed one time, fuel discharge from the high-pressure fuel pump 40 to the high-pressure fuel pipe 34 is performed one time. Hence, the discharge ratio that is the ratio of the number of times of fuel discharge from the high-pressure fuel pump 40 to the high-pressure fuel pipe 34 to the number of times of fuel injection from the fuel injection valve 15 is "3".

Thereafter, a required fuel injection amount Qt5 for the next fuel injection is calculated by the required fuel injection amount calculation unit 106. The required fuel injection amount calculation unit 106 calculates the required fuel injection amount Qt5 at timing t1335 at which a predetermined time has elapsed after the fuel injection ends at timing t1334. The required fuel injection amount Qt5 is smaller than the required fuel injection amount Qt1 (Qt1>Qt5). When the required fuel injection amount Qt5 is calculated by the required fuel injection amount calculation unit 106, as illustrated in FIG. 13, the discharge requirement determination unit 407 calculates the integrated value ΣQ of the required fuel injection amount Qt. Since the integrated value ΣQ is reset to zero at timing t1332, the integrated value ΣQ becomes a value equal to the required fuel injection amount Qt5 at timing t1335. Since the required fuel injection amount Qt5 is smaller than the required fuel injection amount Qt1, the integrated value ΣQ is less than the determination value at timing t1335. For that reason, the discharge requirement determination unit 407 determines that the fuel discharge from the high-pressure fuel pump 40 is not required. As illustrated in FIG. 13, the fuel injection valve drive unit 109 starts fuel injection at the discharge start timing Ts (timing t1336) calculated by the discharge start timing calculation unit 115 by using the injection time Fi and the injection start timing Fs based on the required fuel injection amount Qt5. The fuel injection valve drive unit 109 continues the fuel injection for the injection time Fi calculated by the injection time calculation unit 107 based on the required fuel injection amount Qt5, and ends the fuel injection at timing t1337 at which the injection time Fi has elapsed from timing t1336.

In this case, fuel is not discharged from the high-pressure fuel pump 40 to the high-pressure fuel pipe 34 during a period between the fuel injection performed from timing t1333 to timing t1334 and the fuel injection performed from timing t1336 to timing t1337.

As described above, in the fourth embodiment, the discharge start timing Ts for the high-pressure fuel pump 40 is set to a timing at which a preparation period has elapsed from the end timing Fe of the fuel injection, and the inter-injection discharge control for performing the fuel discharge at the predetermined timing between the Nth fuel injection and the (N+1)th fuel injection is performed. During execution of the inter-injection discharge control, the discharge ratio is changed in accordance with a change in the operational state of the internal combustion engine by calculating the target discharge amount TPt to set the discharge number-of-times Tn, based on the required fuel injection amount Qt set in accordance with the operational state of the internal combustion engine. For example, in a case where the required fuel injection amount Qt is small and when the integrated value ΣQ is less than the determination value, the fuel discharge from the high-pressure fuel pump 40 is not performed even one time during a period from when fuel injection from the fuel injection valve 15 is performed until when the next fuel injection is performed. Accordingly, the discharge ratio can be changed to a value smaller than one.

When the integrated value ΣQ is equal to or larger than a determination value, fuel discharge from the high-pressure fuel pump 40 is performed one time or a plurality of times during a period from when fuel injection from the fuel injection valve 15 is performed until when the next fuel injection is performed. Accordingly, the discharge ratio can be changed to a value equal to or larger than one.

Hence, it is possible to execute fuel discharge corresponding to the fuel injection amount by determining whether it is necessary to perform fuel discharge in accordance with the required fuel injection amount Qt, that is, the fuel injection amount, which is correlated with the operational state of the internal combustion engine. For that reason, according to the fourth embodiment, the effect of improving the controllability of the fuel pressure Pr in the high-pressure fuel pipe 34 is obtained.

(4-2)

In the fourth embodiment, when the discharge requirement determination unit 407 determines that fuel discharge from the high-pressure fuel pump 40 is required, fuel discharge from the high-pressure fuel pump 40 is performed at the discharge start timing Ts at which the preparation time has elapsed from the end timing Fe of the fuel injection, instead of immediately performing fuel discharge from the high-pressure fuel pump 40 to the high-pressure fuel pipe 34. As described above, by executing the inter-injection discharge control such that fuel discharge is performed after the end of the Nth fuel injection, fuel discharge is started so as not to overlap the Nth period of fuel injection from the fuel injection valve 15. For that reason, when fuel injection from the fuel injection valve 15 is performed, it is possible to restrain fuel from being discharged from the high-pressure fuel pump 40. Hence, the influence of fluctuation of the fuel pressure Pr in the high-pressure fuel pipe 34 resulting from the fuel discharge from the high-pressure fuel pump 40 can be made difficult to occur in the fuel injection, and the timing of fuel supply to the high-pressure fuel pipe 34 can be made appropriate.

(4-3)

In the fourth embodiment, when the fuel in an amount corresponding to the target discharge amount TPt is supplied to the high-pressure fuel pipe 34, fuel discharge from the high-pressure fuel pump 40 can be performed a plurality of times during a period from when fuel injection from the fuel injection valve 15 is performed until when the next fuel injection is performed. That is, the discharge ratio can be changed to a value equal to or larger than one. For that reason, it is possible to set the maximum discharge amount for the high-pressure fuel pump 40 to be smaller, and a smaller-sized high-pressure fuel pump 40 can also be selected so as to correspond to the maximum discharge amount therefor.

(4-4)

When the integrated value ΣQ is less than the determination value, fuel discharge from the high-pressure fuel pump 40 is not performed even one time during a period from when fuel injection from the fuel injection valve 15 is performed until when the next fuel injection is performed. For that reason, when the amount of fuel injected from the fuel injection valve 15 is small, it is also possible to stop driving the high-pressure fuel pump 40, and the driving frequency of the high-pressure fuel pump 40 can be made lower than that when the driving of the high-pressure fuel pump 40 is continued irrespective of the amount of fuel injected from the fuel injection valve 15. This contributes to reduction of electrical power consumption.

(4-5)

In the fourth embodiment, the discharge ratio is changed by setting the discharge number-of-times Tn, based on the target discharge amount TPt. For that reason, for example, in a case where the target discharge amount TPt is larger than the maximum amount of fuel that can be discharged one time from the high-pressure fuel pump 40, it is possible to supply the fuel in an amount corresponding to the target discharge amount TPt to the high-pressure fuel pipe 34 by setting the discharge ratio to a high value and performing fuel discharge from the high-pressure fuel pump 40 a plurality of times per one fuel injection from the fuel injection valve 15. Hence, the control for setting the discharge ratio corresponding to the target discharge amount TPt can be implemented.

(4-6)

A case where the injection interval Int is shorter than the required time Tmin and the execution of the individual control is set by the control switching unit 404 will be described with reference to FIG. 14. As illustrated in FIG. 14, the fuel injection interval Int is shorter as the engine speed NE of the internal combustion engine 10 is higher. When the fuel injection interval Int becomes short and the maximum discharge number-of-times Tnmax calculated by the maximum discharge number-of-times calculation unit 402 becomes zero, the control switching unit 404 controls the high-pressure fuel pump 40 using the individual control execution unit 406. That is, when the injection interval Int is determined to be shorter than the required time Tmin required to discharge fuel from the high-pressure fuel pump 40 one time and one fuel discharge cannot be completed within the injection interval Int, the control switching unit 404 switches the control of the high-pressure fuel pump 40 from the inter-injection discharge control to the individual control.

Figure 14:
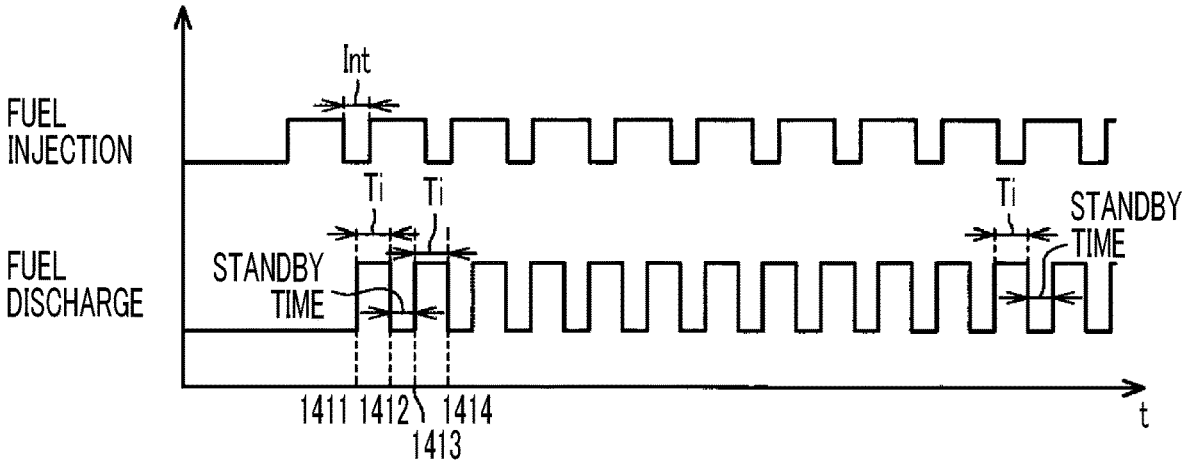
FIG. 14 is a timing chart schematically illustrating transitions of respective parameters in individual control.

As illustrated in FIG. 14, in the individual control, the second pump drive unit 414 performs the energization control in the energization cycle stored in the discharge cycle storage unit 413. The energization cycle is a fixed cycle, and is set such that the amount of fuel discharged from the high-pressure fuel pump 40 is the maximum discharge amount and the fastest driving cycle is achieved. For that reason, the second pump drive unit 414 executes fuel discharge from timing t1411 at which fuel discharge from the high-pressure fuel pump 40 is started to the high-pressure fuel pipe 34 to timing t1412 at which the lift time Ti has elapsed from timing t1411. Accordingly, the fuel in an amount corresponding to the maximum discharge amount is supplied from the high-pressure fuel pump 40 to the high-pressure fuel pipe 34. When the fuel discharge ends, the second pump drive unit 414 starts fuel discharge at timing t1413 at which the standby time has elapsed from timing t1412 at which the fuel discharge ends. Even in the above fuel discharge, the second pump drive unit 414 executes fuel discharge from the timing t1413 at which the fuel discharge is started to timing t1414 at which the lift time Ti has elapsed from timing t1413. Accordingly, the fuel in an amount corresponding to the maximum discharge amount is supplied from the high-pressure fuel pump 40 to the high-pressure fuel pipe 34. Thereafter, as described above, fuel discharge is repeatedly executed until control is switched from the individual control to the inter-injection discharge control. By executing the individual control as described above, the fuel is discharged from the high-pressure fuel pump 40 to the high-pressure fuel pipe 34 without following the timing of fuel injection from the fuel injection valve 15.

In the fourth embodiment, in a case where the fuel injection interval Int in the fuel injection valve 15 is equal to or longer than the required time Tmin required to discharge the fuel one time from the high-pressure fuel pump 40, the inter-injection discharge control is executed. Accordingly, when one or more times of fuel discharge from the high-pressure fuel pump 40 can be completed within the fuel injection interval Int, fuel discharge is executed at a predetermined timing between the Nth fuel injection and the (N+1)th fuel injection. For that reason, the controllability of the fuel pressure in the high-pressure fuel pipe 34 can be maintained.

In a case where the injection interval Int is shorter than the required time Tmin, the fuel discharge from the high-pressure fuel pump 40 cannot be completed within the fuel injection interval Int between fuel injections from in the fuel injection valve 15. In this case, the individual control of repeatedly executing discharge of fuel in the fixed cycle is executed irrespective of the timing of fuel injection. In the individual control, fuel is repeatedly discharged from the high-pressure fuel pump 40 without following the fuel injection from the fuel injection valve 15.

As described above, according to the fourth embodiment, in a case where the fuel injection interval Int is shorter than the required time Tmin, switching is made from the inter-injection discharge control to the individual control. Accordingly, it is possible to increase the fuel discharge amount with respect to the fuel injection amount as compared to a case where the inter-injection discharge control is executed.

In the fourth embodiment, the fixed cycle set in the individual control is set such that the amount of fuel discharged from the high-pressure fuel pump 40 is the maximum discharge amount and the fastest driving cycle is achieved. For that reason, by executing the individual control, the fuel discharge amount per unit time can be maximized, and an excessive decrease in the fuel discharge amount with respect to the fuel injection amount can also be suppressed.

(4-7)

Discharging fuel from the high-pressure fuel pump 40 one time requires some time. In the fourth embodiment, in a case where the add time Tad for performing the fuel discharge the required discharge number-of-times Tnf exceeds the injection interval Int, the discharge number-of-times setting unit 411 sets the discharge number-of-times Tn to the same number as the maximum discharge number-of-times Tnmax calculated by the maximum discharge number-of-times calculation unit 402. Accordingly, an upper limit of the discharge number-of-times Tn set by the discharge number-of-times setting unit 411 is limited to the maximum discharge number-of-times Tnmax. That is, an upper limit of the discharge ratio is limited based on the injection interval Int. For that reason, the time required to discharge fuel from the fuel pump is restrained from becoming longer than the interval between fuel injections from the fuel injection valve 15. Hence, the number of times of fuel discharge within the fuel injection interval Int, which is a limited period, is restrained from being set to an unachievable value, so that driving of the high-pressure fuel pump 40 can be made appropriate.

When the upper limit of the discharge ratio is set as described above, fuel discharge may be executed the number of times smaller than the required discharge number-of-times Tnf. In a case where a situation in which the discharge number-of-times Tn is limited to the number of times smaller than the required discharge number-of-times Tnf continues for a predetermined time, a control mode in which switching is made from the inter-injection discharge control to the individual control may be adopted. In a case where the configuration as described above is adopted, switching to the inter-injection discharge control may be made when the individual control is executed and the fuel pressure Pr increases correspondingly. In the configuration as described above, even in a case where a configuration in which the discharge ratio is limited is adopted, a decrease in the fuel pressure Pr in the high-pressure fuel pipe 34 can be restrained.

The respective embodiments may be modified and carried out as follows. The respective embodiments and the following modification examples may be carried out in combination with each other within a range in which technical contradictions do not occur. In the first embodiment and the second embodiment, the discharge requirement determination unit 113 determines whether or not the fuel discharge from the high-pressure fuel pump 40 is required, based on the fuel pressure deviation ΔP. The manner of determining as to whether or not fuel discharge from the high-pressure fuel pump 40 is required is not limited to this. For example, the discharge requirement determination unit 113 can determine whether or not fuel discharge from the high-pressure fuel pump 40 is required, based on the required fuel injection amount Qt calculated by the required fuel injection amount calculation unit 106. In this case, the discharge requirement determination unit 113 can calculate the integrated value ΣQ of the required fuel injection amount Qt by performing integration each time the required fuel injection amount Qt is calculated and determine whether or not the fuel discharge from the high-pressure fuel pump 40 is required, based on the integrated value ΣQ. The discharge requirement determination unit 113 can also determine whether or not the fuel discharge from the high-pressure fuel pump 40 is required, based on, for example, the magnitude of other parameters, such as the calculated required fuel injection amount Qt, instead of the integrated value Q.

In the first embodiment and the second embodiment, although the discharge number-of-times setting unit 114, 122 sets the discharge number-of-times Tn based on the fuel pressure deviation ΔP, the manner of setting the discharge number-of-times Tn is not limited to this. For example, the discharge number-of-times setting unit 114, 122 can set the discharge number-of-times Tn, based on the required fuel injection amount Qt. In the inter-injection discharge control execution unit 112, the pump characteristics showing the relationship between the energization time and the discharge amount for the high-pressure fuel pump 40 may be learned, and the learned pump characteristics may be reflected in the setting of the discharge number-of-times Tn.

In the first embodiment and the second embodiment, the predetermined value of the fuel pressure deviation ΔP used when the discharge requirement determination unit 113 determines whether fuel discharge from the high-pressure fuel pump 40 is required is set to a value slightly smaller than the amount of change in the fuel pressure Pr caused when the fuel in an amount corresponding to the maximum discharge amount for the high-pressure fuel pump 40 is supplied from the high-pressure fuel pump 40 to the high-pressure fuel pipe 34. The predetermined value may be changed as needed. For example, the predetermined value may be set to a value of half of the amount of change in the fuel pressure Pr, or may be set to the same value as the amount of change. By setting the predetermined value to a larger value, the discharge requirement determination unit 113 is more likely to determine that the fuel discharge is not required.

In the second embodiment, in a case where the discharge number-of-times Tn has already been set by the discharge number-of-times setting unit 122 when the fuel pressure deviation ΔP is equal to or larger than the predetermined value and the discharge requirement determination unit 113 determines that the fuel discharge from the high-pressure fuel pump 40 is required, the discharge number-of-times setting unit 122 does not set the discharge number-of-times Tn again, and holds the already set discharge number-of-times Tn. The configuration as described above can be changed as needed. For example, when the discharge requirement determination unit 113 determines that fuel discharge from the high-pressure fuel pump 40 is required, the discharge number-of-times setting unit 122 may set the discharge number-of-times Tn again based on the fuel pressure deviation ΔP after the fuel injection ends.

In the third embodiment, the discharge ratio is set, by the discharge ratio setting unit 132, to change in a stepwise manner, such that the discharge ratio takes a higher value when the load KL is high than when the load KL is low. Instead of the configuration as described above, the discharge ratio may be set, by the discharge ratio setting unit 132 to change linearly, such that the discharge ratio takes a higher value when the load KL is high than when the load KL is low.

In the fourth embodiment, although the target discharge amount calculation unit 409 calculates the target discharge amount TPt based on the required fuel injection amount Qt and the fuel pressure deviation ΔP, the manner of calculating the target discharge amount TPt is not limited to this. For example, the target discharge amount calculation unit 409 may calculate the target discharge amount TPt based on the load KL and the engine speed NE of the internal combustion engine 10.

Figure 15:
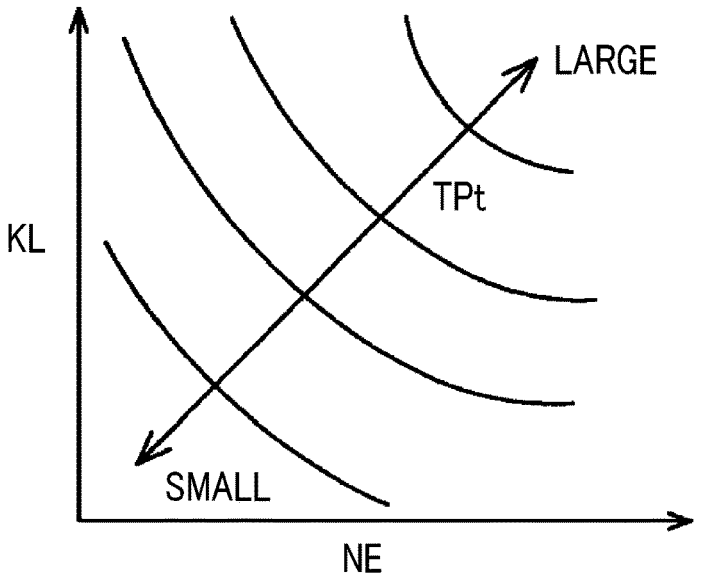
FIG. 15 is a map illustrating an example of a relationship between the load and an engine speed, and a target discharge amount.

In this case, as illustrated in FIG. 15, the target discharge amount calculation unit 409 calculates the target discharge amount TPt such that the target discharge amount TPt when the load KL of the internal combustion engine 10 is high is larger than the target discharge amount TPt when the load KL is low, and calculates the target discharge amount TPt such that the target discharge amount TPt when the engine speed NE is relatively high is larger than the target discharge amount TPt when the engine speed NE is relatively low.

The amount of fuel injection from the fuel injection valve 15 at one time is larger when the load KL on the internal combustion engine 10 is high than when the load KL is low. When the engine speed NE of the internal combustion engine 10 is high, the fuel injection interval Int is short and therefore the fuel pressure Pr in the high-pressure fuel pipe 34 need to be set to be higher than that when the engine speed NE is relatively low. Hence, as in the configuration as described above, the pressure of the fuel in the high-pressure fuel pipe 34 can be appropriately controlled by calculating the target discharge amount TPt for the high-pressure fuel pump 40.

The target discharge amount calculation unit 409 may calculate the target discharge amount TPt based on the target fuel pressure Pt and the required fuel injection amount Qt. In the fourth embodiment, switching is made between the inter-injection discharge control and the individual control based on the fuel injection interval Int and the required time Tmin. In the configuration as described above, when the high-pressure fuel pump 40 performed discharge of fuel one time, the required time Tmin is set to the time equal to the lift time Ti. The manner setting the required time Tmin is not limited to this. For example, the required time Tmin required for the high-pressure fuel pump 40 to perform fuel discharge one time may be set to time equal to the sum of the lift time Ti and the preparation time. In this case, the maximum discharge number-of-times calculation unit 402 sets the maximum discharge number-of-times Tnmax to zero when the fuel injection interval Int is equal to the sum of the lift time Ti and the preparation time.

In the fourth embodiment, the determination value of integrated value ΣQ used when the discharge requirement determination unit 407 determines whether fuel discharge from the high-pressure fuel pump 40 is required is set to half of the maximum discharge amount for the high-pressure fuel pump 40. The determination value may be changed as needed. For example, the determination value may be set to the same amount as the maximum discharge amount of the high-pressure fuel pump 40. By setting the determination value to a larger value, the discharge requirement determination unit 407 is more likely to determine that the fuel discharge is not required.

In a fourth embodiment, although the energization cycle in the individual control is set to a fixed cycle such that the fuel discharge amount from the high-pressure fuel pump 40 is the maximum discharge amount and the fastest driving cycle is achieved. However, other cycles may be adopted as the fixed cycle.

In the second embodiment and the fourth embodiment, the injection interval Int is calculated as a period from when fuel injection ends until when the next fuel injection starts. The manner of calculating the injection interval Int is not limited to this. For example, a period from when fuel injection starts until when the next fuel injection starts, a period from when fuel injection starts until when the next fuel injection ends, or a period from when fuel injection ends until when the next fuel injection ends may be calculated as the injection interval Int.

In the respective embodiments, the discharge ratio is changed by changing the number of times of discharge in accordance with the operational state of the internal combustion engine. Instead of the configuration as described above, it is also possible to adopt a configuration in which the discharge ratio setting unit that changes the discharge ratio in accordance with the operational state of the internal combustion engine is provided, and the discharge number-of-times Tn for the high-pressure fuel pump 40 is set such that the discharge ratio set by the discharge ratio setting unit is achieved. Even in the above-described case, it is desirable to limit the upper limit of the discharge ratio, based on the fuel injection interval Int. Both in a case where the discharge ratio is changed by changing the number of times of discharge in accordance with the operational state of the internal combustion engine and in a case where the discharge ratio is changed by setting the discharge ratio based on the operational state of the internal combustion engine, the discharge ratio is set as follows.

Figure 16:
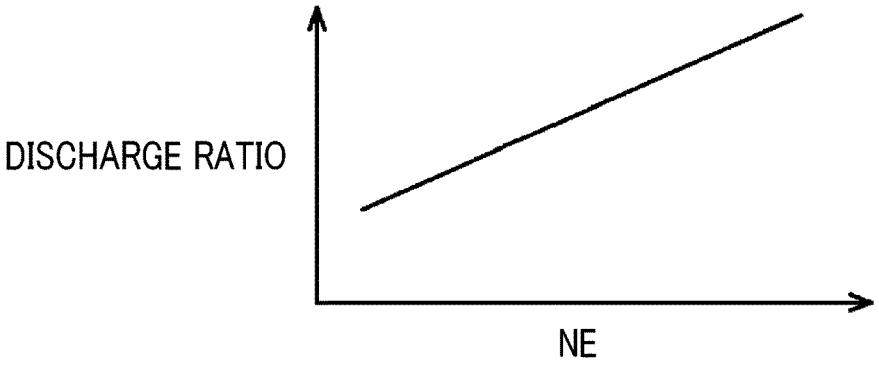
FIG. 16 is a map illustrating an example of a relationship between the engine speed and the discharge ratio.
Figure 17:
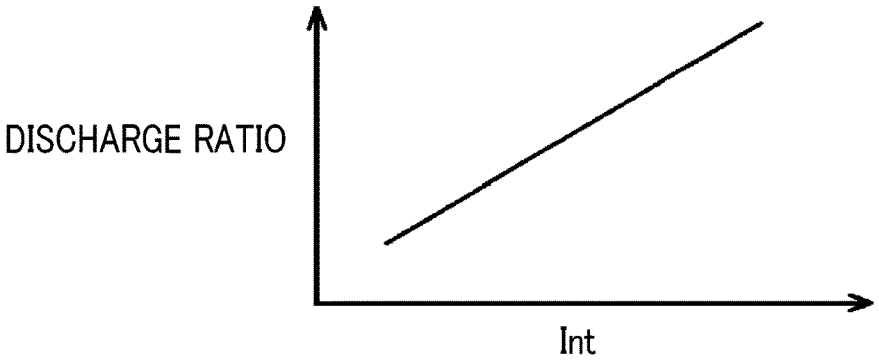
FIG. 17 is a map illustrating an example of a relationship between an injection interval and the discharge ratio.

As illustrated in FIG. 16, the discharge ratio when the engine speed NE is high is smaller than the discharge ratio when the engine speed NE is low. As illustrated in FIG. 17, the discharge ratio when the fuel injection interval Int is short is smaller than the discharge ratio when the injection interval Int is long. When the operational state of the internal combustion engine 10 is, for example, a high-speed rotation low-load state, the injection interval Int is shorter than that at the time of a low-speed rotation low-load state. In this case, fuel discharge can be completed within the injection interval Int by making the discharge ratio smaller. In the example of the fourth embodiment, the operational state of the internal combustion engine 10 is a low-load state and the target discharge amount TPt is small. Therefore, even in a case where the discharge ratio is small, the fuel in an amount corresponding to the target discharge amount TPt can be discharged from the high-pressure fuel pump 40 to the high-pressure fuel pipe 34.

It is also possible to calculate and set the discharge ratio through map computation based on both the load KL on the internal combustion engine 10 and the engine speed NE of the internal combustion engine 10. In a case where the configuration as described above is adopted, the computation load when the discharge ratio is calculated can be reduced as compared to a case where the discharge ratio is calculated through a plurality of computing equations or the like.

Figure 18:
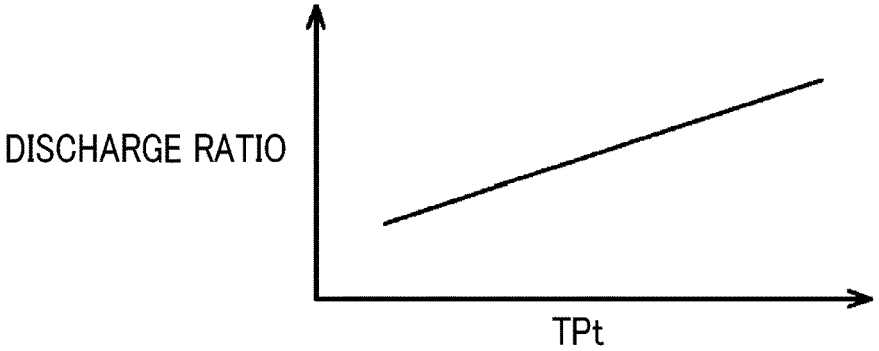
FIG. 18 is a map illustrating an example of a relationship between the target discharge amount and the discharge ratio.

As illustrated in FIG. 18, when the target discharge amount TPt is relatively large, a configuration in which the discharge ratio is made higher than that when the target discharge amount TPt is relatively small can also be adopted. When the discharge ratio is changed by changing the number of times of discharge in accordance with a change in the operational state of the internal combustion engine, the discharge ratio can be made smaller by making the number of times of discharge smaller.

In the inter-injection discharge control in the respective embodiments, between the Nth fuel injection and the (N+1) th fuel injection, fuel discharge is started at a timing at which the preparation time has elapsed after the Nth fuel injection ends, which is used as the predetermined timing. The predetermined timing in the inter-injection discharge control may be changed as appropriate. For example, the end timing Fe of the Nth fuel injection may be calculated as the discharge start timing Ts without taking the preparation time into consideration. In this case, fuel discharge is started at the timing at which the fuel injection ends. A configuration in which a predetermined timing later than the start timing of the Nth fuel injection and earlier than the end timing Fe of the fuel injection is calculated as the discharge start timing Ts may be adopted. In this case, the fuel discharge is started at a predetermined timing within the fuel injection period of the Nth fuel injection. In the above-described configuration, by setting the end timing of fuel discharge to a timing within a period from when the Nth fuel injection ends until when the (N+1)th fuel injection is started, the fuel discharge can be executed so as to overlap only the fuel injection period of the Nth fuel injection from the fuel injection valve 15 in the inter-injection discharge control. In the above-described configuration, by setting the end timing of the fuel discharge to a timing within a period from when the (N+1)th fuel injection starts until when the (N+1)th fuel injection ends, the fuel discharge can be executed so as to overlap both the fuel injection periods of the Nth fuel injection from the fuel injection valve 15 and the (N+1)th fuel injection from the fuel injection valve 15 in the inter-injection discharge control. In the inter-injection discharge control, it is also possible to execute the fuel discharge such that the fuel discharge overlaps only the fuel injection period of the (N+1)th fuel injection from the fuel injection valve 15. The configuration as described above can be implemented, for example, by adopting a configuration in which fuel discharge is started at a timing later than the start timing of the (N+1)th fuel injection and ending the fuel discharge at a timing earlier than the end timing Fe of the (N+1)th fuel injection. The configuration as described above can also be implemented by adopting a configuration in which the start timing of fuel discharge is set to a timing within a period from when the Nth fuel injection ends until when the (N+1)th fuel injection is started and the fuel discharge ends at a timing later than the start timing of the (N+1)th fuel injection and earlier than the end timing of the (N+1)th fuel injection. As described above, the interval between the Nth fuel injection and the (N+1)th fuel injection corresponds to a predetermined period from the start timing of the Nth fuel injection to the end timing of the (N+1)th fuel injection.

In the respective embodiments, the manner of setting the standby time may be changed as appropriate. For example, the standby time may be set to a time shorter than or a time longer than the time required for the plunger 75 to move toward the second side, after the energization control for the high-pressure fuel pump 40 ends, until the plunger 75 abuts against the protruding part 83 from a state where the protruding portion 75B of the plunger 75 of the high-pressure fuel pump 40 abuts against the insertion part 56. Similarly, the standby time may be set by changing the lift time Ti that is the energization time to the high-pressure fuel pump 40 as appropriate.

In the respective embodiments, the discharge ratio is set to a value within a range from a value smaller than one to a value larger than one. Instead of the configuration as described above, a configuration in which by setting the discharge ratio within a range larger than one, fuel discharge is reliably performed one or more times per one fuel injection may be adopted. Alternatively, a configuration in which by setting the discharge ratio within a range smaller than one, the number of times of fuel discharge per one fuel injection is always made smaller than one time may be adopted.

The fuel in the fuel tank 31 may be suctioned by the high-pressure fuel pump 40. In this case, the low-pressure fuel pump 32 and the low-pressure fuel pipe 33 may be omitted. The configuration of the high-pressure fuel pump 40 may be changed as appropriate. For example, the plunger 75 is constituted of a round-bar part made of a material different from the magnetic material and inserted through the cylinder 57, and a magnetic part coupled to a first end of the round-bar part and made of the magnetic material. It is also possible to adopt a configuration in which the magnetic part is moved by a magnetic field generated by energizing the coil 85 to displace the plunger 75 to change the volume of the pressurizing chamber 78. In short, the control device for a fuel pump, which is the same as that in the respective embodiments, may be applied to any fuel pump in which the plunger 75 can be reciprocated through energization and which performs a suction function of suctioning fuel and a discharge function of pressurizing and discharging the suctioned fuel through reciprocation of the plunger 75.

The electronic control unit 100, 400 for a fuel pump has a function of controlling the driving of the fuel injection valve 15 and a function of controlling the driving of the throttle valve 21. These functions may be provided to a controller different from the electronic control unit 100, 400 for a fuel pump. In this case, the electronic control unit 100, 400 and the controller are configured to be communicable with each other, and the driving of the fuel pump can be controlled in a manner similar to that in the respective embodiments, by causing the control device 100, 400 and the controller to transmit and receive necessary information.

What is claimed is:

1. A control device for a fuel pump including a cylinder, a plunger provided to be slidable inside the cylinder of the fuel pump, and an electric actuator configured to move the plunger, the fuel pump being an electric fuel pump configured to supply fuel to a fuel pipe to which a fuel injection valve is coupled, the fuel injection valve being disposed so as to inject fuel into a cylinder of an internal combustion engine, and the fuel pump being configured to perform suction of fuel and discharge of fuel as the plunger reciprocates by an energization control to the electric actuator, the control device comprising an electronic control unit configured to:

execute an inter-injection discharge control of executing fuel discharge from the fuel pump at a predetermined timing between an Nth fuel injection and an (N+1)th fuel injection from the fuel injection valve; and change a discharge ratio in accordance with an operational state of the internal combustion engine during the execution of the inter-injection discharge control, the discharge ratio being a ratio of the number of times of fuel discharge from the fuel pump to the fuel pipe to the number of times of fuel injection from the fuel injection valve.

2. The control device according to claim 1, wherein the electronic control unit is configured to execute one of the following controls i) and ii):

i) control of making the discharge ratio smaller when a rotation speed of the internal combustion engine is high than when the rotation speed is low; and ii) control of making the discharge ratio smaller when an injection interval of fuel in the fuel injection valve is short than when the injection interval is long.

3. The control device according to claim 1, wherein the electronic control unit is configured to set the discharge ratio to a higher value when a target discharge amount is large compared to the discharge ratio when the target discharge amount is small, and the target discharge amount is a target value of a fuel discharge amount from the fuel pump.

4. The control device according to claim 1, wherein the electronic control unit is configured to set the discharge ratio to a value higher than one during the execution of the inter-injection discharge control.

5. The control device according to claim 1, wherein the electronic control unit is configured to set the discharge ratio to a value lower than one during the execution of the inter-injection discharge control.

6. The control device according to claim 1, wherein the electronic control unit is configured to set an upper limit of the discharge ratio, based on a fuel injection interval between execution of a present fuel injection and execution of next fuel injection.

7. The control device according to claim 1, wherein the electronic control unit is configured to change the discharge ratio, based on a target discharge amount that is a target value of a fuel discharge amount from the fuel pump to the fuel pipe.

8. The control device according to claim 7, wherein:

the electronic control unit is configured to perform calculation so as to make the target discharge amount lager when a load of the internal combustion engine is high than when the load of the internal combustion engine is low; and the electronic control unit is configured to perform calculation so as to make the target discharge amount larger when a rotation speed of the internal combustion engine is high than when the rotation speed of the internal combustion engine is low.

9. The control device according to claim 1, wherein the electronic control unit is configured to set the discharge ratio to a higher value when a load of the internal combustion engine is high than when the load of the internal combustion engine is low.

10. The control device according to claim 1, wherein:

the electronic control unit is configured to execute the inter-injection discharge control when a fuel injection interval between the execution of a present fuel injection and the execution of next fuel injection is equal to or more than a required time that is a time required to discharge fuel one time from the fuel pump; and the electronic control unit is configured to execute an individual control of repeatedly performing discharge of fuel in a fixed cycle when the injection interval is shorter than the required time.

11. The control device according to claim 1, wherein the electronic control unit is configured to set a timing at which fuel discharge is executed so as not to overlap a fuel injection period that is a period in which fuel is injected from the fuel injection valve, in the inter-injection discharge control.

12. The control device according to claim 1, wherein the electronic control unit is configured to execute fuel discharge from the fuel pump after an end of the Nth fuel injection and before a start of the (N+1)th fuel injection, in the inter-injection discharge control.

13. The control device according to claim 1, wherein the electronic control unit is configured to execute fuel discharge from the fuel pump so as to overlap a fuel injection period of any of the Nth fuel injection and the (N+1)th fuel injection within a period from a start of the Nth fuel injection to an end of the (N+1)th fuel injection, in the inter-injection discharge control.

14. The control device according to claim 1, wherein:

the electronic control unit is configured not to perform the fuel discharge from the fuel pump to the fuel pipe when a difference between a target fuel pressure and an actual fuel pressure of the fuel pipe is less than a predetermined value during the execution of the inter-injection discharge control; and the electronic control unit is configured to perform the fuel discharge from the fuel pump to the fuel pipe until next fuel injection is started when the difference between the target fuel pressure and the actual fuel pressure is more than the predetermined value.

15. A control method of a fuel pump including a cylinder, a plunger provided to be slidable inside the cylinder of the fuel pump, and an electric actuator configured to move the plunger, the fuel pump being an electric fuel pump configured to supply fuel to a fuel pipe to which a fuel injection valve is coupled, the fuel injection valve being disposed so as to inject fuel into a cylinder of an internal combustion engine, and the fuel pump being configured to perform suction of fuel and discharge of fuel as the plunger reciprocates by an energization control to the electric actuator, the control method comprising:

executing, by an electronic control unit, an inter-injection discharge control of executing fuel discharge from the fuel pump at a predetermined timing between an Nth fuel injection and an (N+1)th fuel injection from the fuel injection valve; and changing, by the electronic control unit, a discharge ratio in accordance with an operational state of the internal combustion engine during the execution of the inter-injection discharge control, the discharge ratio being a ratio of the number of times of discharge of fuel from the fuel pump to the fuel pipe to the number of times of fuel injection from the fuel injection valve.

* * * * *